US006652064B2

(12) United States Patent
Bruch et al.

(10) Patent No.: US 6,652,064 B2
(45) Date of Patent: Nov. 25, 2003

(54) METHOD FOR IMPROVING IMAGE QUALITY ON PLOTS

(75) Inventors: Xavier Bruch, Barcelona (ES); Lidia Calvo, San Diego, CA (US); Jose Jurjo, Barcelona (ES); Antoni Murcia, San Diego, CA (US); Xavier Girones, Tarragona (ES); Christopher Taylor, Coconut Grove, FL (US); Ramon Vega, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/839,268

(22) Filed: Apr. 20, 2001

(65) Prior Publication Data

US 2002/0027575 A1 Mar. 7, 2002

(30) Foreign Application Priority Data

Apr. 20, 2000 (EP) ..... 00108056

(51) Int. Cl.[7] ..... B41J 2/165
(52) U.S. Cl. ..... 347/23; 347/19
(58) Field of Search ..... 347/19, 23, 40, 347/41

(56) References Cited

U.S. PATENT DOCUMENTS 5,627,571 A 5/1997 Anderson et al. ..... 347/19
6,238,112 B1 * 5/2001 Girones et al. ..... 400/74

FOREIGN PATENT DOCUMENTS

| | | |
|---|---|---|
| EP | 0443832 A1 | 2/1991 |
| EP | 0499432 A2 | 2/1992 |
| EP | 0622202 A2 | 4/1994 |
| EP | 0767067 A1 | 9/1996 |
| EP | 0911172 A2 | 10/1998 |
| WO | WO 96/3266 | 10/1996 |

* cited by examiner

*Primary Examiner*—Craig Hallacher

(57) ABSTRACT

An inkjet printing device for printing plots comprises a printhead, which has a plurality of nozzles each nozzle having at least a working status and a failing status, a servicing unit capable of applying recovery functions to said plurality of nozzles, detection means for checking if a nozzles is in a working status or in a failing status, memory means and a plurality of functions executable by said device to improve image quality. Said memory means, responsive to said detection means, contains data on how the status of a nozzle is varying over time. Said device further comprises means to select and execute at least one of said plurality of functions, responsive to the data stored in said memory means. A method of improving image quality on plots produced by said device said method comprising the steps of: checking the status of one or more nozzles; storing in a memory support the status of a checked nozzle as detected during said checking step; and based on a plurality of said statuses stored over time in said memory support, performing an appropriate function form said variety for improving the image quality.

11 Claims, 29 Drawing Sheets

METHOD FOR IMPROVING IMAGE QUALITY ON PLOTS

FIELD OF THE INVENTION

The present invention relates to inkjet printing devices, and particularly although not exclusively to a method for improving image quality on plots.

BACKGROUND OF THE INVENTION lnkjet printing mechanisms may be used in a variety of different printing devices, such as plotters, facsimile machines or inkjet printers. Such printing devices print images using a colorant, referred to generally herein as "ink." These inkjet printing mechanisms use inkjet cartridges, often called "pens," to shoot drops of ink onto a page or sheet of print media. Some inkjet print mechanisms carry an ink cartridge with an entire supply of ink back and forth across the sheet. Other inkjet print mechanisms, known as "off-axis" systems, propel only a small ink supply with the printhead carriage across the printzone, and store the main ink supply in a stationary reservoir, which is located "off-axis" from the path of printhead travel. Typically, a flexible conduit or tubing is used to convey the ink from the off-axis main reservoir to the printhead cartridge. In multi-color cartridges, several printheads and reservoirs are combined into a single unit, with each reservoir/printhead combination for a given color also being referred to herein as a "pen".

Each pen has a printhead that includes very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporisation chambers is located between a nozzle orifice plate and a substrate layer. This substrate layer typically contains linear arrays of heater elements, such as resistors, which are energised to heat ink within the vaporisation chambers. Upon heating, an ink droplet is ejected from a nozzle associated with the energised resistor.

To print an image, the printhead is scanned back and forth across a printzone above the sheet, with the pen shooting drops of ink as it moves. By selectively energising the resistors as the printhead moves across the sheet, the ink is expelled in a pattern on the print media to form a desired image (e.g., picture, chart or text). The nozzles are typically arranged in one or more linear arrays. If more than one, the two linear arrays are located side-by-side on the printhead, parallel to one another, and substantially perpendicular to the scanning direction. Thus, the length of the nozzle arrays defines a print swath or band. That is, if all the nozzles of one array were continually fired as the printhead made one complete traverse through the printzone, a band or swath of ink would appear on the sheet. The height of this band is known as the "swath height" of the pen, the maximum pattern of ink which can be laid down in a single pass.

The orifice plate of the printhead, tends to pick up contaminants, such as paper dust, and the like, during the printing process. Such contaminants adhere to the orifice plate either because of the presence of ink on the printhead, or because of electrostatic charges. In addition, excess dried ink can accumulate around the printhead. The accumulation of either ink or other contaminants can impair the quality of the output by interfering with the proper application of ink to the printing medium. In addition, if colour pens are used, each printhead may have different nozzles which each expel different colours. If ink accumulates on the orifice plate, mixing of different coloured inks (cross-contamination) can result during use. If colours are mixed on the orifice plate, the quality of the resulting printed product can be affected. For these reasons, it is desirable to clear the printhead orifice plate of such contaminants and ink on a routine basis to prevent the build up thereof. Furthermore, the nozzles of an ink-jet printer can clog, particularly if the pens are left uncapped in an office environment.

In an off-axis pen, life goal is on the order of 40 times greater than a conventional non off-axis system, e.g. the printhead cartridges available in DesignJet® 750C color printers, produced by Hewlett-Packard Company, of Palo Alto, Calif., the present assignee. Living longer and firing more drops of ink means that there are greater probability that the printer print quality degrade and/or deviate along life. This requires finding better ways to keep functional and stable our printheads during long periods and large volumes of ink fired.

In order to maintain the quality of the printed output of the printer device it is important to improve the certainty that each instruction to the printhead to produce an ink drop from a nozzle of the plurality of nozzles does will produce such an ink drop (i.e. good servicing of the printhead and replacing nozzles out with working nozzles in performing error hiding).

In the present application, the term plot means a printed output of any kind or size produced by a printing device. For instance a plot could be a printed CAD image or a printed graphic image like a photo or a poster or any other kind of printed image reproduction.

In U.S. Pat. No. 5,455,608 it is described how a printer may adjusts servicing of the pen based on the result of the current drop detection step only. Before starting a plot these printers perform a drop detection on all the pens to detect if there are any non-firing nozzles ("nozzles out"). If a single nozzle out is detected in a pen, the printer triggers a so called automatic recovery servicing process for servicing the malfunctioning pen to recover the malfunctioning nozzle(s).

This process includes a sequence of 3 nozzle servicing or clearing procedures of increasing severity which are performed in sequence so long as some of the nozzles of the printhead fail to fire ink drops pursuant to ink firing pulses provided to the printhead or until all of the procedures have been performed.

At the end of each of these procedures a new drop detection is performed on the pen, to verify if the pen is fully recovered. If, according to the current result of the drop detection, it is not, the subsequent servicing procedure is performed. If, at the end of the 3 functions, the pen is still not fully recovered (i.e. at least one nozzles is still out) the user is reported to replace the pen or to disable the nozzle check. One big drawback of this system when implemented, e.g. as in DesignJet© 750 C printers, is that if the printer is not able to fully recover the failing nozzles or there are some unstable nozzles, the system will remain in this recovery servicing mode until the decease of the printhead, being forced, by the permanent nozzle out, to run this process at the beginning of each plot. This usually leads to either an unacceptable loss of throughput and printer productivity (because the printer stops and waits for an answer, the automatic recovery process is very time consuming, and causes a big waste of ink particularly when running the priming functions) or to excessive printhead replace or continue messages that users disable nozzle check via front panel, causing throughput losses.

European Patent Application no. 99 103283.0 in the name Hewlett-Packard Company (Docket number 60980059) describes a technique for servicing a printhead, by checking the status of the printhead by means of a drop detector sensing ink droplets fired by the nozzles of such a printhead. This technique monitors the more recent status of the nozzles and employs an incremental counter, reporting in a condensed way a number of historical statuses of the nozzles, to decide whether or not executing a recovery service on the printhead. In particular the recovery algorithm comprises 3 different servicing procedures (spitting, wiping, priming) which are applied in sequence, from the softer servicing (spitting) to the stronger one (priming), to the printhead. The decision to pass from one servicing procedure to the next one in the sequence is based on the monitored efficacy of the currently applied servicing procedure, i.e. if a servicing procedure is increasingly recovering nozzles, this is usually repeated; if not, a stronger servicing procedure is started to attempt the recovery of the still malfunctioning nozzles. However, monitoring only the efficacy of a servicing procedure, implies the fact that some non-efficacious procedures (sometime these may affect the lifetime of the printhead itself) are often performed and than abandoned. The performance of useless, or even damaging, servicing procedures is then increasing the length of the entire recovery algorithm. In addition such unneeded recoveries may generate wear in the nozzle plate and in the component of service station and possibly a waste of ink. Finally the execution of wrong servicing may generate additional defects in the printhead.

SUMMARY OF THE INVENTION

The specific embodiments and methods according to the present invention aim to improve the efficiency and the efficacy of the recovery process thereby improving printing quality and the functional lifetime of the plurality of nozzles.

According to an aspect of the present invention, there is provided a method of improving image quality on plots produced by a printhead, which has a plurality of nozzles, mounted in an inkjet printing device for printing plots, each nozzle having at least a working status and a failing status and such printing device is capable of performing a variety of functions to improve image quality, said method comprises the steps of: (a) checking the status of one or more nozzles; (b) storing in a memory support the status of a checked nozzle as detected during said checking step; and (c) based on a plurality of said statuses stored over time in said memory support, performing an appropriate function form said variety for improving the image quality.

The fact that data on historical statuses nozzles are stored in a memory support allows to better evaluate what sort of functions can be executed to improve image quality. Generally error hiding techniques base their generation of print masks taking into account the current status of the nozzles only, e.g. when using printed test patterns, either automatically or manually checked. The capability of executing a process(s) or function(s) based on how the status of the nozzle(s) changed over time, gives great flexibility and accuracy in selecting the one which can achieve an higher image quality on plots, fitting with the current health of the printhead.

Preferably, a nozzle in the failing status comprise a malfunctioning nozzle or an aberrant nozzle.

In a preferred embodiment, the variety of functions comprises (i) one or more error hiding function for replacing nozzles in a failing status with nozzles in a working status while printing plots and (ii) one or more servicing functions for recovering a nozzle in failing status back to a working status.

In this way, i.e. applying error hiding or servicing functions, the method is trying to control and improve the failures, affecting the image quality, which are less stable during the life of a printhead.

Typically, one or more servicing functions are applied in sequence if the nozzle is still in a failing status and after applying one or more servicing functions, one or more error hiding functions are also applied to hide a nozzle still in a failing status.

Accordingly, performing different level of functions, depending on the persistency of the failure, allows to reduce the waste of time in the servicing and to control the wear of the nozzle plate by not applying non-required functions.

More preferably, The method further comprises the step of identifying the cause of failure of a nozzle in a failing status, before the step of performing said appropriate function.

The identification of what is causing the failure of the printhead allows to improving the efficiency and efficacy of the recovery process. Firstly, an appropriate recovery can be often identified before executing any additional recovery functions, so speeding up the entire process. Secondarily, by allowing to skip the unnecessary functions and to apply only the ones that are more likely to solve or improve the failure, this can reduce most of the problems generated by the execution these unneeded or wrong functions.

Preferably, the step of identifying comprises the step of observing how the status of the nozzle is changing over time. Advantageously, said step of identifying the cause of failure of a nozzle in a failing status is based on examining said plurality of statuses individually stored over time in said memory support.

Contrary to what suggested in the EP Application no. 99 103283.0 cited above, the collection of data relative to the failures is now stored individually and not incrementally, in order to gives to a pattern recognition algorithm enough details over the previous statuses of the nozzles. This allows to track the evolution of the failure and so an easier identification of the possible causes of the defect(s) of the nozzle(s) or the printhead.

Viewing a second aspect of the present invention, there is also provided a computer program which comprises computer program code means performing the following steps when said program is run on an inkjet printing device comprising a printhead, having a plurality of nozzles, and said printing device being capable of performing a variety of functions for improving image quality: (a) enabling the device to check the status of one or more nozzles; (b) storing in a memory support the status of a checked nozzle as detected during said checking step; and (c) based on a plurality of said statuses stored over time in said memory support, enabling the device to perform an appropriate function for improving the image quality.

Viewing a forth aspect of the present invention, there is also provided an inkjet printing device for printing plots which comprises a printhead, having a plurality of nozzles, a servicing unit capable of applying recovery functions to said plurality of nozzles, detection means for checking if a nozzles is in a working status or in a failing status, memory means and a plurality of functions executable by said device to improve image quality; said memory means, responsive to said detection means, contains data on how the status of a nozzle is varying over time and said device further comprises means to select and execute at least one of said plurality of functions, responsive to the data stored in said memory means.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described by way of example the best mode contemplated by the inventors for carrying out the invention. In the following description numerous specific details are set forth in order to provide a thorough understanding of the present invention. It will be apparent however, to one skilled in the art, that the present invention may be practiced without limitation to these specific details, including the fact that computer program code can be utilized for carrying out part or entire methods, algorithms, processes, functions, procedures, as described in the present application. In other instances, well known methods and structures have not been described in detail so as not to unnecessarily obscure the present invention.

Specific methods according to the present invention described herein are aimed at printer devices having a printhead comprising a plurality of nozzles, each nozzle of the plurality of nozzles being configured to eject a stream of droplets of ink. Printing to a print medium is performed by moving the printhead into mutually orthogonal directions in between print operations as described herein before. However, it will be understood by those skilled in the art that general methods disclosed and identified in the claims herein, are not limited to printer devices having a plurality of nozzles or printer devices with moving print heads.

Figure 1:
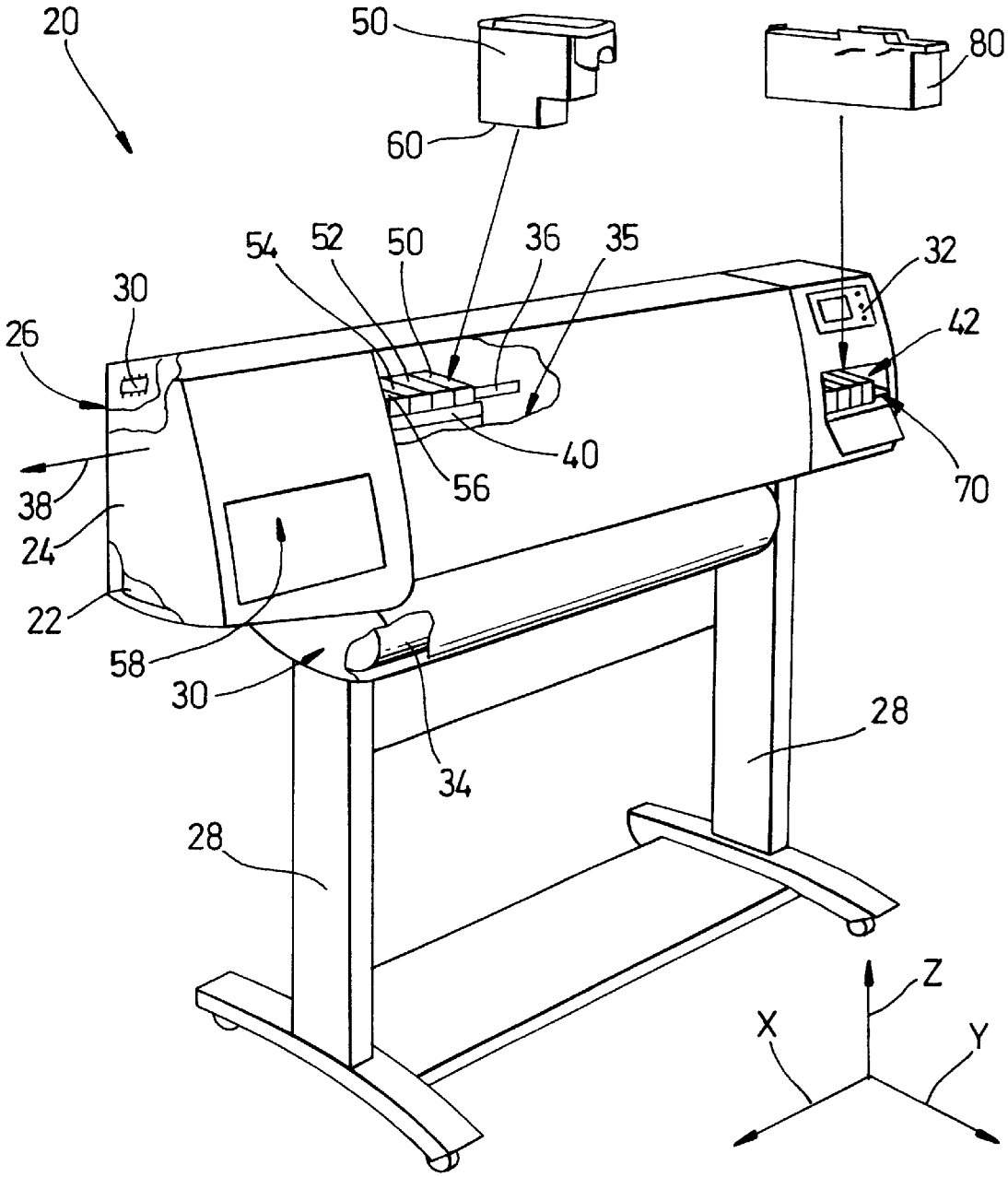
FIG. 1 is a perspective view of one form of an inkjet printing mechanism, here an inkjet printer, including one form of an inkjet printhead cleaner service station system of the present invention, shown here to service a set of inkjet printheads.

FIG. 1 illustrates a first embodiment of an inkjet printing mechanism, here shown as an inkjet printer 20, constructed in accordance with the present invention, which may be used for printing conventional engineering and architectural drawings, as well as high quality poster-sized images, and the like, in an industrial, office, home or other environment. A variety of inkjet printing mechanisms are commercially available. For instance, some of the printing mechanisms that may embody the present invention include desk top printers, portable printing units, copiers, video printers, all-in-one devices, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material, together forming a print assembly portion 26 of the printer 20. While it is apparent that the print assembly portion 26 may be supported by a desk or tabletop, it is preferred to support the print assembly portion 26 with a pair of leg assemblies 28. The printer 20 also has a printer controller, illustrated schematically as a microprocessor 30, that receives instructions from a host device, typically a computer, such as a personal computer or a computer aided drafting (CAD) computer system (not shown). The printer controller 30 may also operate in response to user inputs provided through a key pad and status display portion 32, located on the exterior of the casing 24. A monitor coupled to the computer host may also be used to display visual information to an operator, such as the printer status or a particular program being run on the host computer. Personal and drafting computers, their input devices, such as a keyboard and/or a mouse device, and monitors are all well known to those skilled in the art.

A conventional print media handling system (not shown) may be used to advance a continuous sheet of print media 34 from a roll through a printzone 35. The print media may be any type of suitable sheet material, such as paper, poster board, fabric, transparencies, mylar, and the like, but for convenience, the illustrated embodiment is described using paper as the print medium. A carriage guide rod 36 is mounted to the chassis 22 to define a scanning axis 38, with the guide rod 36 slideably supporting an inkjet carriage 40 for travel back and forth, reciprocally, across the printzone 35. A conventional carriage drive motor (not shown) may be used to propel the carriage 40 in response to a control signal received from the controller 30. To provide carriage positional feedback information to controller 33, a conventional metallic encoder strip (not shown) may be extended along the length of the printzone 35 and over the servicing region 42. A conventional optical encoder reader may be mounted on the back surface of printhead carriage 40 to read positional information provided by the encoder strip, for example, as described in U.S. Pat. No. 5,276,970, also assigned to Hewlett-Packard Company, the assignee of the present invention. The manner of providing positional feedback information via the encoder strip reader, may also be accomplished in a variety of ways known to those skilled in the art. Upon completion of printing an image, the carriage 40 may be used to drag a cutting mechanism across the final trailing portion of the media to sever the image from the remainder of the roll 34. Suitable cutter mechanisms are commercially available in DesignJet® 650C and 750C color printers. Of course, sheet severing may be accomplished in a variety of other ways known to those skilled in the art. Moreover, the illustrated inkjet printing mechanism may also be used for printing images on pre-cut sheets, rather than on media supplied in a roll 34.

Figure 2:
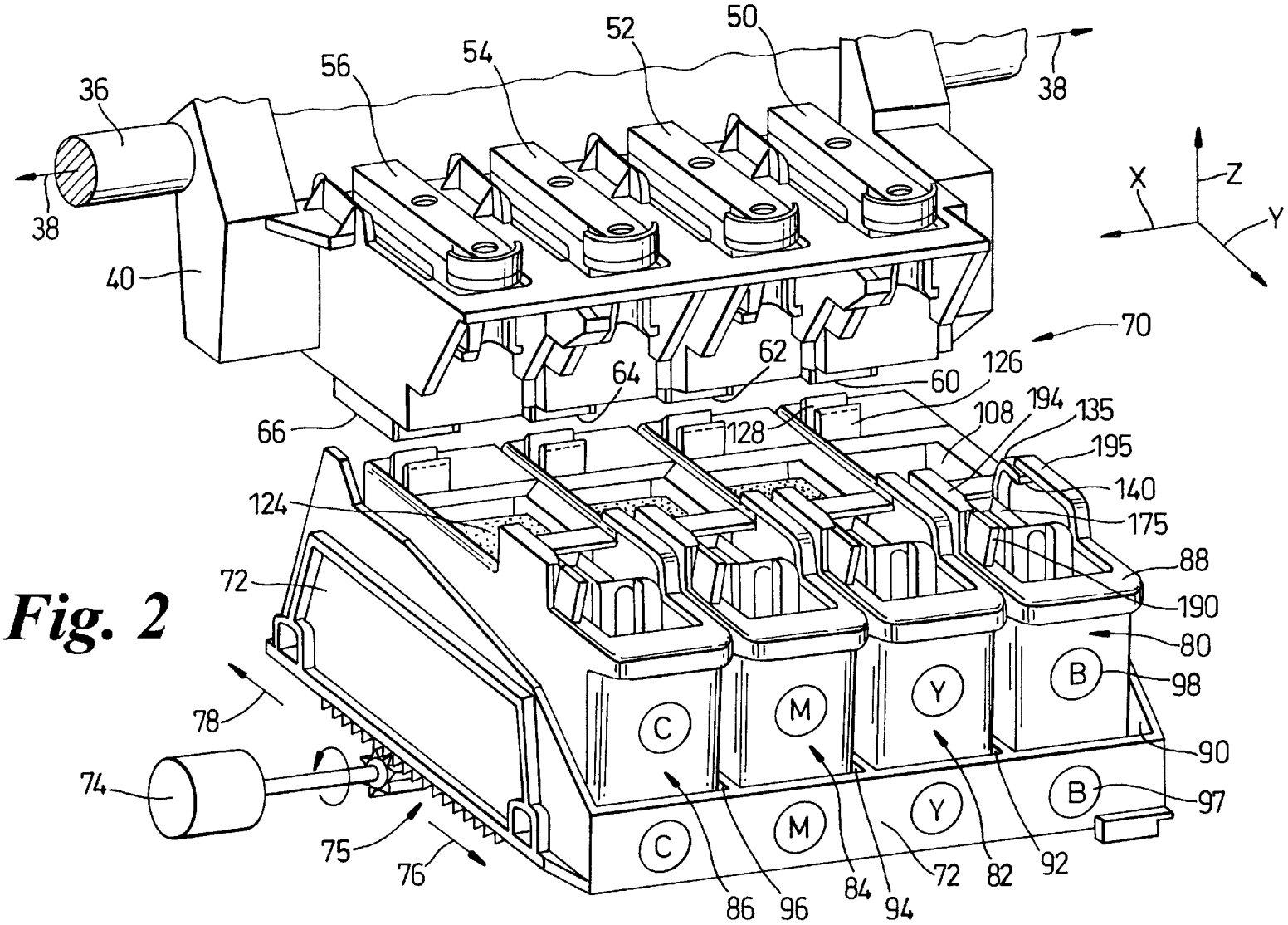
FIG. 2 is an enlarged perspective view of the service station system of FIG. 1.

In the printzone 35, the media sheet receives ink from an inkjet cartridge, such as a black ink cartridge 50 and three monochrome color ink cartridges 52, 54 and 56, shown in greater detail in FIG. 2. The cartridges 50–56 are also often called "pens" by those in the art. The black ink pen 50 is illustrated herein as containing a pigment-based ink. For the purposes of illustration, color pens 52, 54 and 56 are described as each containing a dye-based ink of the colors yellow, magenta and cyan, respectively, although it is apparent that the color pens 52–56 may also contain pigment-based inks in some implementations. It is apparent that other types of inks may also be used in the pens 50–56, such as paraffin-based inks, as well as hybrid or composite inks having both dye and pigment characteristics. The illustrated printer 20 uses an "off-axis" ink delivery system, having main stationary reservoirs (not shown) for each ink (black, cyan, magenta, yellow) located in an ink supply region 58. In this off-axis system, the pens 50–56 may be replenished by ink conveyed through a conventional flexible tubing system (not shown) from the stationary main reservoirs, so only a small ink supply is propelled by carriage 40 across the printzone 35 which is located "off-axis" from the path of printhead travel. As used herein, the term "pen" or "cartridge" may also refer to replaceable printhead cartridges where each pen has a reservoir that carries the entire ink supply as the printhead reciprocates over the printzone.

The illustrated pens 50, 52, 54 and 56 have printheads 60, 62, 64 and 66, respectively, which selectively eject ink to from an image on a sheet of media 34 in the printzone 35. These inkjet printheads 60–66 have a large print swath, for instance about 20 to 25 millimeters (about one inch) wide or wider, although the printhead maintenance concepts described herein may also be applied to smaller inkjet printheads. The concepts disclosed herein for cleaning the printheads 60–66 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 60, 62, 64 and 66 each have an orifice plate with a plurality of nozzles formed therethrough in a manner well known to those skilled in the art. The nozzles of each printhead 60–66 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction substantially perpendicular to the scanning axis 38, with the length of each array determining the maximum image swath for a single pass of the printhead. The illustrated printheads 60–66 are thermal inkjet printheads, although other types of printheads may be used, such as piezoelectric printheads. The thermal printheads 60–66 typically include a plurality of resistors which are associated with the nozzles. Upon energizing a selected resistor, a bubble of gas is formed which ejects a droplet of ink from the nozzle and onto a sheet of paper in the printzone 35 under the nozzle. The printhead resistors are selectively energized in response to firing command control signals delivered from the controller 30 to the printhead carriage 40.

FIG. 2 shows the carriage 40 positioned with the pens 50–56 ready to be serviced by a replaceable printhead cleaner service station system 70, constructed in accordance with the present invention. The service station 70 includes a translationally moveable pallet 72, which is selectively driven by motor 74 through a rack and pinion gear assembly 75 in a forward direction 76 and in a rearward direction 78 in response to a drive signal received from the controller 30. The service station 70 includes four replaceable inkjet printhead cleaner units 80, 82, 84 and 86, constructed in accordance with the present invention for servicing the respective printheads 50, 52, 54 and 56. Each of the cleaner units 80–86 include an installation and removal handle 88, which may be gripped by an operator when installing the cleaner units 80–88 in their respective chambers or stalls 90, 92, 94, and the 96 defined by the service station pallet 72. Following removal, the cleaning units 80–86 are typically disposed of and replaced with a fresh unit, so the units 80–86 may also be referred to as "disposable cleaning units,"

although it may be preferable to return the spent units to a recycling centre for refurbishing. To aid an operator in installing the correct cleaner unit 80–86 in the associated stall 90–96, the pallet 72 may include indicia, such as a "B" marking 97 corresponding to the black pen 50, with the black printhead cleaner unit 80 including other indicia, such as a "B" marking 98, which may be matched with marking 97 by an operator to assure proper installation.

The cleaner unit 80–86 also includes a spittoon chamber 108. For the color cleaner units 82–86 the spittoon 108 is filled with an ink absorber 124, preferably of a foam material, although a variety of other absorbing materials may also be used. The absorber 124 receives ink spit from the color printheads 62–66, and the hold this ink while the volatiles or liquid components evaporate, leaving the solid components of the ink trapped within the chambers of the foam material. The spittoon 108 of the black cleaner unit 80 is supplied as an empty chamber, which then fills with the tar-like black ink residue over the life of the cleaner unit.

The cleaner unit 80–86 includes a dual bladed wiper assembly which has two wiper blades 126 and 128, which are preferably constructed with rounded exterior wiping edges, and an angular interior wiping edge, as described in the Hewlett-Packard Company's U.S. Pat. No. 5,614,930. Preferably, each of the wiper blades 126, 128 is constructed of a flexible, resilient, non-abrasive, elastomeric material, such as nitrile rubber, or more preferably, ethylene polypropylene diene monomer (EPDM), or other comparable materials known in the art. For wipers a suitable durometer, that is, the relative hardness of the elastomer, may be selected from the range of 35–80 on the Shore A scale, or more preferably within the range of 60–80, or even more preferably at a durometer of 70+/−5, which is a standard manufacturing tolerance.

For assembling the black cleaner unit 80, which is used to service the pigment based ink within the black pen 50, an ink solvent chamber (not shown) receives an ink solvent, which is held within a porous solvent reservoir body or block installed within the solvent chamber. Preferably, the reservoir block is made of a porous material, for instance, an open-cell thermoset plastic such as a polyurethane foam, a sintered polyethylene, or other functionally similar materials known to those skilled in the art. The inkjet ink solvent is preferably a hygroscopic material that absorbs water out of the air, because water is a good solvent for the illustrated inks. Suitable hygroscopic solvent materials include polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have an almost zero vapor pressure. For the purposes of illustration, the reservoir block is soaked with the preferred ink solvent, PEG.

To deliver the solvent from the reservoir, the black cleaner unit 80 includes a solvent applicator or member 135, which underlies the reservoir block.

The cleaner unit 80–86 also includes a cap retainer member 175 which can move in the Z axis direction, while also being able to tilt between the X and Y axes, which aids in sealing the printheads 60–66. The retainer 175 also has an upper surface which may define a series of channels or troughs, to act as a vent path to prevent depriming the printheads 60–66 upon sealing, for instance as described in the allowed U.S. patent application Ser. No. 08/566,221 currently assigned to the present assignee, the Hewlett-Packard Company.

The cleaner unit 80–86 also includes a snout wiper 190 for cleaning a rearwardly facing vertical wall portion of the printheads 60–66, which leads up to electrical interconnect portion of pens 50–56. The snout wiper 190 includes a base portion which is received within a snout wiper mounting groove 194 defined by the unit cover. While the snout wiper 190 may have combined rounded and angular wiping edges as described above for wiper blades 126 and 128, blunt rectangular wiping edges are preferred since there is no need for the snout wiper to extract ink from the nozzles. The unit cover also includes a solvent applicator hood 195, which shields the extreme end of the solvent applicator 135 and the a portion of the retainer member 175 when assembled.

Figure 3:
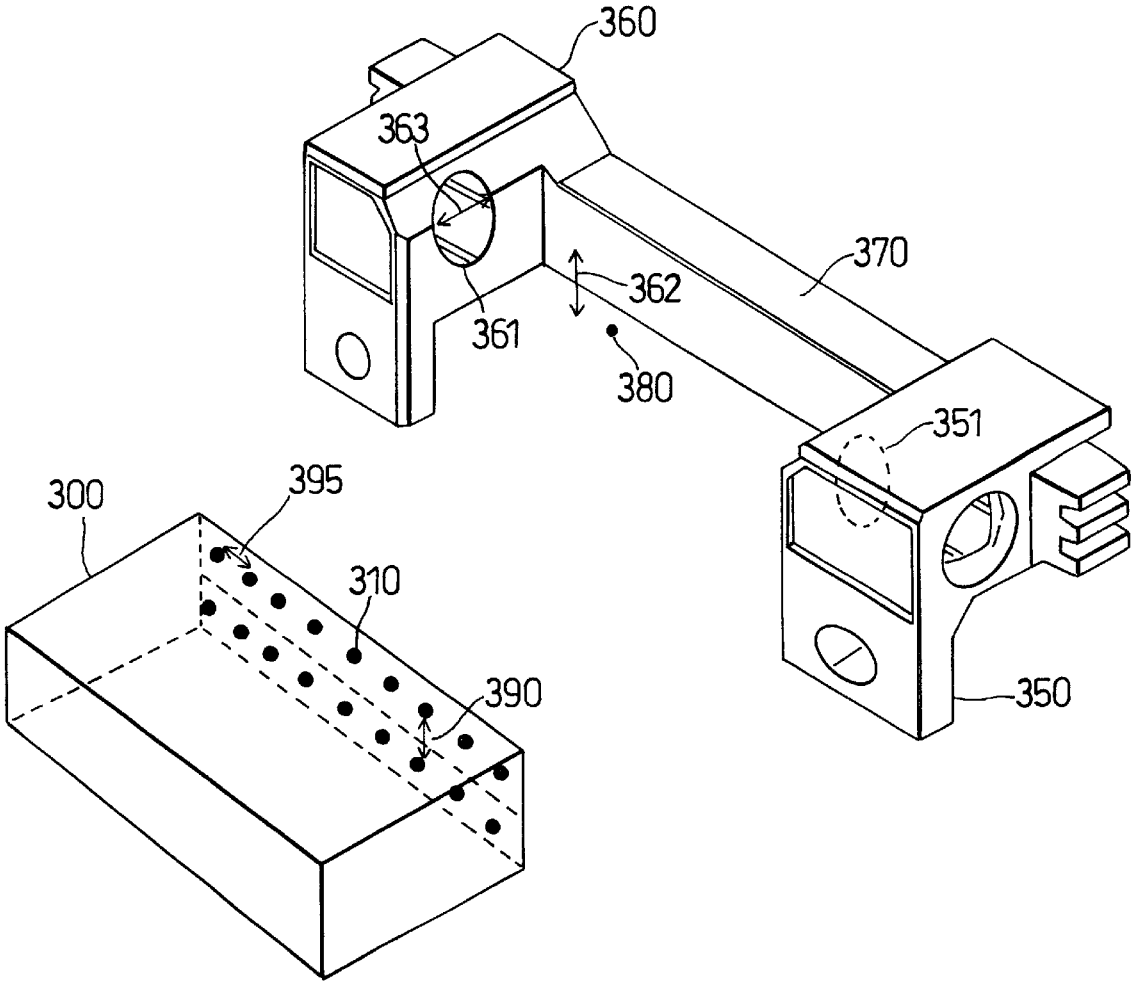
FIG. 3 illustrates schematically a printer head and detection device assembly according to a specific implementation of the present invention.

Referring to FIG. 3 herein, there is illustrated schematically a printer head and improved drop detection device according to a specific implementation of the present invention. A printer head 300 comprises an assembly of a plurality of printer nozzles 310. The printer head, in use, operates to eject a plurality of streams of ink drops which travel towards a print medium in a direction transverse to a main plane of the print medium, which typically comprises paper sheets, and in a direction transverse to a direction of travel of the print medium. Preferably the printer head 300 comprises two substantially parallel rows of printer nozzles 310, each row containing 262 printer nozzles. According to a specific method of the present invention, the printer nozzles in a first row are designated by odd numbers and the printer nozzles in a second row are designated by even numbers. Preferably a distance 390 between corresponding nozzles of the first and second rows is of the order 4 millimeters and a distance between adjacent printer nozzles 395 within a same row is 2/600 inches (0.085 millimeters). Corresponding nozzles between first and second rows are off set by a distance of 1/600 inches (0.042 millimeters) thereby yielding a printed resolution of 600 dots per inch (approx. 2.36 dots per cm) on the printed page.

The printer head 300 is configured, to spray or eject a single droplet of ink 380 from a single nozzle of the plurality of nozzles upon receiving a single drop release instruction signal.

When installed in a mass produced operational printer device, the printer head undergoes a test routine, for example when the printer device is first switched on, on every time the printer device is switched on, in order to check whether the printer head is operating correctly, and to check individual nozzles to see if any nozzles are malfunctioning or are anomalous. Malfunctioning nozzles may include nozzles which do not eject ink temporarily or permanently. Anomalous or aberrant nozzles may include nozzles which eject ink drops of a lower than average volume, nozzles which eject ink drops of a larger than average volume, nozzles which misfire, nozzles which malfunction by operating only intermittently, and nozzles which are misdirected. In the present application the term failing nozzles may comprise anomalous and/or malfunctioning nozzles.

Each nozzle 310 of the plurality of nozzles comprising printer head 300 are, according to the best mode presented herein, configurable to release a sequence of ink droplets in response to an instruction from the printer device. In addition to the printer head 300, there is also included an ink droplet detection means comprising a housing 360 containing an high intensity infra-red light emitting diode; a detector housing 350 containing a photo diode detector and an elongate, substantially rigid member 370. The emitter housing 360, rigid member 370 and detector housing 350 comprise rigid locating means configured to actively locate the high intensity infra-red light emitting diode with respect to the photo diode detector.

The printer head 300 and the rigid locating means 360, 370 and 350 are orientated with respect to each other such that a path traced by an ink droplet 380 ejected from a nozzle of the plurality of nozzles comprising the printer head 300 passes between emitter housing 360 and detector housing 350.

The high intensity infra-red light emitting diode contained within emitter housing 360 is encapsulated within a transparent plastics material casing. The transparent plastics material casing is configured so as to collimate the light emitted by the light emitting diode into a light beam. According to the best mode described herein, the collimated light beam emitted by the high intensity infra-red LED contained within emitter housing 360 exits the emitter housing via a first aperture 361. The collimated light beam from emitter housing 360 is admitted into detector housing 350 by way of second aperture 351. The light beam admitted into detector housing 350 illuminates the photo diode detector contained within detector housing 350. An ink droplet 380 ejected from a nozzle 310 on entering the collimated light beam extending between apertures 361 and 351 temporarily obstructs the infra-red light beam and causes a decrease in the amount of light entering aperture 351 and hence illuminating the photo diode contained within detector housing 350. Ink droplets are only detected if they pass through an effective detection zone in the collimated light beam which has a narrower width than a width of the collimated light beam. Preferably, the width of the effective detection zone 362 is approximately 2 millimeters. A width 363 of the emitter housing aperture 361 is preferably of the order 1.7 millimeters and similarly a width of the detector housing aperture 351 is preferably of the order 1.7 millimeters. Preferably, a distance from center of the effective detection zone and the rows of nozzles is of the order 3.65 millimeters. Preferably, a main length of the collimated light beam lies transverse to and substantially perpendicular to the firing direction of the nozzles of the printer head.

Preferably, ink droplets are injected from the nozzles with an initial speed in the range of 10 to 16 meters per second. Due to effects of air resistance the initial speed of the ink droplets leaving the nozzles is progressively reduced the further each ink droplet travels from the printer head. A sequence of four ink droplets fired from a nozzle with the droplets having an initial speed of 16 meters per second and with a delay between the firing of each droplet of 83 $\mu$s, as described herein before, would occupy a total distance from the first ink droplet to the fourth ink droplet of approximately 4 mm, immediately after the fourth droplet is ejected from the nozzle. However, if the distance between the first ink droplet and the fourth ink droplet of a sequence of ink droplets fired from a nozzle is greater than the width of the effective detection zone in the collimated light beam then some droplets may remain undetected. A consequence of the progressive slowing, due to air resistance, of a sequence of ink droplets fired from a nozzle is that the distance between each droplet of the sequence of droplets decreases.

In order to maximise the probability of detecting each droplet comprising the sequence of droplets fired from a nozzle it is important that the width of the effective detection zone is greater than the corresponding distance between the first and last droplets as the droplets pass through the effective detection zone. The distance between the first and last droplets of the sequence of droplets in the effective detection zone is determined by parameters including the following:

the initial ejection speed of ink droplets from a nozzle in the printer head; and the distance from a nozzle output of a printer head and the effective detection zone.

For a given initial ejection speed of droplets leaving nozzles of the printer head the closer the printer head is moved to the effective detection zone then the wider the effective detection zone must be. However, increasing the width of the effective detection zone necessitates a proportional increase in the time between firing ink droplet from adjacent nozzles thereby increasing the total time required to perform drop detection according to the best mode presented herein. Conversely, if the distance between the printer head and the effective detection zone is too large then for a given width of the effective detection zone the distance between the first and last ink droplets of the sequence of ink droplets may be significantly smaller than this given width and hence there is a possibility that a droplet fired from an adjacent nozzle might mistakenly be detected concurrently with the sequence of ink droplets ejected from the nozzle currently being tested. Additionally, increasing the distance between the printer head and the effective detection zone again increases of time duration between sequences of ink droplets from adjacent nozzles of the printer head thereby increasing the total time required before drop detection. Hence it is necessary to optimize the various parameters, for example, effective detection zone width, and distance from the printer head to the effective detection zone, in order to minimize the probability of simultaneously detecting droplets ejected from neighboring nozzles of the printer head whilst also minimizing the total time required to perform drop detection. The optimization may be performed experimentally.

The volume of ink fired by a nozzle is selected such that either a single ink droplet of at least a predetermined volume produces a detector signal having sufficient signal to noise ratio to reliably determine detection of the drop, and/or such that a series of two or more droplets having a combined volume which is at least the predetermined volume result in a series of detected signal pulses which when analyzed together, have a signal to noise ratio sufficient to reliably determine satisfactory operation of the nozzle.

Figure 4:
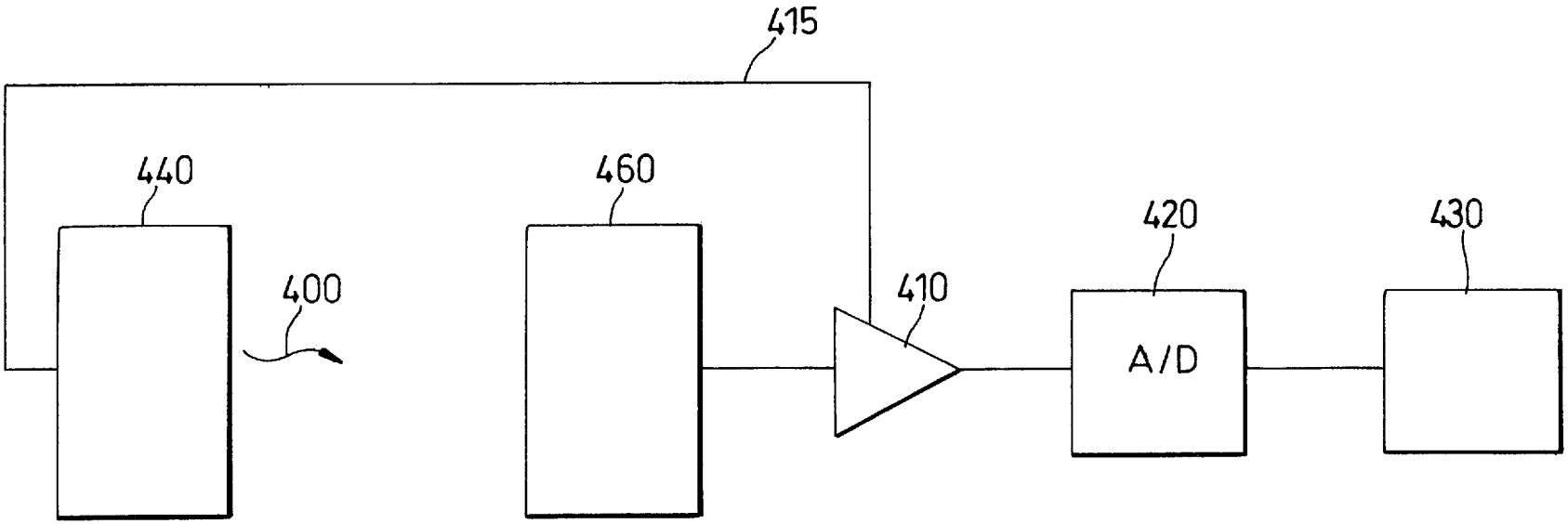
FIG. 4 illustrates schematically a functional overview of components of the drop detection device according to the specific implementation of the present invention.

Referring to FIG. 4 herein there is illustrated schematically functional blocks comprising an improved drop detection device. High intensity infra-red LED 440 emits a collimated light beam light 400 which is detected by photo diode detector 460. An output current of the photo diode detector 460 is amplified by amplifier 410. Additionally, amplifier 410 is configured to increase a driver current to high intensity infra-red LED 440 in response to a decrease in an output current of the photo diode detector 460 and to decrease an input current into high intensity infra-red LED 440 in response to an increase in the output current of photo diode detector 460 via signal path 415 thereby regulating the intensity of the light beam 400 with the object of achieving a substantially constant intensity beam. An amplified output current of amplifier 410 is input into an analogue to digital (A/D) converter 420. The A/D converter 420 samples the amplified output current signal of the photo diode. Preferably, the A/D converter 420 samples the amplified output current with a sampling frequency of 40 kilohertz. When a drop or series of drops, which in the best mode comprise either 2 or 4 drops per nozzle in a test routine, traverses the light beam 400, a perturbation pulse is caused in the output signal of detector 410. The A/D converted pulse is sampled by drop detection unit 430. Drop detection unit 430 processes a sampled output current of the photo diode detector 460 to determine whether or not an ink droplet has crossed the collimated light beam between the high intensity infra-red LED 440 and the photo diode detector 460. Additionally, analysis of the output current of the photo diode detector 460 enables operating characteristics of the printer nozzles to be determined. The time period between samples is, preferably in the order 25 $\mu$s hence yielding a total sampling time of 1.6 milliseconds. The 64 samples of the output of the photo diode 460 are stored within a memory device which may be a random access memory device in drop detection unit 430. Drop detection unit 430 may also be configured to store in a memory device an indication of whether or not a nozzle of the plurality of nozzles comprising printer head 300 is functioning correctly or not.

Preferably, before printing a page on the print medium the printer device checks the nozzles comprising printer head 300 by performing a sequence of test operations for the purpose of determining the operating performance of each nozzle and the print head as a whole, which are known hereinafter as drop detection. Each nozzle within a row of nozzles in turn sprays a predetermined sequence of ink droplets such that only one nozzle is spraying ink droplets at any time. Each nozzle within the plurality of nozzles comprising the printer head are uniquely identified by a corresponding respective number. Preferably, a first row of nozzles are identified by a contiguous series of odd numbers between 1 and 523 and a second row of nozzles are identified by a contiguous series of even numbers between 2 and 524. During drop detection each odd numbered nozzle within a row is operated to spray a predetermined sequence of ink droplets. Then printer head 400 is moved to bring the second row of nozzles into line with the center of the light beam, and each nozzle of the second row ejects a predetermined sequence of ink droplets. For each predetermined sequence of ink droplets ejected from each nozzle, a corresponding respective perturbation signal is produced in the detector output signal, as the predetermined sequence of droplets travels through the light beam. In the best mode herein, the width of the light beam, the distance between the center of the light beam and the rows of nozzles are arranged such that the sequence of droplets which are ejected from the printer nozzle, typically at a velocity in the order of 16 meters per second, are slowed down by air-resistance, such that when the first ink droplet of a predetermined sequence reaches a far side from the nozzle of the light beam, the subsequently ejected ink droplets of the predetermined sequence following the first droplet of the sequence have also traveled to be within the cross-section of the light beam, such that transiently, all ink droplets of the predetermined sequence ejected from a nozzle are within the cross-section of the light beam at a same time, and result in a single perturbation pulse per each determined ejected sequence. The distances between the center of the light beam and the nozzles and the velocity of ejection of the ink droplets from the nozzles are arranged such that there is 'bunching up' of the ink droplets spatially, due to air resistance, such that at a distance (in the best mode herein approximately 3.65 millimeters) from the nozzles, corresponding with the center of the light beam, the ink droplets are transiently all within the light beam at the same time.

Figure 5:
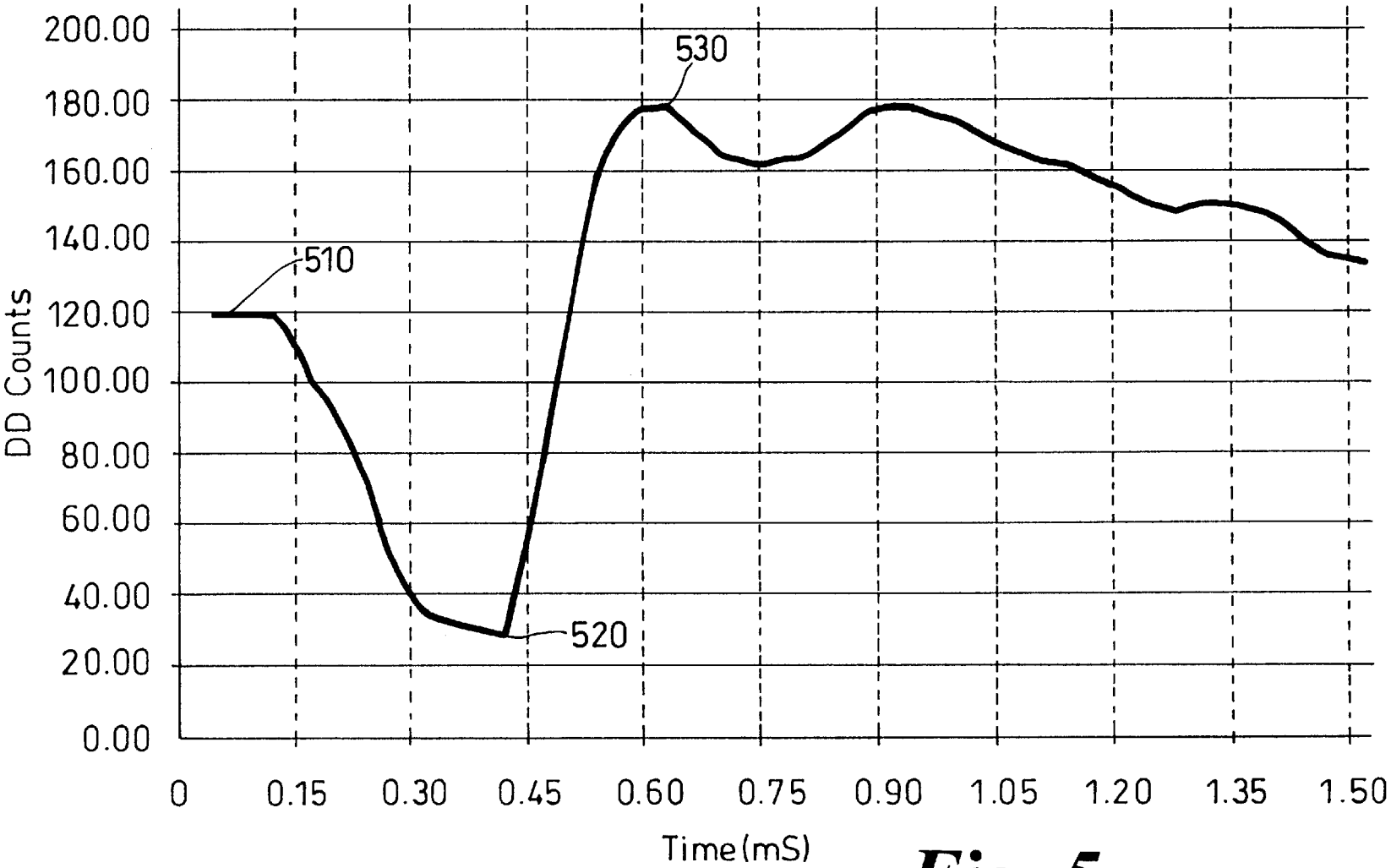
FIG. 5 illustrates graphically, by way of example, an output signal of the drop detection device according to the specific implementation of the present invention.

Referring to FIG. 5 herein, there is illustrated graphically, by way of example, a sampled output signal of photo diode detector 460 illustrated by the continuous solid line 510 and produced in response to a sequence of droplets ejected from a single nozzle 310 and entering the collimated light beam emitted by high intensity infrared LED 440. On a vertical axis of FIG. 5, there is represented a quantisation of the current amplitude of the output signal from detector 410, which corresponds to an intensity of infra-red light falling on the detector. On the horizontal axis of FIG. 5, there is represented time from an arbitrarily set zero time, prior to a perturbation pulse signal in the detector output current. At initial time 510, corresponding to a time when the light beam is unobstructed by passing ink droplets, the output current signal resides at a steady state value, which is maintained at a substantially constant level by virtue of the feedback mechanism operated by amplifier 410 which regulates the detector output signal, by increasing or decreasing the drive signal to the LED 440. As a predetermined sequence of ink droplets passes through the light beam between the emitter and detector, the intensity of light falling on the detector is reduced temporarily until a minimum intensity (in FIG. 5 in the order of 30 quantisation units) is reached at a time 520. In response to a decrease in the output current of the photodiode detector 460, due to a detected sequence of ink droplets traversing the light beam, an increased driver current to the high intensity infrared LED 440 supplied by amplifier 410 increases the intensity of the collimated light beam thereby increasing the output current of photodiode detector 460. At third time 530, approximately 0.15 milliseconds after the minimum intensity point at same time 520, the output signal of the amplifier 410 reaches a maximum, which in the example of FIG. 5, is approximately 60–70% greater than the steady state current value at time 510. The gradient of signal response between second time 520 at minimum output current signal value and third time 530 at maximum output current value can be varied by design of the feedback characteristics of the feedback loop comprising amplifier 410, emitter 440 and detector 460. The response time (the difference between second time 520 and third time 530) the gradient of rise on the current output after minimum intensity, and oscillation period between third time 530 and fourth time 540 at which a second peak response occurs are all capable of variation and design by variation of the inherent frequency response characteristics of the feedback loop as will be understood by those skilled in the art.

A number of ink droplets within the predetermined sequence of ink droplets is configured such that a total volume of ink simultaneously occulting the collimated light beam emitted by high intensity infrared LED 440 lies substantially within the range 1–100 picoliters, and more preferably within a range of 30–100 picoliters. A total ink droplet volume of 30–100 picoliters provides a sufficient disturbance of the light input into photodiode detector 460 to ensure an output signal, in response to the presence of a predetermined sequence of ink droplets, having a substantially larger amplitude than a typical noise amplitude introduced by, for example, amplifier 410.

Figure 6:
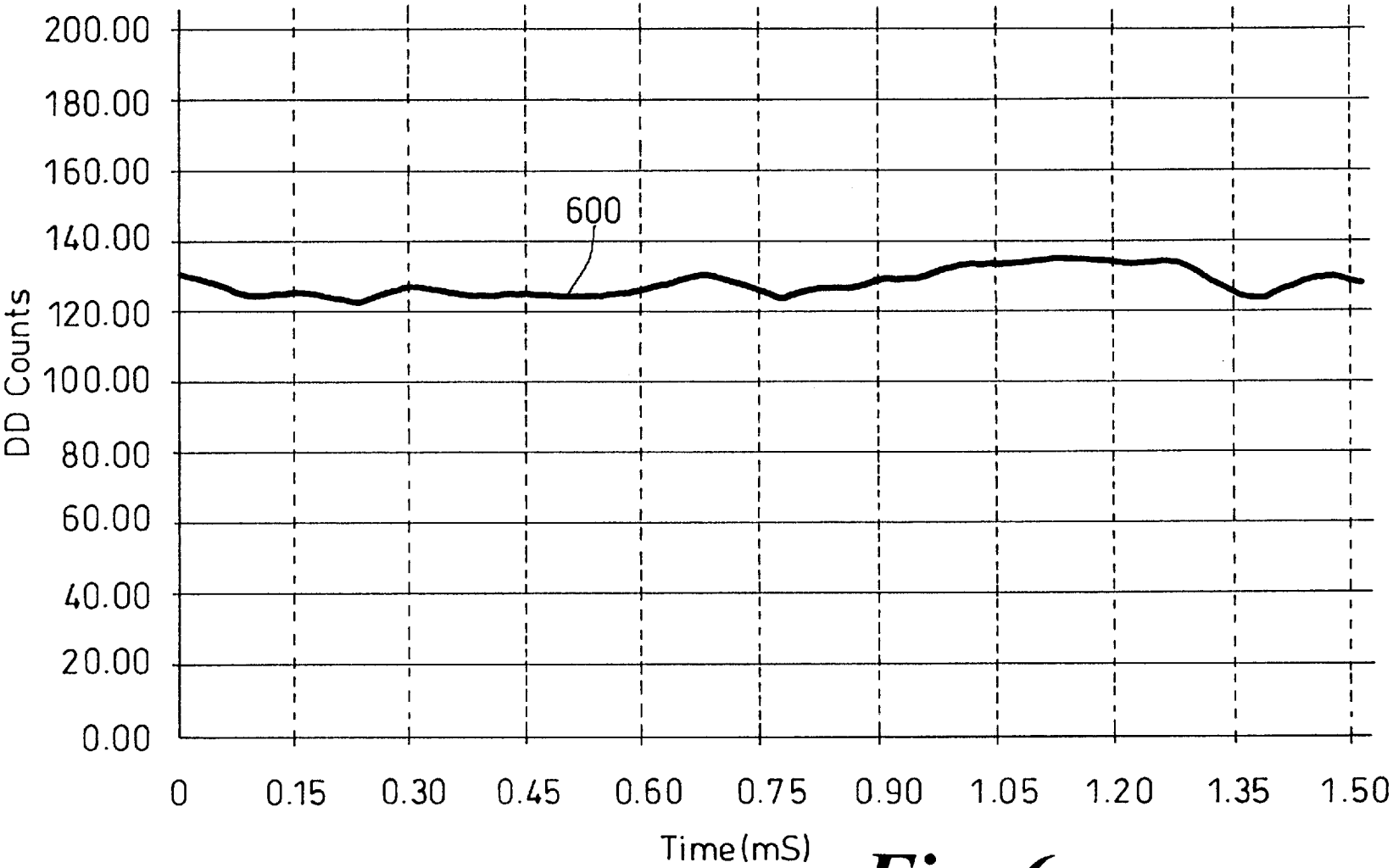
FIG. 6 illustrates graphically, by way of example, an output signal of the drop detection device in the case where an ink droplet has not been detected.

Referring to FIG. 6 herein, there is illustrated graphically, by way of example, an output signal 600 of A/D converter 420 in a case where an instruction to eject a predetermined sequence of ink droplets from a nozzle 310 has been sent to the printer head 300 but no ink droplets have entered the collimated light beam emitted by LED 440. A nozzle 310 might be prevented from ejecting ink droplets if, for example, the nozzle is clogged with an accumulation of ink or blocked with a paper fiber. The response of FIG. 6 is for a wholly malfunctioning nozzle. The quantized amplitude of amplifier 410 fluctuates by around 10–15% of its value.

Further details of the implementation of a drop detection unit of the above type for identifying malfunctioning nozzles are described in the European Patent Application no. 99 102646.9, filed in the name of Hewlett-Packard Company. Another example of such drop detection device is available in DesignJet 1000 and 1050 printers, produced by Hewlett-Packard Company.

Figure 7:
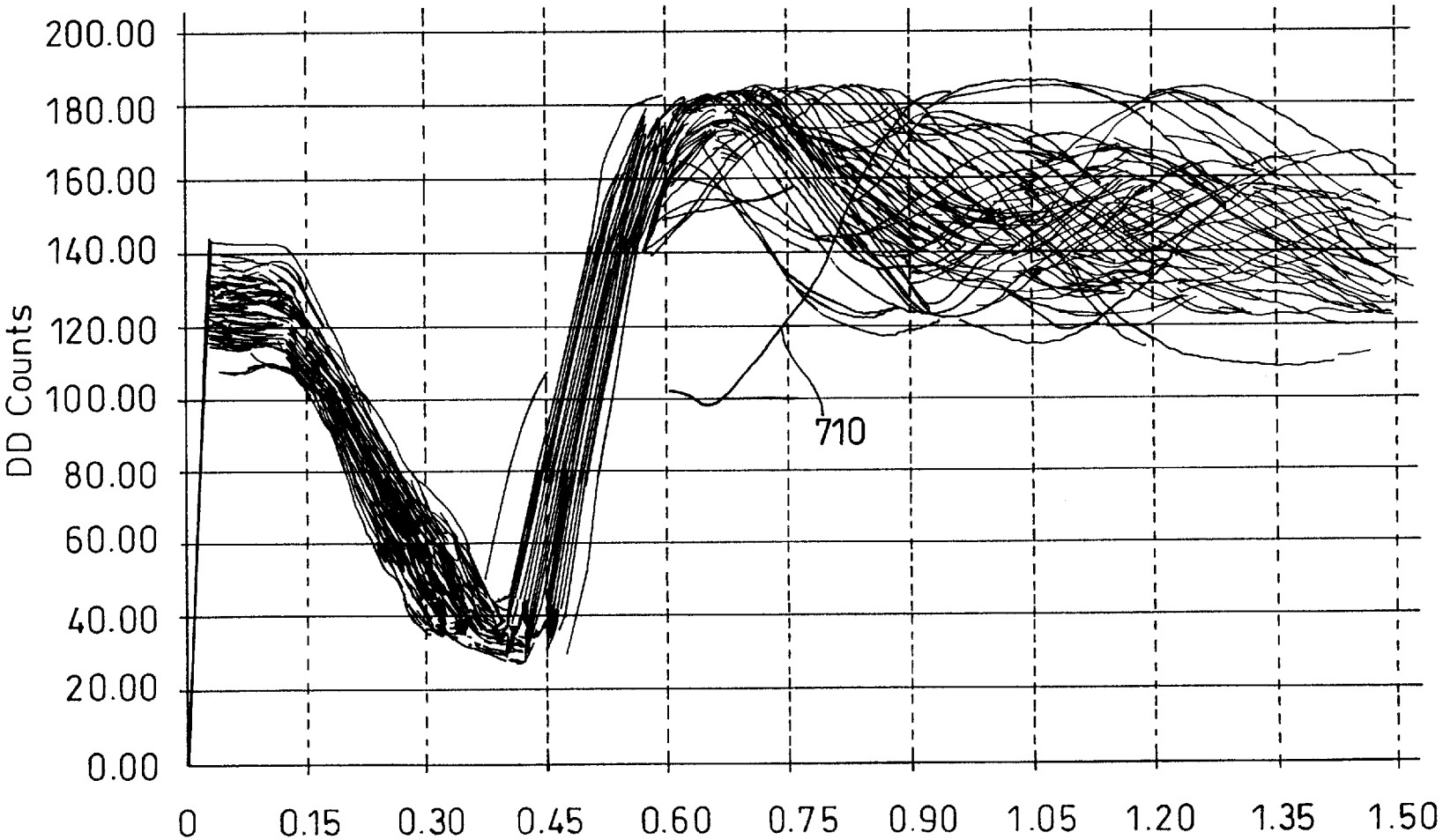
FIG. 7 illustrates graphically, by way of example, a plurality of output signals from a drop detection device, the output signals having being produced by a plurality of nozzles of a printer head and includes an output signal from a misfiring nozzle.

Referring to FIG. 7 herein, there is illustrated graphically, by way of example, a plurality of sampled outputs 700 of photodiode detector 460 produced in response to a plurality of correctly firing nozzles from a same row of a printer head 300. The individual data concerning the passage of ink droplets through the collimated light beam for each nozzle afforded by the high frequency (40 kilo hertz) sampling of the photodiode detector 460 output current reveals that in some instances the output signal generated by a predetermined sequence of ink droplets fired from a particular nozzle differs significantly from the signals produced by ink droplets fired from adjacent nozzles in a same row of the printer head 300. Output signal 710 is an example of a significantly different output signal. Nozzles which produce corresponding sampled output signals which differ significantly from the output signals of adjacent nozzles are termed herein as anomalous or aberrant nozzles. Detection of the presence or absence of ink droplets being ejected from a nozzle may be determined by subtracting a minimum output signal from a maximum output signal of each signal response resulting from each predetermined sequence of ink droplets to obtain a corresponding respective peak-to-peak signal. However, referring to FIG. 7 it can be seen that an anomalous nozzle may escape detection on the basis of a simple peak-to-peak calculation. Hence, it is one aspect of the present invention to use the improved knowledge concerning ink droplets crossing the collimated light beam emitted by the high intensity infra-red LED 440 to identify incorrectly functioning nozzles (which are also known herein as anomalous nozzles) which may escape detection using previous prior art drop detection techniques.

Figure 8:
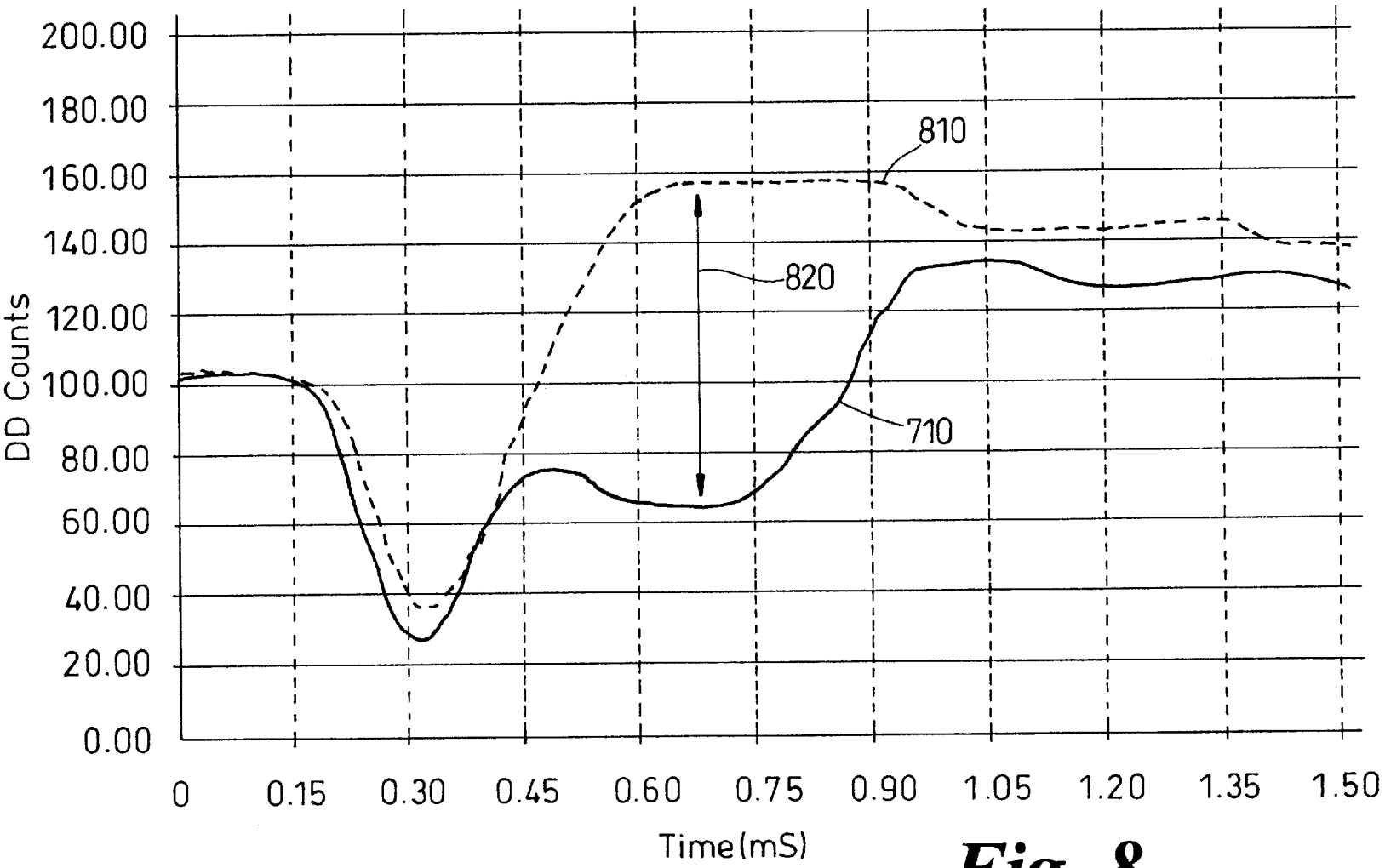
FIG. 8 illustrates graphically, by way of example, a comparison between an output signal of the drop detection device for both an average output signal determined from a plurality of correctly firing nozzles and an output signal from a misfiring nozzle.

Referring to FIG. 8 herein, there is illustrated graphically, by way of example, a preferred method by which an anomalous nozzle is detected. An output signal 710 corresponding to a nozzle which is to be tested is compared to an average output signal 810 calculated by averaging a plurality of corresponding signal responses from a plurality of nozzles substantially adjacent to and in a same row as the nozzle to be tested. A total error signal is generated by combining an amplitude difference value 820 between corresponding samples of the average output signal 810 and an output signal 710 corresponding to the nozzle to be tested.

Figure 9:
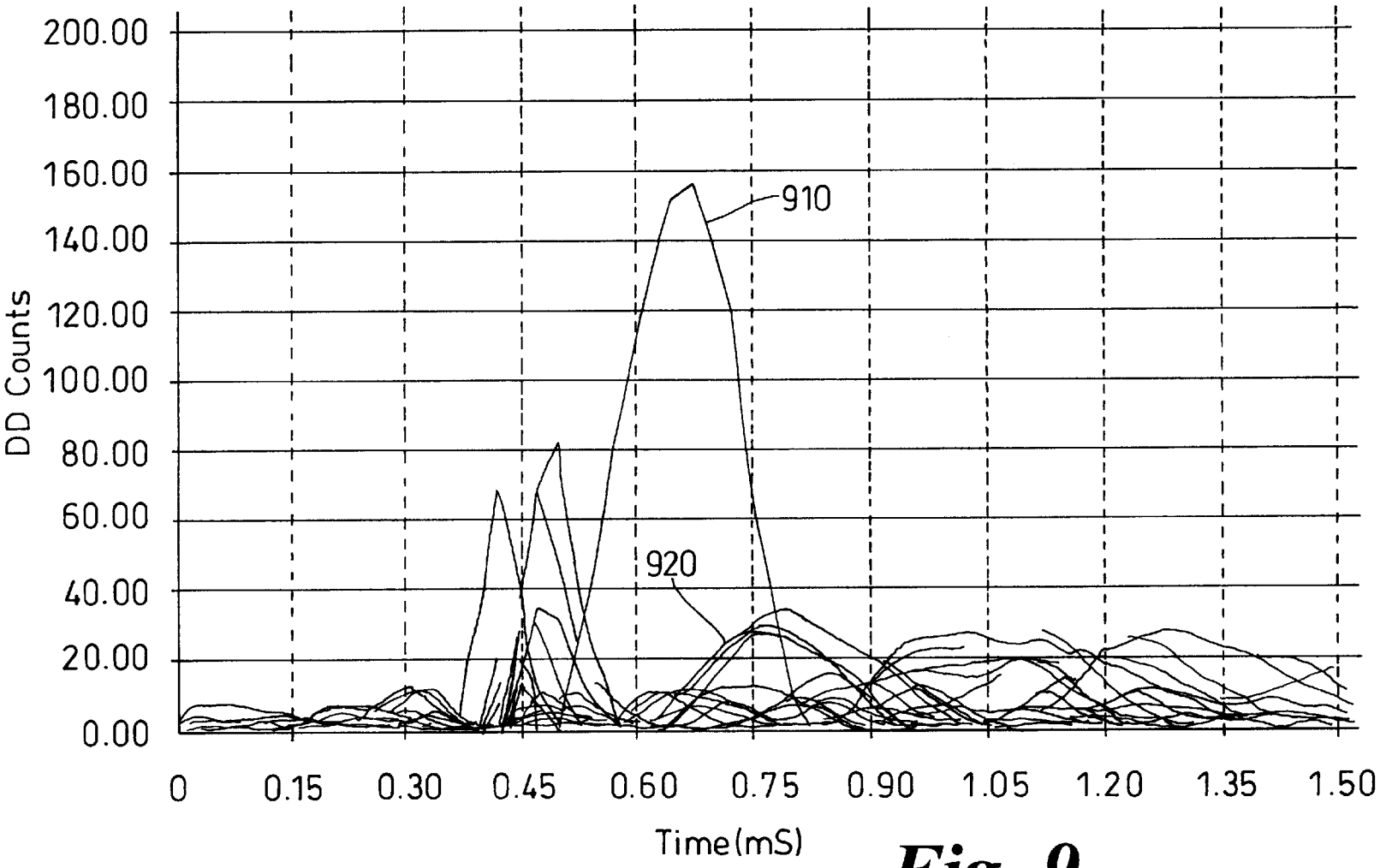
FIG. 9 illustrates graphically, by way of example, an error signal derived for an anomalous nozzle compared to a plurality of error signals originating from correctly functioning nozzles according to a first specific method of the present invention.

Referring to FIG. 9 herein, there is illustrated graphically, a comparison of differences between corresponding samples of a plurality of correctly functioning nozzles 920 in relation to an average response and an anomalous nozzle 910 in relation to an average response. The vertical axis in FIG. 9 corresponds to a difference between the quantized sampled amplitude of output current response from detector 410 for a single anomalous nozzle, and an average of the quantized output signal responsive from detector 410 for each of a plurality of nozzles, 810 in FIG. 8. Curve 910 in FIG. 9 represents a difference in signal response for a signal produced by a single nozzle, relative to an average signal determined from the plurality of other nozzles. Comparison of the total error for an anomalous nozzle compared with the corresponding total errors of correctly functioning nozzles enables, according to the best node presented herein, anomalous nozzles to be readily detected.

Figure 10:
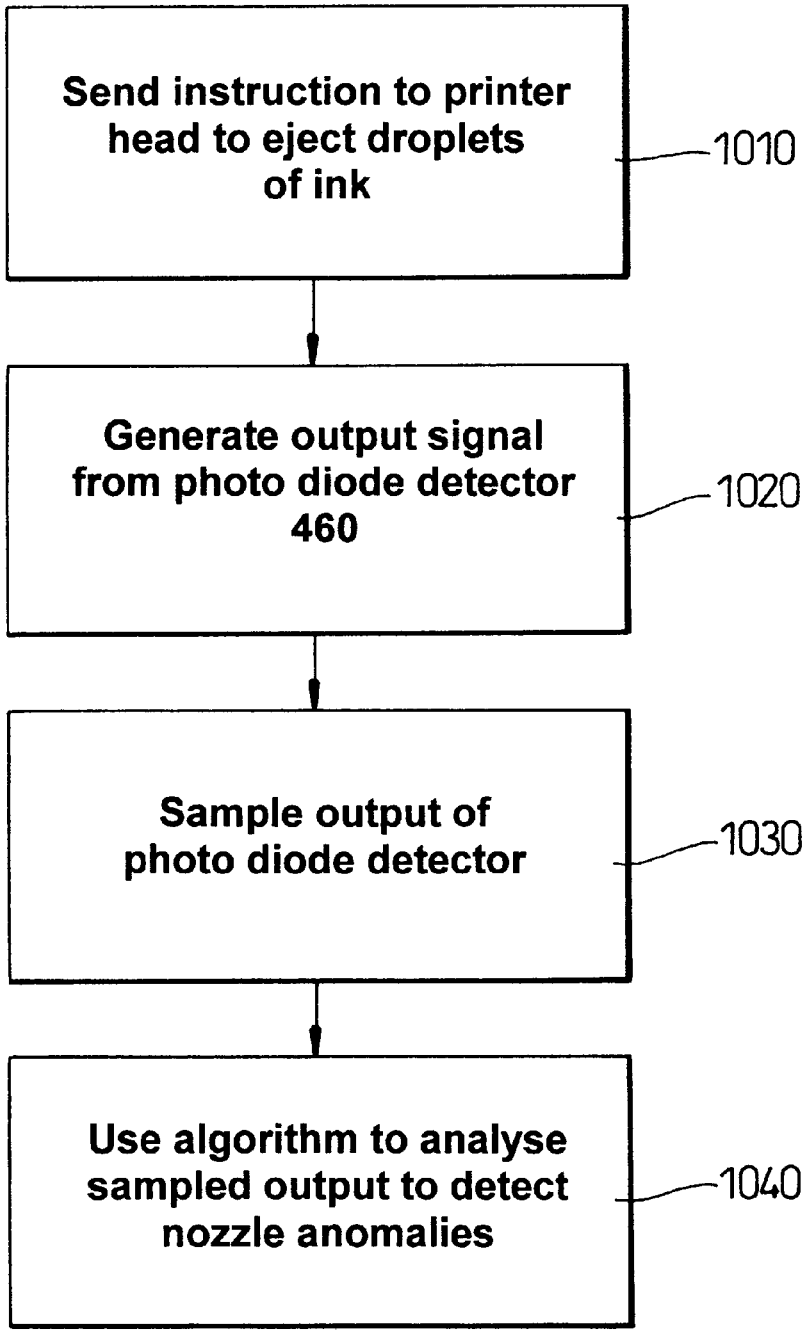
FIG. 10 illustrates schematically steps involved in detecting anomalous nozzles according to the first specific method of the present invention.

Referring to FIG. 10 herein, there is illustrated schematically, steps involved in detecting anomalous nozzles according to the best mode presented herein. The steps in FIG. 10 are repeated for each of the nozzles in the print head. In step 1010, an instruction is sent to the printer head 300 to eject a predetermined sequence of droplets of ink. Preferably, each nozzle forming a first row of the printer head fires the predetermined sequence of droplets such that only one nozzle is ejecting droplets at any moment. If, in response to the instruction in step 1010, ink droplets are ejected from a nozzle then as the ink droplets enter the collimated light beam emitted by high intensity infrared LED 440 then the light input into the photodiode detector 460 decreases as the light beam is occulted by the ink droplets. In step 1030, after a time delay of 0.2 milliseconds from the time at which the instruction was sent in step 1010, the time delay also being known herein as "fly time", the A/D converter 420 commences sampling the amplified output signal of photodiode detector 460 amplified by amplifier 410. Preferably the A/D converter 420 samples the amplified output signal of the photodiode detector at a rate of 40 kilohertz. Preferably, the A/D converter samples the output signal, which may be an output voltage signal or an output current signal, the total of 64 times. Each sample represents the amplitude of the output signal as an 8 bit binary number. The number representing an amplitude of the output signal is also known herein as drop detect (DD) counts. The 64 8-bit samples of the amplitude of the output signal of photodiode detector 460 and amplifier 410 corresponding to a predetermined sequence of ink droplets fired from one nozzle are stored in a memory location of a memory device. The memory device may be a random access memory (RAM) device.

In step 1040, a microprocessor having random access memory and read only memory (ROM) applies an algorithm to compare the sampled output signal resulting from ink droplets ejected from a selected nozzle with corresponding sampled output signals resulting from ink droplets ejected from adjacent nozzles of the printer head. The algorithm derives a total error signal for each nozzle for comparison with a total error signal determined from each other nozzle of the plurality of nozzles comprising the printer head in order to determine operating characteristics of each nozzle and thereby identify anomalous nozzles.

Figure 11:
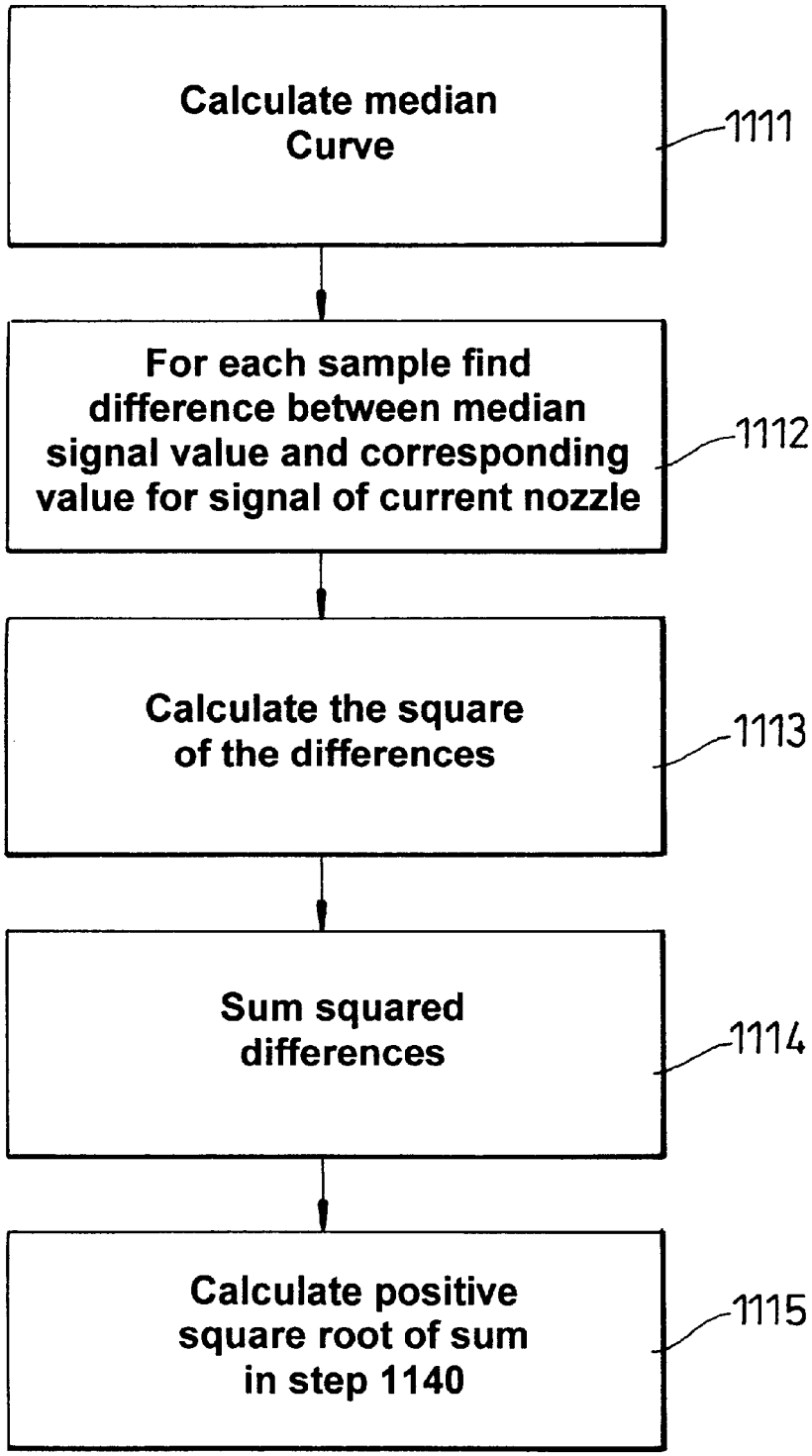
FIG. 11 illustrates schematically a first algorithm used for detecting anomalous nozzles according to the first specific method of the present invention.

Referring to FIG. 11 herein, there is illustrated schematically an algorithm used to calculate the total error signal according to a preferred embodiment of the present invention. Each nozzle of the plurality of nozzles is tested by comparison with an average drop detect output signal 810. The average output signal 810 is calculated by averaging the output signals of a plurality of the nozzles in a same row as the nozzle to be tested and which lie substantially adjacent to the nozzle to be tested. Preferably, the average output signal curve is calculated by averaging corresponding respective samples stored in a memory device of the drop detection output signals generated by a 20 nearest nozzles located on either side of a nozzle being tested and in a same row as the nozzle being tested. By way of example, considering the case where a nozzle number 50 is currently being tested then an average drop detection output signal of amplifier 410 is calculated by averaging a plurality of output signals generated by ink droplets ejected from all even numbered nozzles having identifying numbers between 10 and 48 and between 52 and 90.

In the case where a nozzle to be tested lies less than 20 nozzles away from either end of the row of nozzles in the printer head then the selection of nozzles used to calculate an average drop detection output signal is as follows:

The total number of nozzles used to calculate the average signal remains constant. If, for example, the current nozzle being tested has a nozzle number 10 then the average signal is calculated using the corresponding output signals relating to nozzles 2, 4, 6, 8 and 12, 14 . . . 78, 80.

Preferably, according to the best mode presented herein, the average output signal is a median value of the corresponding output signals of the nozzles adjacent to the nozzle being tested. The median is chosen in order to minimize the effects of the outputs of other anomalous nozzles on the calculated values of the average output signal 810. The median signal is determined from the plurality of selected output signals corresponding to the respective selected nozzles as follows. For each signal response of the plurality of signal responses, a first sample is taken after a first time period from a start time of the sample. A median is taken of the plurality of digitized amplitudes of all of the plurality of sampled signals, at the first time period after the initial start time of the sampling period. The result is a single value representing a median value of all the plurality of signals, at the first sample interval. Similarly, at the second sample interval, a median value of all digitized quantized amplitude values of all of the plurality of nozzles used as the basis for the median curve is taken to provide a single median value at the second sample interval after the start of the sampling period. Similarly, for third, fourth and successive sample intervals up to the maximum $64^{th}$ sample interval after the start of the time period. The first value of the median output signal is calculated by taking a median value of corresponding first sampled values of the adjacent nozzles as described herein before. Similarly, a second median output signal value is calculated by taking the median value of corresponding second values of the output signals relating to the adjacent nozzles as described herein before.

In step 1112, a difference is calculated between a sampled value of the output signal of the drop detection and a corresponding median value calculated in step 1111. As described herein before the amplified output signal of the photodiode detector 460 is sampled 64 times by A/D converter 420. Hence, in step 1112 there are calculated 64 different signal values between the median output signal and the output signal corresponding to the current nozzle being tested. In step 1113, each of the difference signals calculated in step 1112 are squared and in step 1114 a sum of the squared differences is calculated. In step 1115, a positive square route of the summed, squared differences between the median output signal and the output signal corresponding to the current nozzle being tested is calculated. A total error calculated in step 1115 gives a measure of the whole of the difference between an output signal generated by a given nozzle in comparison with the median output signal determined from the plurality of output signals resulting from the plurality of adjacent nozzles.

Figure 12:
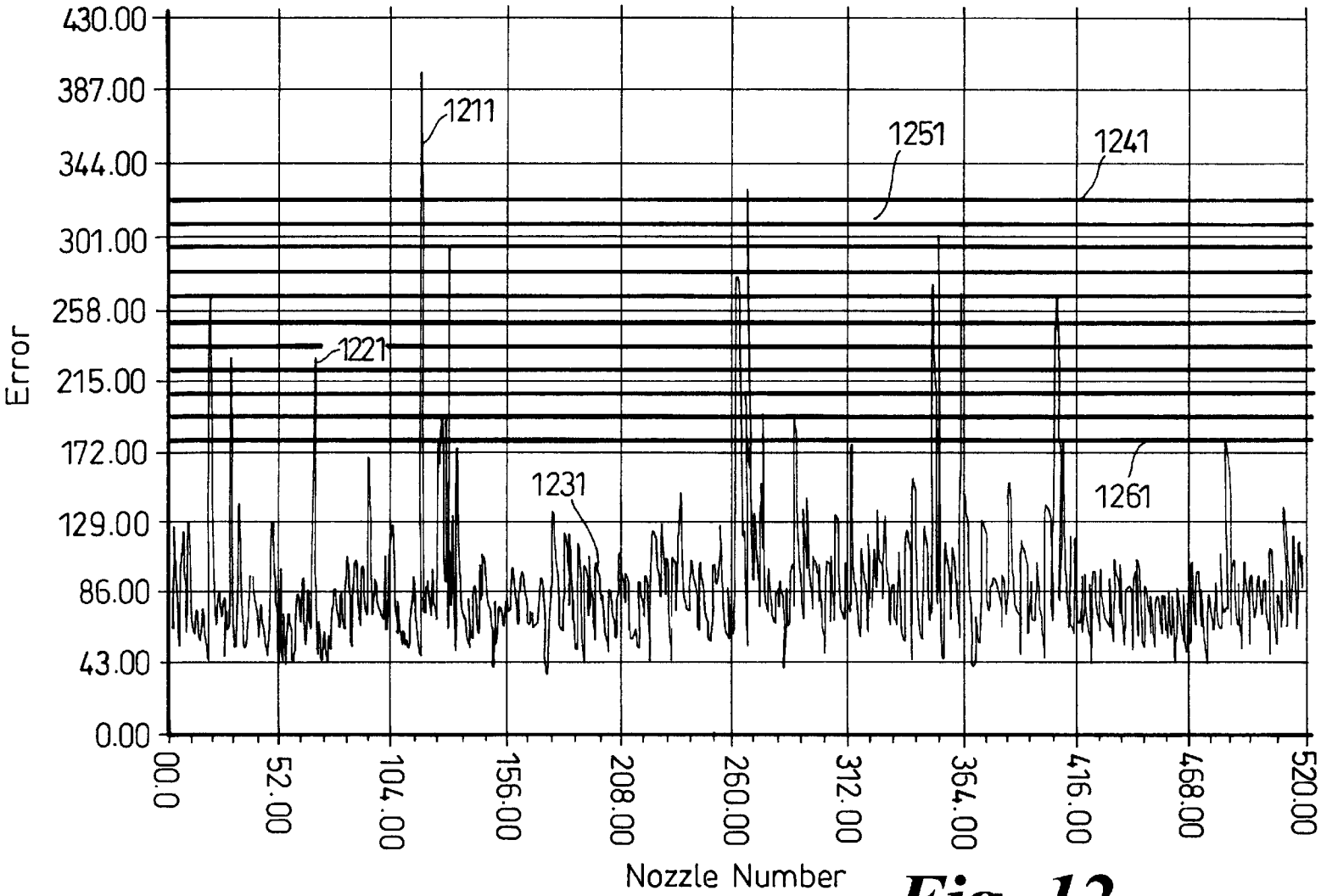
FIG. 12 illustrates graphically, by way of example, a plot of errors calculated according to the first specific method of the present invention for a printer head comprising 524 nozzles.

Referring to FIG. 12 herein, there is illustrated graphically, by way of example, a plot of error value calculated for each nozzle of the plurality of nozzles comprising the printer head as function of nozzle number. Using the algorithm as described herein before a total integrated error is calculated for each nozzle of the plurality of nozzles comprising the printer head. According to the best mode described herein, a median error is calculated from the total integrated errors calculated for each nozzle 1211, 1221, 1231. The median error is calculated by sorting the plurality of total integrated errors in order of increasing size into an array and taking the mean average of the total integrated errors associated with element numbers 262 and 263 of the array of sorted total integrated errors in the case of a printer head comprising 524 nozzles. Additionally, an upper quartile error value is calculated by forming a mean average of the total integrated errors associated with element numbers 393 and 394 of the array of sorted to total integrated errors, for the case of the printer head comprising 524 nozzles.

Having calculated a median error value from the plurality of total integrated errors derived from plurality of nozzles comprising the printer head, and calculating the corresponding upper quartile error values associated with each of the nozzles of the printer head a number characterizing the probability of measuring a total integrated error for any nozzle of the plurality of nozzles lying a fixed distance above the calculated median error value. The number characterizing the probability (known herein as sigma) is calculated using the following equation:

$$\text{Sigma}=\text{abs (upper quartile}-\text{median)}/1.35.$$

Sigma is the absolute value of the difference between the upper quartile error value and the median error value calculated as described herein before, wherein the difference between the two upper quartile error value and median error value is divided by 1.35.

In FIG. 12 the black horizontal lines including 1241, 1251 and 1261 represent multiples of the sigma value calculated herein before. Line 1261 represents 7× the calculated sigma value. For comparison there are also plotted on FIG. 12*a* line representing 8× sigma, 9× sigma . . . 16× sigma 1251 and 17× sigma represented by line 1241. It can be seen from FIG. 12 that certain of the total integrated error values corresponding to individual nozzles of the plurality of nozzles comprising the printer head have significantly larger error values than the majority of the errors calculated for other nozzles 1231. For example, error value 1221 is more than 10 sigma greater than the median error value calculated from the total integrated error values corresponding to the same plurality of nozzles. Similarly, error 1211 is more than 17 sigma greater than the calculated median error value.

In the present application an anomalous nozzles is also identified as a nozzle which has a total integrated error which is greater than a predetermined number of sigma as described herein before. Preferably, the predetermined sigma level is 10 sigmas. Referring to Table 1 there is summarized how the average probability of failing a correctly functioning, non-anomalous nozzle decreases as the number of sigmas used to identify anomalous nozzles is increased. Table 1 is obtained using the algorithm according to a preferred embodiment of the present invention to calculate the total integrated error values.

TABLE 1

| Number of sigmas | Average probability of failing a good nozzle |
|---|---|
| 7 | 1.60% |
| 9 | 0.69% |
| 11 | 0.31% |
| 13 | 0.14% |
| 15 | 0.08% |
| 17 | 0.04% |

Additional implementations of a drop detection unit for detecting abnormal nozzles are described with grater details in the U.S. patent application Ser. No. 99 09/252706, filed in the name of Hewlett-Packard Company.

Figure 27:
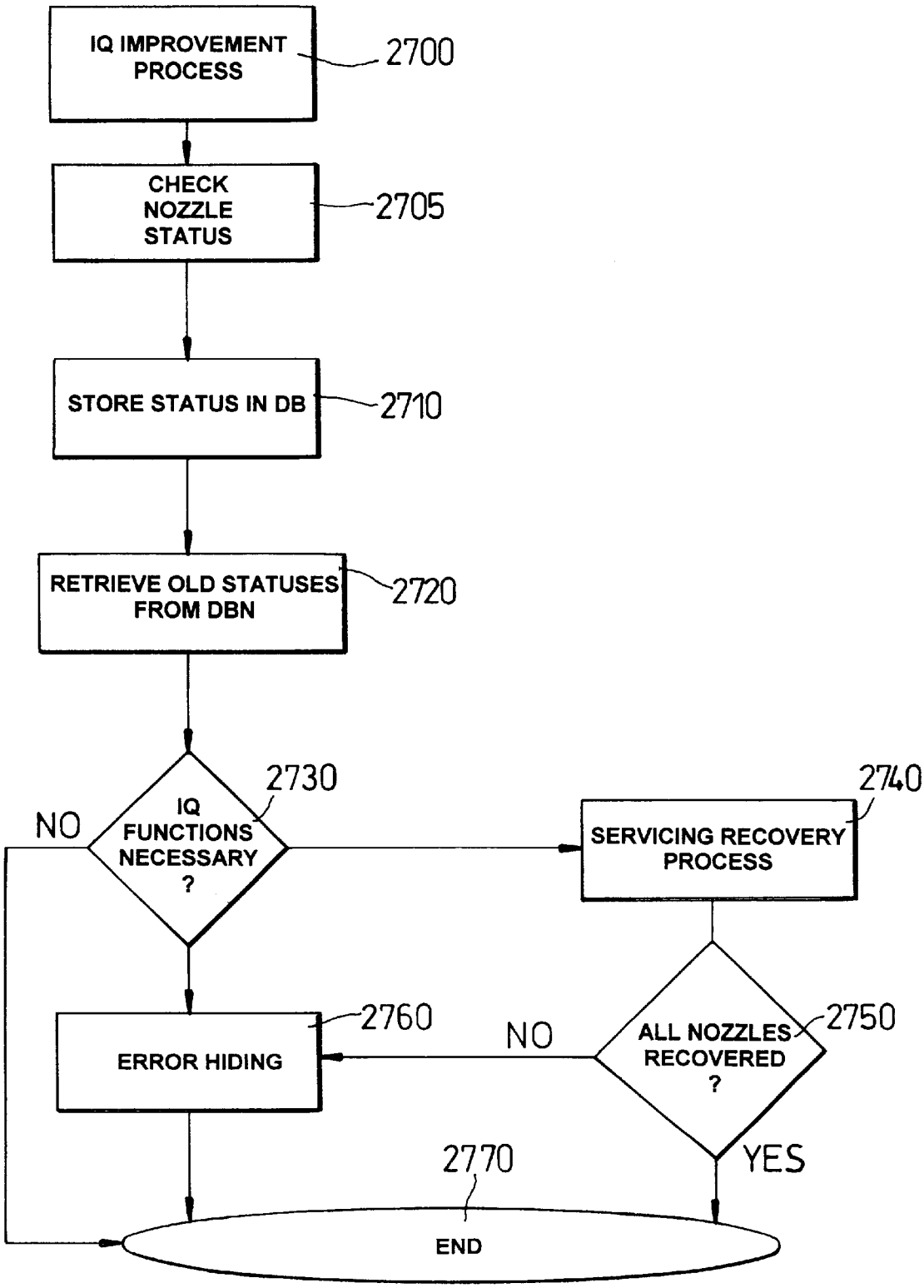
FIG. 27 illustrates schematically steps involved in an image quality improvement process, according to a specific method of the present invention.

A process for improving image quality (IQ) of an inkjet printing device is described with reference to schematic steps as shown in FIG. 27.

The IQ process starts at step 2700, when the printer 20 is taking steps for improving the quality of its output, in terms of limiting the generation of artifacts, or banding in the printed plots by performing some preventing functions.

At step 2705 the status of the nozzles 310 of a printhead 300, mounted in the printer 12, is checked, e.g. using a drop detection procedure as described above to detect if the status of each nozzle is working, non-working or aberrant.

At step 2710 the status of each nozzle is stored in a database, e.g. as described in the following with reference to FIG. 17A. At step 2720 statuses referring to the current and to earlier drop detections are retrieved from the database for each nozzle.

At step 2730, the statuses of each nozzle 310 are reviewed and, in accordance to the evolution of their statuses, a function to improve image quality is selected, if necessary. According to this example, only two kinds of processes are given: (i) a process comprising functions which improve image quality by improving the health of the nozzles, i.e. attempting to recovery the failing nozzles before printing the plot; and (ii) a process comprising functions which improve image quality by running error hiding algorithms, which replace failing nozzles with working nozzles when printing a plot. The skilled in the art may appreciate that other techniques, e.g. adding delays on the firing time of a nozzle, which improve the image quality of the output can be easily introduced in the current process, without departing from the spirit of the present invention.

If no image quality functions are necessary, e.g. because the printhead has all of its nozzles in a working status, the process ends at step 2770.

At step 2730, by taking into account threshold values described in more details in the following with reference to FIGS. 19–22, it decides whether a servicing recovery process or whether an error hiding process needs to be executed.

At step 2740 a servicing recovery process is executed, e.g. a full recovery process, as described in the following with reference to FIGS. 13–16, or a dynamic servicing process, as described in the following with reference to FIG. 17A or 17B.

While at step 2760 a error hiding process is performed, e.g. a process as described in the following with reference to FIG. 25.

Once the servicing recovery process ends, step 2750 checks if all nozzles in a failing status have been recovered. If not the error hiding process of step 2760 is performed, otherwise the IQ process ends at step 2770. Once step 2760 is completed, the IQ process ends at step 2770 too.

In the following, with reference to FIG. 17A, an exemplary servicing recovery or clearing process as implemented in one embodiment of the present invention will be described limited to the servicing of one pen, e.g. pen 50, for sake of simplicity. The skilled in the art may appreciate that the same process can be performed, without substantial modifications, on the full set of pens, by executing some steps in parallel on the different pens (e.g. servicing) and some in sequence (e.g. drop detection) or even all in parallel or in sequence.

The process start at step 1700 when the signal to start printing a plot is sent to the printer 20. At this stage two procedures are performed. First a conventional lightweight servicing is executed on the printhead 60. A conventional lightweight servicing may include spitting a predetermined number of droplets into the spittoon 108 of the service station 80. According to the time the pen rested in the service station capped, an higher predetermined number of droplets may be spitted and a conventional wiping step can be also added. Subsequently a drop detection procedure, for example the one described above, is started.

The results of each drop detection step are then stored in a database preferably located in the printer itself. For each of the 524 nozzles a value, corresponding to the detected information, is stored in the database, where "0" means good nozzle (i.e. drop detected), "1" means nozzle out (i.e. no drop detected), "2" if nozzle is low aberrant and "3" if nozzle is high aberrant. As described above with reference to FIGS. 10 and 11, aberrant nozzles are identified by the amplitude difference value 820, e.g. the total error generated by the nozzle as calculated in step 1150. If the total error is above a given threshold, preferably 10 sigma (see FIG. 12), the aberrant nozzle is marked as low aberrant and set to "2". If the total error is above a given second greater threshold, preferably 17 sigma (see FIG. 12) the aberrant nozzle is market as high aberrant and set to "3". In the following more details will be given on servicing and error hiding routines to improve IQ when nozzles marked 1, 2 or 3 exist in the pen. However, nozzles marked low or high aberrant are preferably not serviced, since the failure is usually due to a physically damaged nozzle, which can be hardly recovered with the known servicing functions.

The database can contain more details, for instance regarding the environmental conditions at the time of the drop detection or information regarding the pen. A typical database may contain the following parameters:

1. Pen identifier and colour
2. Kind of service (begin or end of plot)
3. Absolute number of DD related to printer
4. Model Number of the pen:
5. Database release
6. Pen identifier on Acumen
7. amount of times the printer has been reset.
8. Amount of second since the last registration.
9. Pen Age, measured in ink fired (cc)
10. ink remaining in refill unit in cc
11. Environmental temperature
12. Environmental humidity
13. Plot width (mm)
14. Plot length (mm)
15. Carriage speed while printing (ips)
16. Media type
17. Maximum swath density (drops/mm)
18. Average swath density (drops/mm)
19. Maximum temperature that the pen reached in a swath
20. Plotname
21. Date
22. Free string
23. Specific recoveries done in each Recovery cycle (see 3.2.1)
24. Pens affected by recoveries (see 3.2.1)

The 524 Drop Detection values of the nozzles: 0 if good nozzle, 1 if nozzle-out, 2 if nozzle is a low Aberrant and 3 if nozzles is a high aberrant.

At step 1710 the values of the current and historical drop detections (in the following, with current drop detection is intended the most recent one) are examined and if no failing nozzles are detected or the number of failing nozzles is below a certain threshold the control passes to step 1740. At step 1740, nozzles still marked as failing (i.e. out or aberrant) are preferably replaced by working ones by means of an error hiding procedure, for instance the one described in the following with reference to FIG. 25. Then the plot is printed in combination with a conventional spit while printing function. At Step 1750, once that the plot has been entirely printed, a new drop detection is performed. If again no nozzles out are detected the procedure ends at step 178 with a conventional lightweight servicing.

If at step 1710 a number of nozzle out is bigger than a given threshold, preferably one or more recovery servicing routines are applied later. At this stage, two options are available:

(i) a pattern recognition of the nozzles failures is performed (and this is considered the first step of a dynamic servicing process) if the database contains enough information on the nozzle health history of the pen, i.e. data on a number of drop detection grater than a given value exists. In fact, the sequence of failures of the nozzles of the pen, as stored in the database, can be used as a sort of evolution path of the failures of the printhead, which are identified by running a pattern recognition algorithm. Preferably the data should reflect a number of drop detections which is grater than 9, and more preferably greater that 30 (generally between 4 and 15 plots). The patter-recognition tries to identify the causes of the detected failure of a nozzle, by attempting to distinguish the evolution path of the failure, looking at the historical data of the failing nozzle and of the entire printer as stored in the database.

(ii) Control is passed to a full servicing process when the data stored by the process, and related to previous drop detections, is not sufficiently accrued or reliable for allowing pattern recognition. For instance the data are considered not reliable when an high number of nozzles out has been detected in some of the drop detections taken into account by the dynamic servicing process. Preferably, the trigger for data not reliable is X% of the examined drop detections has more than Y nozzles out, where typically X is about 30 or more and Y is about 40 or more.

If option (ii) is true, control pass to step 1720 where a full recovery servicing is performed on the printhead. To be effective this process, described in grater details in the following with reference to FIGS. 13–16, needs to investigate a number of drop detections considerably smaller than the one required by the pattern recognition. Once that full recovery has been performed control passes to step 1740, together with the information of which nozzles have not been recovered by the servicing.

If option (i) is true, control passes to step 1730, where the second step of a dynamic recovery servicing is performed on the printhead, i.e. a list of recovery functions each having a specific recovery capability is formed in accordance with the failure modes identified by the process during the pattern recognition. Then each of these recovery functions are applied in the formed sequence.

In this embodiment a group of failure modes is predetermined and each of these modes is associated to a recovery function. According to this example, Table 2 shows a set of failure modes and their association to specific recovery functions or actions triggered. The skilled in the art may appreciate that this set can be modified, e.g. in view of different typology of pens or inks, by defining new modes or recoveries/actions or removing some of these or defining different associations between failure mode and recovery/actions.

Preferably, failures modes can also be discriminated according to when the current drop detection has been performed. At steps 1710 and 1730, the dynamic servicing will seek for failures typical at the beginning of plot and accordingly select one or more specific recoveries which are designed to improve such kind of failures. In the same way, in case some nozzles are not recovered, different weight can be assigned to nozzles having different failure modes, and this weight can then be used for generating more accurate print

TABLE 2

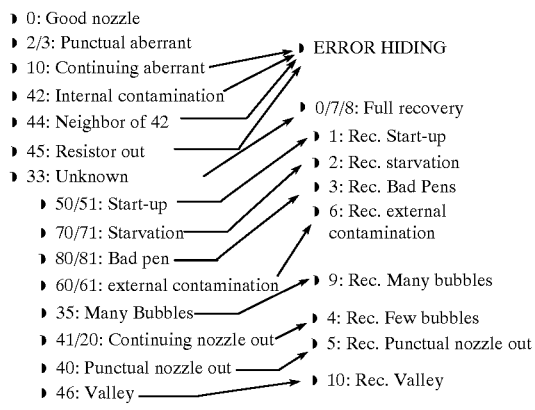

More details on the dynamic servicing process, its failures modes and recovery functions and the way these interact will be given in the following.

Once the dynamic servicing has been completed, the method passes to step 1740, together with the information of which nozzles have not been recovered by the servicing.

Now we move back to step 1750, if the drop detection detects that not all the nozzles are good, depending on the status of the data in the database a different servicing process is selected: if not enough drop detections have been performed on the printhead or the data are not reliable, a full recovery servicing is performed at step 1760, like in step 1720; otherwise a dynamic servicing is performed. Contrary to steps 1710 and 1730, now the dynamic servicing will seek for failures typical at the end of plot and accordingly select, at step 1770, one or more specific recoveries which are designed to improve such kind of failures. From both steps 1760 or 1770 control passes to step 1780.

In the following, with reference to FIGS. 13–16, it will be described how a full recovery servicing may be implemented, for example in the inkjet printer 20.

This process allows to adjusts servicing based on the nozzle health information gathered during the last eight usable drop detections, and not only in the most recent one (also identified as "current drop detection"), and allowing to show how persistent or irrecoverable the failures of the nozzles are.

The following definitions will be used to describe the process in greater detail:

D (historical drop detection array): it contains the total number of defective nozzles found in the last usable eight drop detection's, in chronological order D[7] is the total nozzle defects detected during the last drop-detection D[0] is the total nozzle defects detected eight usable drop detects ago.

Dsort (sorted historical drop detection): it contains the same information as D but in increasing order from minimum number of nozzles out found -Dsort[0]- to the maximum -sort[7]-.

DDnth (nth percentile of D): It points to a value contained in Dsort[n]. This is obtained using reading the Dp value in Dsort. In this embodiment, the percentile used is 50%, which is obtained by using a Dp=3. Thus, DDnth contains the result of the median drop detection, excluding the higher failure values which are contained in Dsort[4) to Dsort[7].

Dp (pointer index): it identifies the DDnth percentile in the Dsort vector. Zero means the first one, 7 means the last one. As already said in this embodiment this value is 3

$DD_{Map}$ (array of the result of last drop detection): this array shows the status for each nozzle. A working nozzle is a zero, a malfunctioning nozzle is a one. For the sake of clarity, a plurality of DDMap arrays are maintained in memory each one containing the health information for each of the nozzles during a different usable drop detection (e.g. as shown in next Table 3) even though in the following when the description refers to DDMap it will be the DDMap referring to the most recent drop detection.

$Perm_{Map}$ (array of the nozzles that have a higher probability of failing during the next plot after the last drop detection): this array contains, a value of zero for a working nozzle, and a value of one for a nozzle being detected as permanent defective.

$Perm_{Score}$ (array of the counters used to track persistency of nozzle health issues after the last drop detection): this arrays contains the score assigned to each nozzle according to the following rules:

WoundNozzleScore: amount by which the $Perm_{Score}[j]$ is incremented every time nozzle[j] check fails at beginning of plot or at end of plot. In this embodiment this value is 0.

DeadNozzleScore: amount by which the $Perm_{Score}[j]$ is incremented every time nozzle[j] check fails after performing a recovery servicing. In this embodiment this value is +9.

LivingNozzleScore: amount by which the $Perm_{Score}[j]$ is reduced every time nozzle[j] check is OK. In this embodiment this value is 20.

NozzleKillScore: when $Perm_{Score}[j]$ reaches this level, the process considers nozzle[j] to suffer a permanent defect and set $Perm_{Map}[j]$ to 1. In this embodiment this level is 50. $Perm_{Score}[j]$ will not go higher and will stay at NozzleKillScore level if nozzle [j] checks continue to fail.

NozzleResurectScore: when $Perm_{Score}[j]$ reaches this level, the process considers nozzle [j] as being recovered from permanent defect and set $Perm_{Map}[j]$ to 0. This embodiment this level is zero. According to this scheme, a nozzle is normally removed from the $Perm_{Map}$ array after being detected as working during 3 subsequent drop detection. This allows to maintain for a longer period flagged as out also an intermittent nozzle. $Perm_{Score}[j]$ will not go lower and will stay at NozzleResurectScore level if nozzle [j] checks continue to be OK.

In order to clarify the usage of the above parameters in the following it is provided an example with a pen having a printhead with only eight nozzles.

At the initial drop detection $Perm_{Map}$ has the following values{1 0 0 0 0 0 0 1} while the $Perm_{Score}$ array has {30 0 0 0 42 15 5 50}. This means that nozzles 1, and 8 are identified as suffering of a permanent defect.

The next tables 3, 4, 5 show the history of the last eight usable drop detects from the older detection 0 to the more recent one 7. In the tables drop detections 7, 4 and 1 correspond to drop detections performed at the end of printing a plot (EOP); 6, 3, and 0 correspond to drop detections performed before to starting to print a plot (BOP), while 5 and 2 correspond to drop detections performed after performing a recovery servicing (INT).

TABLE 3

| | EOP | BOP | INT | EOP | BOP | INT | EOP | BOP |
|---|---|---|---|---|---|---|---|---|
| | $DD_{Map}[j]$ | | | | | | | |
| Nozzle | 0 | 1 | 2 | 3 | 4 | 5 | 6 | 7 |
| 1 | 1 | 0 | 0 | 0 | 0 | 1 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 1 | 1 | 1 | 1 | 1 | 0 | 0 | 1 |
| 6 | 0 | 1 | 0 | 0 | 1 | 0 | 0 | 0 |
| 7 | 0 | 0 | 0 | 0 | 0 | 0 | 0 | 0 |
| 8 | 1 | 1 | 1 | 0 | 0 | 0 | 0 | 0 |
| D | 3 | 3 | 2 | 1 | 2 | 1 | 0 | 1 |
| Dsort | 1 | 1 | 1 | 1 | 2 | 2 | 3 | 3 |
| Dp | | | | | | | | 3 |
| $DD_{50\%}$ | | | | | | | | 1 |

TABLE 4

| | $Perm_{Score}[j]$ | | | | | | | |
|---|---|---|---|---|---|---|---|---|
| Nozzle | 0 | 1 | 2 | 3 | 4 | 5 | 6 | 7 |
| 1 | 32 | 12 | 0 | 0 | 0 | 9 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 44 | 44 | 50 | 50 | 50 | 30 | 10 | 10 |
| 6 | 0 | 0 | 0 | 0 | 0 | 0 | 0 | 0 |
| 7 | 0 | 0 | 0 | 0 | 0 | 0 | 0 | 0 |
| 8 | 50 | 50 | 50 | 30 | 10 | 0 | 0 | 0 |

TABLE 5

| | $Perm_{Map}[j]$ | | | | | | | |
|---|---|---|---|---|---|---|---|---|
| Nozzle | 0 | 1 | 2 | 3 | 4 | 5 | 6 | 7 |
| 1 | 1 | 1 | 0 | 0 | 0 | 0 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 0 | 0 | 1 | 1 | 1 | 1 | 1 | 1 |
| 6 | 0 | 0 | 0 | 0 | 0 | 0 | 0 | 0 |
| 7 | 0 | 0 | 0 | 0 | 0 | 0 | 0 | 0 |
| 8 | 1 | 1 | 1 | 1 | 1 | 0 | 0 | 0 |

At the end of the eight usable drop detections the values are:

$Perm_{Map}$={0 0 0 0 1 0 0 0}, $Perm_{Score}$={0 0 0 0 12 0 0 0} and $DD_{50\%}$=1.

At this time only nozzle 5 is considered permanently defective.

Figure 13:
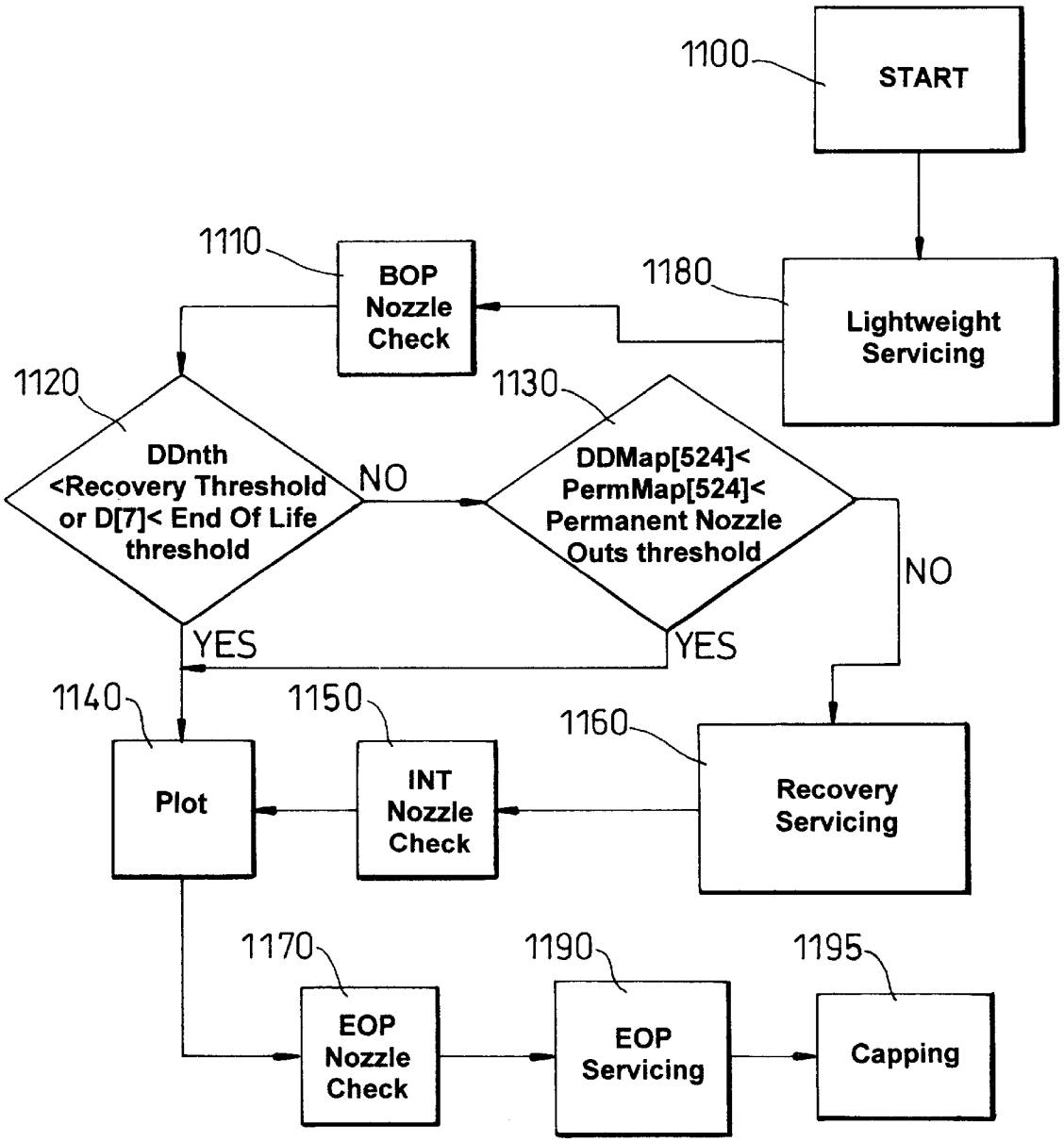
FIG. 13 illustrates schematically steps involved in printhead full servicing recovery process according to the present invention.

With reference to FIG. 13, the full servicing process will be described, again limited to the servicing of one pen for the sake of simplicity. The process start at step 1100 when the signal to start printing a plot is sent to the printer 20. At this stage a lightweight servicing step 1180 is executed. At step 1110 a drop detection process if performed, as described previously described, on the printhead 400. At test 1120 it is verified if the number of nozzles out of the nth percentile, in this embodiment 50, of the drop detection history is below a predetermined recovery threshold value, here 2 if the printhead pertains to the black pen or 6 if the printhead pertains to the for color pens, or the last drop detection has revealed a current number of nozzles out is smaller than a predetermined End of Life threshold value, here equal to 5 for black pens and equal to 8 for color pens. If the result of test 1140 is YES the process pass to step 1140, wherein the printer prints the plot. If the result is NO, the control passes to test 1130. In 1130 the nozzles which are present in the DDMap and not in the PermMap are counted and summed together. Then if this sum is smaller than a predetermined Permanent Nozzles Out threshold value the control pass again to step 1140. Step 1130 try to avoid servicing on nozzles that probably will not be recovered by the recovery servicing. In fact if all the nozzles detected as out in the last drop detection were already in the PermMap running a recovery service would probably just reduce the throughput of the printing, or damage other working nozzles and loose some ink.

If the result of test 1130 is NOT, the recovery service procedure is started to try to recover all the nozzles out. This procedure will be described in greater details with reference to FIGS. 14–16.

After the completion of the recovery procedure another Drop detection is performed in order to check the result of the servicing. The value of this drop detect is stored as part of the history of the printhead, as shown before and no further servicing activity are now performed. Then step 1140 is executed. When the plot is completed a new drop detection is performed on the printhead at step 1170. Immediately after, at step 1190, an end of plot servicing is performed on the pen. An end of plot servicing may include conventionally spitting a predetermined number of droplets into the spittoon 108. According to the results of the last drop detection, an higher predetermined number of droplets may be spitted and a conventional wiping step can be also added. After the servicing the pen is capped at step 1195 in the service station until a request for printing a new plot is sent to the printer, then the process starts again from step 1100.

Figure 14:
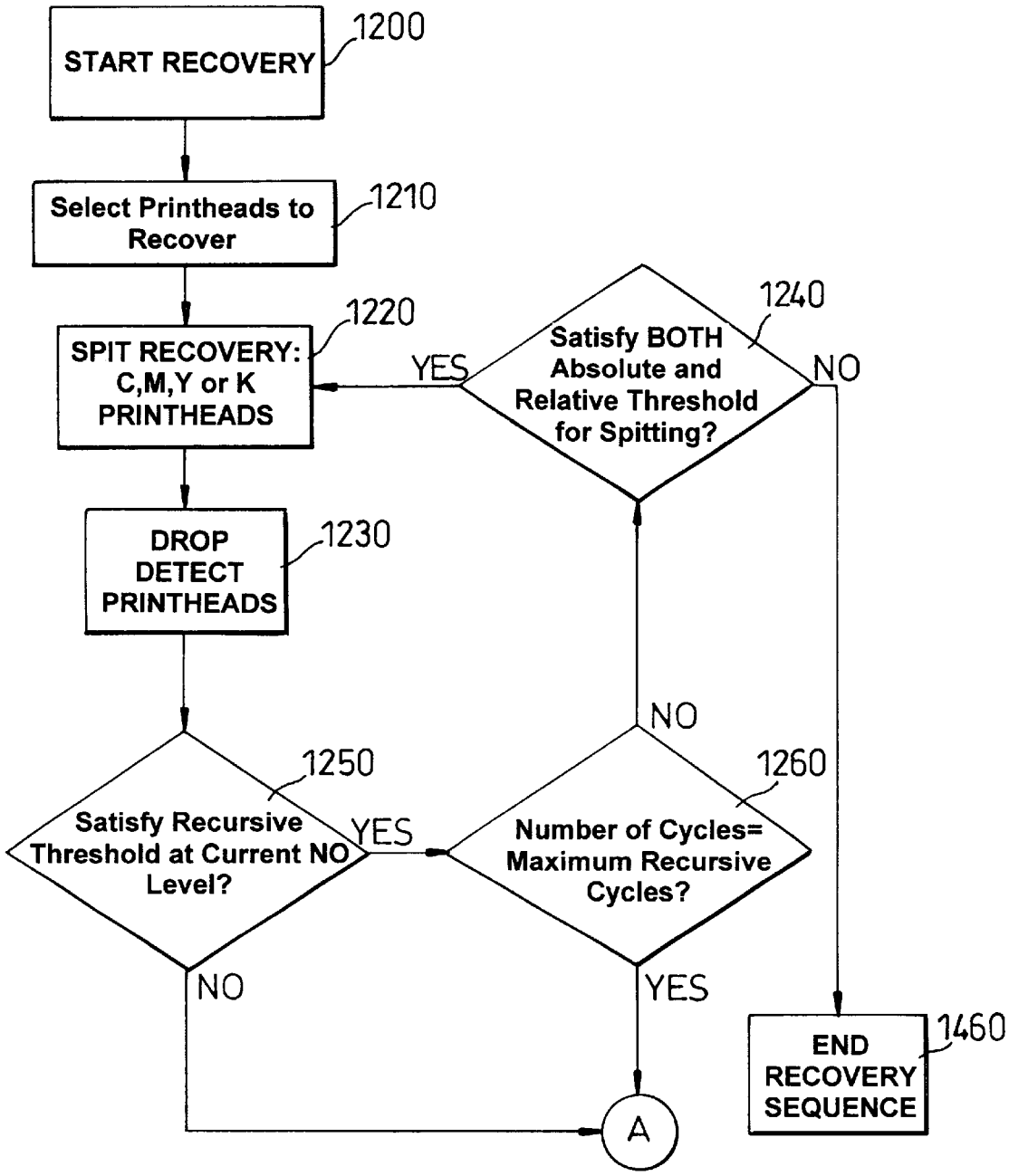
FIGS. 14–16 illustrate in more detail steps involved in printhead full servicing recovery according to a specific method of the present invention.
Figure 15:
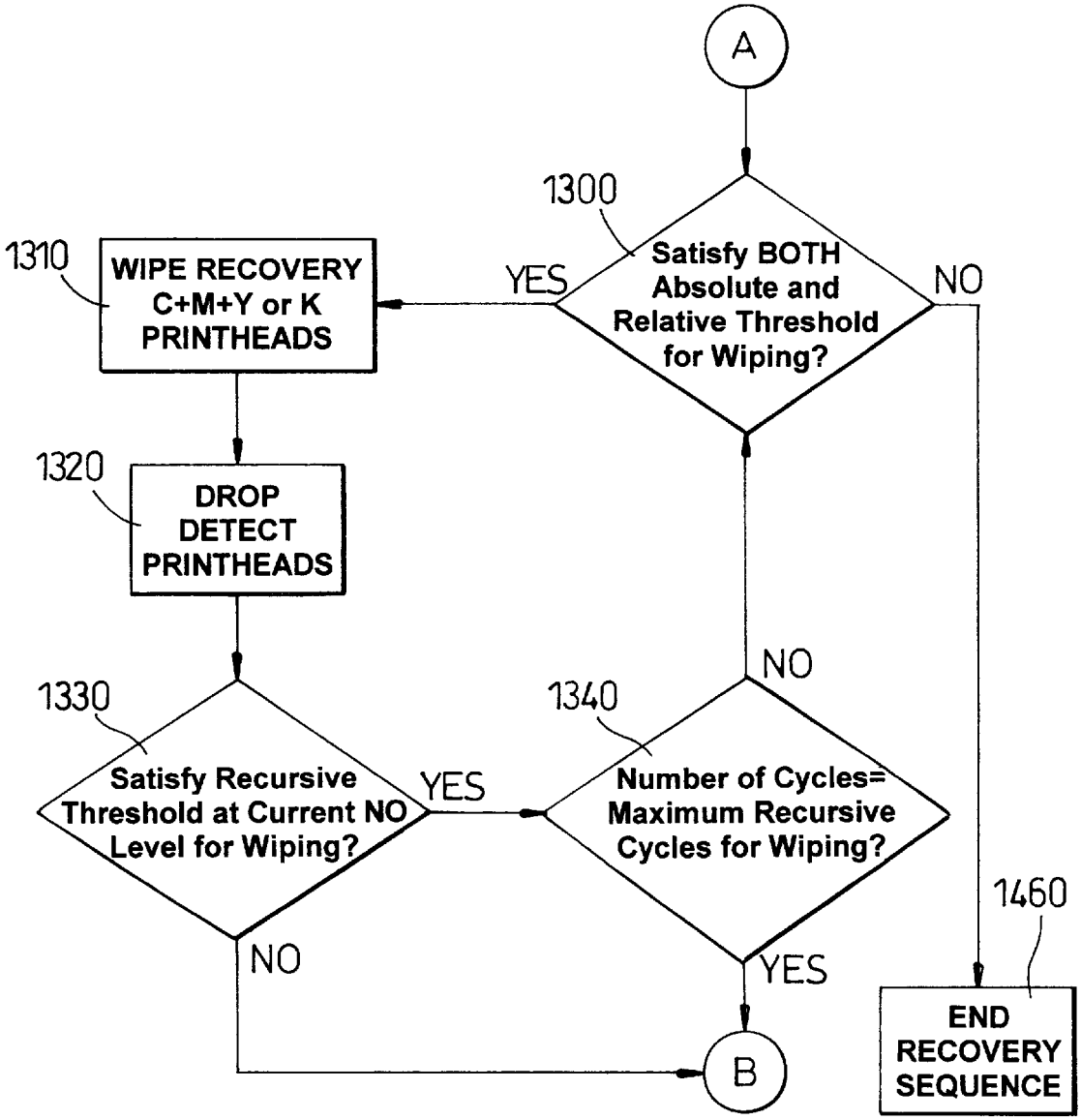
Figure 16:
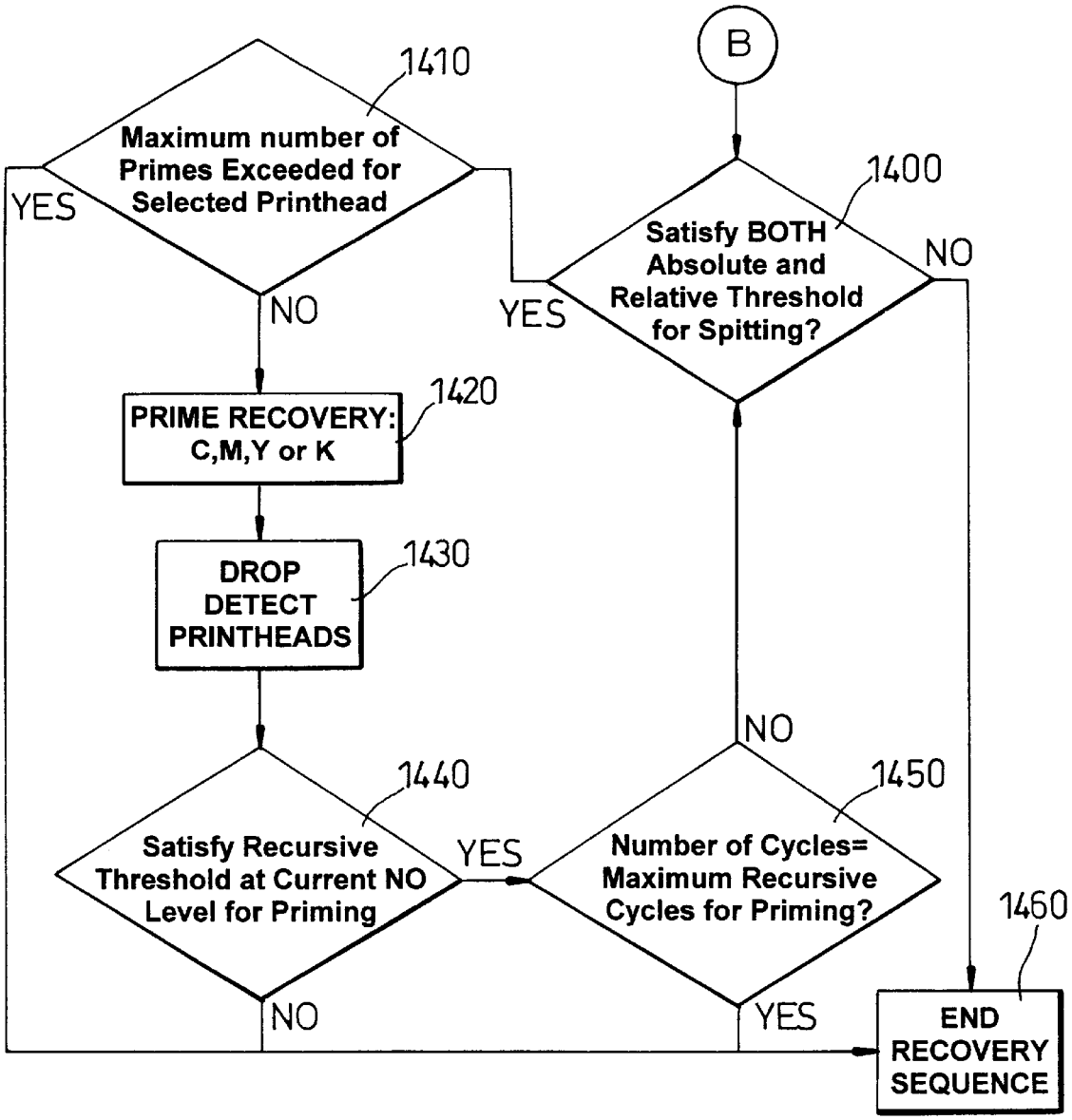

With reference to FIGS. 14–16, an example of the recovery servicing procedure 1160 is provided.

According to this example further threshold values have been defined, all the predetermined values assigned to the various threshold are specific to this embodiment and may vary in accordance to different servicing requirements of different embodiments.

Absolute Threshold for Spitting, Absolute Threshold for Wiping and Absolute Threshold for Priming relate to absolute number of nozzles out in the last drop detection for each respective printhead, i.e. DDMap[j] contents for each printheads. These thresholds are related to the level at which the printhead would start demonstrating print quality defects. The level is adjusted so that a noisy low level nozzles out will not force an excessively high intervention frequency. The value of the Absolute Threshold for Spitting and the Absolute Threshold for Wiping is set to 1 for all the printheads, while the value of the Absolute Threshold for Priming is set to 4 for the color printheads (CMY) and to 2 for the black printhead.

Relative Threshold for Spitting, Relative Threshold for Wiping and Relative Threshold for Priming compare the current nozzles out, DDMap[j], to the nozzles which exist in the map of permanent nozzles, PermMap[j], and determines if the current nozzle out snapshot varies enough from the permanent nozzles to warrant a recovery. This threshold is designed to ensure that permanent nozzles are not triggering unnecessary recovery routines when the likelihood that a recovery will not have any effect on the permanent nozzles out is very high. The values for all the relative thresholds and for all the printheads is set to 2.

Recursive Threshold for Spitting and Recursive Threshold for Priming allow determination of the recovery effectiveness of the previous recovery pass, and it is used to indicate if an additional pass through the same recovery pass is likely to recover another significant number of nozzles out. If the recovery efficacy falls below the threshold, it is determined that another similar step would not have a beneficial effect on the printhead state.

Figure 18:
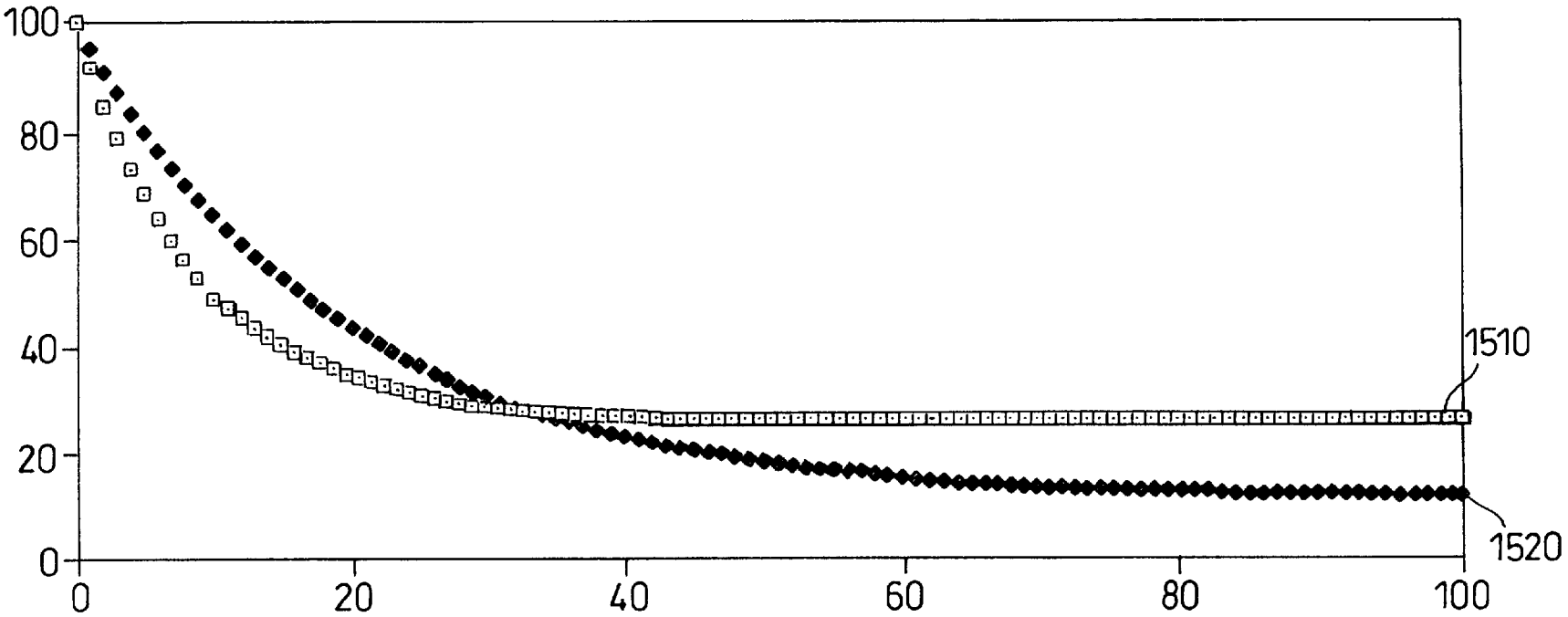
FIG. 18 shows graphically two threshold curves for two recursive services to determine the recovery effectiveness of the previous recovery pass.
Figure 19:
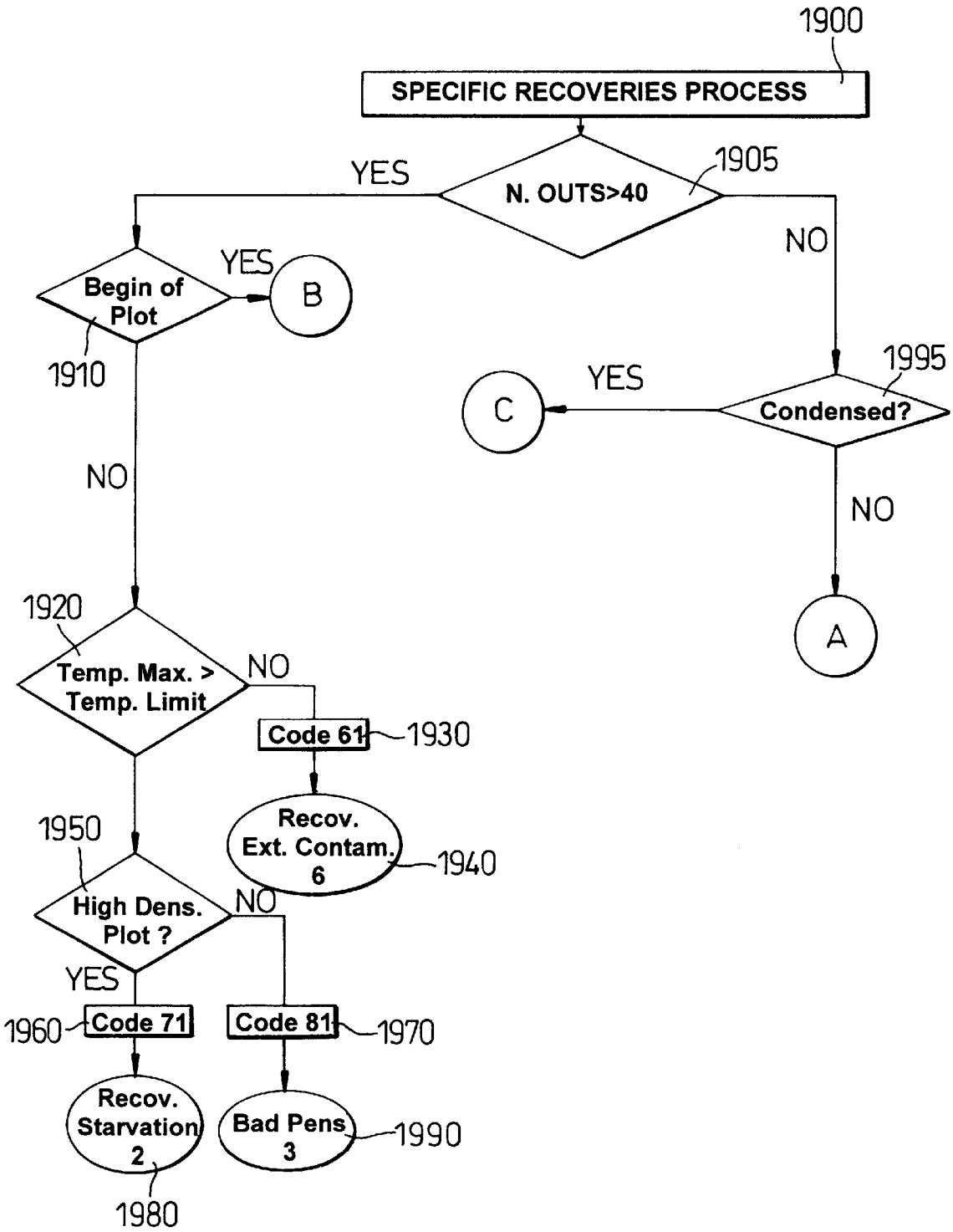
FIGS. 19–22 illustrate in more detail steps involved in printhead dynamic servicing recovery according to a specific method of the present invention.
Figure 20:
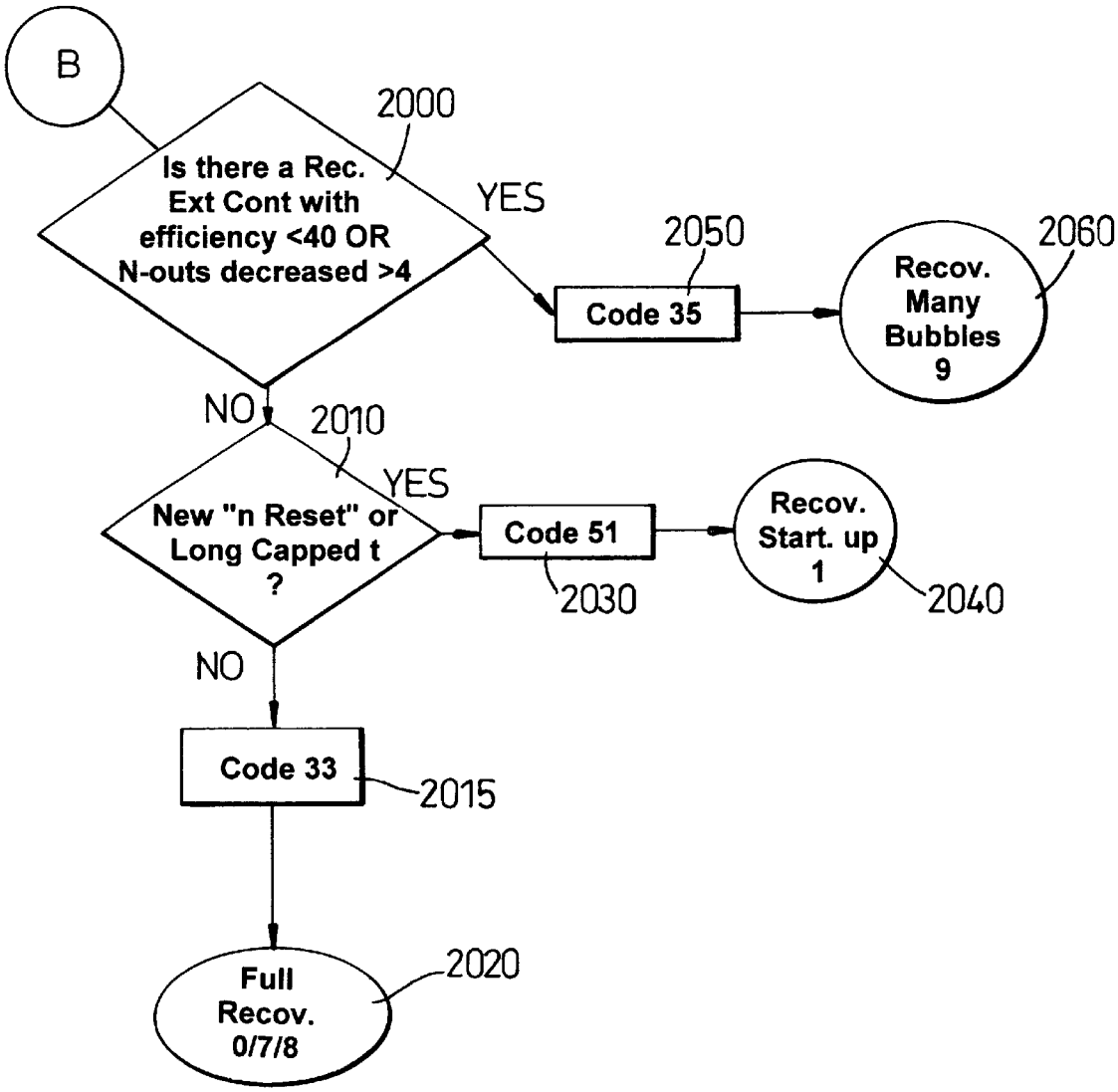
Figure 21:
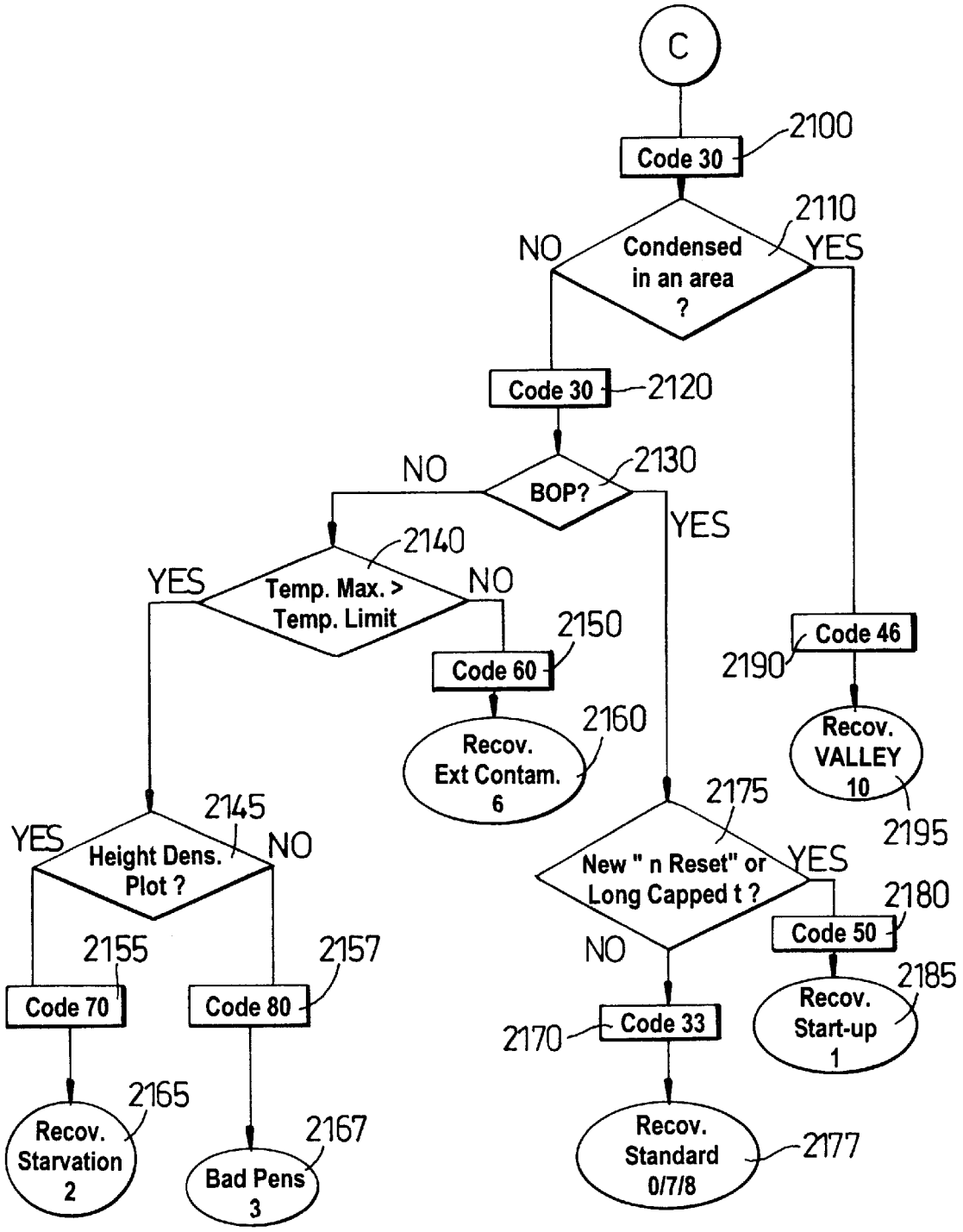
Figure 22:
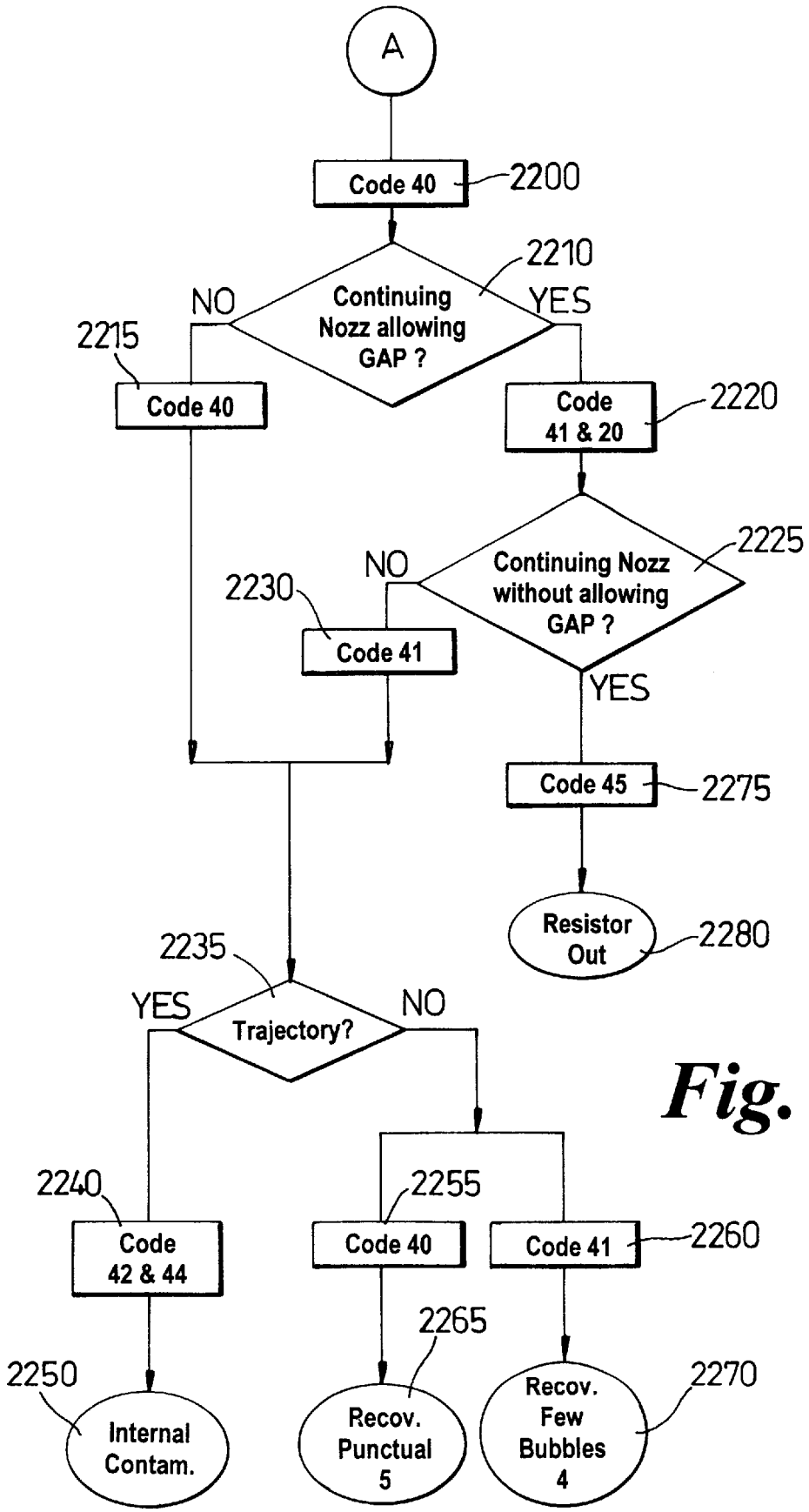

The thresholds vary for spitting and for priming as can be seen in accordance to FIG. 18, where curve 1510 refers to prime percentage threshold and curve 1520 refers to spit percentage threshold. In the graph of FIG. 15 on the X axis reference is the number of nozzles out before performing a recursive pass, while on the Y axis it is placed the threshold value in terms of percentage of nozzles out which must be recovered to trigger a recursive recovery pass.

The general equation governing these curves 1510, 1520 is:

$$\text{Recovery Percentage}=A*e^{-B(NO)}+C$$

Where A, B and C are determined by a curve fit through various critical points as shown in Table 6 where NO is the number of nozzles out before the recovery pass. In this example, for spitting A=90, B=−0.05, C=10 and for priming A=75, B=−0.11, C=25.

TABLE 6

| Spitting | | Priming | |
|---|---|---|---|
| Nozzles Out | Percentage | Nozzles Out | Percentage |
| 0 | 100 | 0 | 100 |
| 16 | 50 | 10 | 50 |
| Infinity | 10 | Infinity | 25 |

In this embodiment it is not employed a recursive wiping step, but the skilled in the art may appreciate that, similarly, a further curve may be used for defining a Recursive Threshold for Wiping. This value is set to a constant 0.

Maximum Recursive Spitting Cycles is the maximum number of the same spitting pass that can be sequentially performed during a the recovery servicing 1160. This threshold is set to 3 for all the printheads.

Maximum Recursive Wiping Cycles is the maximum number of the same wiping pass that can be sequentially performed during the recovery servicing 1160. This threshold is set to 1 for all the printheads.

Maximum Recursive Priming Cycles is the maximum number of the same priming pass that can be sequentially performed during the recovery servicing 1160. This threshold is set to 2 for all the printheads.

Maximum Total Priming Cycles is the maximum number of priming cycles that can be performed during the life of the printhead. This threshold is set to 35 for each color printhead (CMY) and to 50 for the black printhead.

Referring now to FIG. 12, the recovery servicing procedure will be described in greater detail in connection with a magenta pen. It will be apparent for the skilled in the art how the recovery procedure works with the different pens.

At step 1200 the recovery servicing procedure 1160 starts and will be described assuming that tests 1120 and 1130 identified that the magenta pen needs recovery. At pass 1210 it is selected the magenta printhead.

At pass 1220 a spit servicing command forces the magenta printhead to spit a predetermined amount of ink into its corresponding spittoon 108. For instance the printhead may fire 1000 drops only from the nozzles out at a frequency of 6 kHz and at a temperature of 50° C. (for Cyan pen is 600 drops at 6 kHz and 50° C., for Yellow pen is 450 drops at 6 kHz at 50° C., for Black pen is 1500 at 2 kHz without pre-warming the printhead), followed by spitting 4 drops from all the nozzles at 10 kHz and 50° C. (all the color pen use the same strategy and the black pen fires 15 dorps at 10 kHz at 50° C.) A drop detection step is performed on the printhead at pass 1230 to check the result of the spit pass. Test 1250 is performed to verify if the percentage of recovered nozzles (total number of nozzles out at the current drop detection divided total number of nozzles out at the previous drop detection) is above the Recursive Threshold Value for the magenta printhead. If NOT control passes to test 1300 at FIG. 13. If the result of test 1250 is YES a subsequent test 1260 is executed to verify if the number of spit passes 1220 executed during the current recovery procedure is equal to the Maximum Recursive Spitting Cycles threshold for the magenta pen, i.e. 3.

Test 1260 improves prior art recovery strategies where the recoveries needed to be developed to successfully recover the worst case failure of each type. For example, if some failures would require spitting 500 drops per nozzle to recover and others would require spitting 1500 drops per nozzle, the recovery algorithm would have to be sized to the higher of the two levels to cover both cases. The present recovering procedure, by means of a fast nozzle check implementation, allows for nozzle out checking also within the recovery step. Thus the printer is able to size the spitting to 500 drops and allow the printer to apply this spitting pass recursively, only as required, to recover the printhead. The result is a recovery strategy which is much less severe for the printhead but which can have a higher efficacy as well.

Returning to test 1260 if the result is YES, the control passes to test 1300, otherwise control passes to test 1240.

Test 1240 verifies if the number of current nozzles out, DDMap [j], are more that the Absolute Spitting Threshold for magenta pen, i.e. 1, AND if the number of current nozzles out which are NOT in the array of the permanent nozzles out, PermMapD[j], is more than the Relative Spitting Threshold for the magenta pen, i.e. 2.

If the result of test 1240 is "NO" as opposed to nozzles out, the recovery procedure ends at step 1460, otherwise a new spit pass 1220 is performed again, increasing the number of spit cycles executed in the current recovery, i.e. now 1+1=2, and the flow of steps is followed as before.

Test 1300 verifies if the number of current nozzles out, DDMap [j], are more than the Absolute Wiping Threshold for magenta pen, i.e. 1, AND if the number of current nozzles out which are NOT in the array of the permanent nozzles out, PermMap[j], is more than the Relative Spitting Threshold for the magenta pen, .ie. 2.

If the test 1300 returns "NO" the recovery procedure ends at step 1460, otherwise at pass 1310 a wipe servicing command forces the magenta printhead to be wiped according to a predetermined wiping strategy, increasing the number of wipe cycles executed in the current recovery procedure, i.e. now 0+1=1. For instance The wiping strategy for any color printheads includes spitting 20 drops from all nozzles at 10 kHz and 50° C., then perform 2 cycles of bi-directional wipe at a speed of 2 ips (inch per second). Then the magenta pen fires 600 drops (Y pen 600 and C pen 800) from all nozzles at 10 kHz (Y and C pens the same) and 60° C. (Y and C pens at 50° C.).

If the pen is black the wipe servicing includes spitting 10 drops from all nozzles at 10 kHz at 50° C., PEG the pen once at a speed of 2 ips and with an hold time of 0.5 sec. Then a wipe from the front to the back of the printhead is performed once at 2 ips speed, followed by a cycle of 3 bidirectional wipes at 2 ips. Then all nozzles spit 200 drops each at 10 kHz at 50° C.

A final spitting step is then performed: color pens fire 5 drops at 10 kHz at 50° C. while a black pen fires 15 drops at 10 kHz at 10° C.

A drop detection step is performed on the printhead at pass 1320 to check the result of the wipe pass. Test 1330 is performed to verify if the percentage of recovered nozzles (total number of nozzles out at the current drop detection divided total number of nozzles out at the previous drop detection) is above the Recursive Threshold Value for the magenta printhead.

If the result of test 1330 is "NO" control passes to test 1400 at FIG. 14. If the result of test 1330 is "YES" a subsequent test 1340 is executed to verify if the number of wipe servicing 1310 executed during the current recovery procedure is equal to the Maximum Recursive Spitting Cycles threshold for the magenta pen, i.e. 1. If the result of test 1340 is YES, the control passes to test 1400, otherwise control passes to test 1300.

Test 1400 verifies if the number of current nozzles out, DDMap [j], are more that the Absolute Priming Threshold for magenta pen, i.e. 4, AND if the number of current nozzles out which are NOT in the array of the permanent nozzles out, PermMap[j], is more than the Relative Priming Threshold for the magenta pen, .ie. 2.

If the test 1400 returns "NO" the recovery procedure ends at steps 1460, otherwise a test 1410 verifies if the total number of primes executed by the current pen, exceed the Maximum Total Priming Cycles for the magenta pen, i.e. 35. If the test return YES the recovery procedure ends at steps 1460, otherwise at pass 1420 a conventional priming servicing command forces the magenta printhead to prime, increasing the number of priming cycles executed in the current recovery procedure, i.e. now 0+1=1, as well as the total priming cycles. A drop detection step is performed on the printhead at pass 1430 to check the result of the prime pass. Test 1440 is performed to verify if the percentage of recovered nozzles (total number of nozzles out at the current drop detection divided total number of nozzles out at the previous drop detection) is above the Recursive Threshold Value for Prime for the magenta printhead.

If the result of test 1440 is "NO" the recovery procedure ends at steps 1460. If the result of test 1440 is YES a subsequent test 1450 is executed to verify if the number of prime servicing 1420 executed during the current recovery procedure is equal to the Maximum Recursive Prime Cycles threshold for the magenta pen, i.e. 2. If the result of test 1340 is YES, the recovery procedure ends at steps 1460, otherwise control passes to test 1400 again.

In the following it is provided how the recovery procedure may work trying to recover a Magenta pen with 32 nozzles out:

DO SPIT RECOVERY Magenta
Drop Detect==20 Nozzles Out
Spit Efficiency=37.5%
Recursive Threshold Spit at 32 Nozzles Out=28% (Satisfied)
Spit Cycles=1
Max Cycles=3 (Satisfied)
Absolute Threshold Spit=1 (Satisfied)
Relative Threshold Spit=2 (Satisfied)
SPIT RECOVERY Magenta
Drop Detect=18 Nozzles Out
Spit Efficiency=10%
Recursive Threshold Spit @ 20NO=43% (Not Satisfied
Absolute Threshold Wipe=1 (Satisfied)
Relative Threshold Wipe=2 (Satisfied)
DO WIPE RECOVERY COLOR
Drop Detect=20 Nozzles Out
Wipe Efficiency=0% (Actually negative but clips at zero)
Absolute Threshold Prime=4 (Satisfied)
Relative Threshold Prime=2 (Satisfied)

Total Primes=6
Max Primes Allowed Magenta=35 (Satisfied)
PRIME RECOVERY Magenta
Drop Detect=12 Nozzles Out
Prime Efficiency=40%
Recursive Threshold Prime @ 20NO=33% (Satisfied)
Prime Cycles=1
Max Recursive Prime Cycles=2 (Satisfied)
Absolute Threshold Prime=4 (Satisfied)
Relative Threshold Prime=2 (Satisfied)
Total Primes=7
Max Primes Allowed Magenta=35 (Satisfied)
PRIME RECOVERY Magenta
Drop Detect=6 Nozzles Out
Prime Efficiency=50%
Recursive Threshold Prime @ 12NO=45% (Satisfied)
Prime Cycles=2
Max Recursive Prime Cycles=2 (Not Satisfied)
LEAVE RECOVERY ALGORITHM FOR PRINTING The dynamic servicing process will now be described in greater details, again limited to one pen for clarity.

The bigger difference between full servicing above and dynamic servicing resides in the fact that the history of the nozzles of the printhead is used to attempt a pattern recognition of the failure. The dynamic process analyses the historical behaviour of the printhead and based on this it reassigns or assigns new failures code to one or more nozzles; this failure code is then taken into account to select the more appropriate recovery function. In this way it will be clear if the nozzle is out, for instance due to bubbles, to internal contamination, to start-up, to starvation and so on, i.e. it will be detected not only which is the nozzle that is failing, but also why.

With reference to FIGS. 19–22, it is shown in grater details the method to perform the pattern recognition of steps 1710 and 1750, to identify the failure modes of the failing nozzles The process starts at step 1900, when the database is opened, and the results of the current drop detection and of the history of the last Z drop detections, for each of the nozzle marked 0 or 1, are passed to the pattern recognition procedure. The output is a pair of failing nozzle vectors one containing the failure codes of odd nozzles and the other of even ones. All the aberrant nozzles (code 2 and 3) will be passed through a different pattern recognition procedure which will be described later. Preferably Z is grater than 30 and more preferably is equal to 40 or more. However, this number is dependent on the colour, e.g. black (K) yellow (Y) cyan (C) magenta (M) light cyan (Lc) or light magenta (Lm), and on the type of ink, e.g. dye, pigmented or textile, used by the pen. Some inks may require a larger history then others for allowing an accurate patter recognition of the nozzle failures. A preferred default value for the size of the history is 50 drop detection. However the database will store a deeper history, up to 5000 drop detections or more, which may be used for a more accurate investigation of the reasons of some failures occurred to the printer or the pen(s). Such history may be automatically review for instance by a software tester or manually by a service engineer.

At step 1905 it is checked if, in the last drop detection, more than 40 nozzles were out, i.e. had code equal to 1.

Experiments have verified that if the printhead has an high number of nozzles out, Preferably 40, it is likely that a single factor has caused all or most of the failures. For this reason and for speeding up the process has been decided that if the pen has this high failure rate the first failure code identified will be assigned to the entire pen and the pattern recognition stops without assigning codes to the remaining nozzles.

Then, control passes to step 1910, where it is checked if the current drop detection happened at the begin of plot. If not, at step 1920 it is controlled if the maximum temperature of the pen is higher than a limit, which preferably is set to about 60° C. If it is not a problem of temperature, this means that the failure is due to external contamination problems, like head crash or paper particles on the printhead or dried ink on the nozzle plate, thus at step 1930 the failing nozzles are set to code 61, and at step 1940 an external contamination recovery is "programmed" for these nozzles. "Programmed" means that once the failing nozzle vectors will contains all the new failure codes of the nozzles, the associated recovery functions will be ordered from the lighter to the stronger and applied to the printhead in such sequence. The code associated to the recovery function identifies the strength of the servicing, where a lower value means a softer servicing.

If the answer to step 1920 is yes, at step 1950 it is verified if the printed plot was an high density plot, preferably by checking whether the pen have fired more than a given number of drops for printing said plot. More preferably this number of drops is bigger than 1000. If so this means that a smaller quantity of ink is flowing to the nozzle plate, generally because a big bubble of air has been generated in the vaporisation chamber of the pen. In the following this failure is called starvation. Thus at step 1960 a code 71 is assigned to all the pen and at step 1980 a starvation recovery function is programmed.

If the test 1910 return yes, then at step 2000 it is checked if in the previous dynamic servicing an external contamination recovery was applied and it recovered less than 40% of the non-working nozzles OR between the last (after servicing) and the current (before servicing) drop detection the number of nozzles out decreased, preferably of 4 or more nozzles. If so, this means that the previous failure was not due to external contamination but due too many bubbles and that this failure was not solved by the previous "wrong" servicing. Many bubbles means that an high number of nozzles have bubbles of air in their ink channels. Then step 2050 assigns a code 35 to all the nozzles and a many bubbles recovery is programmed.

If test 2000 returns no, at step 2010 it is checked if a new reset of the printer occurred or the pen has been capped for a long period, preferably for more than 12 hours. If so, at step 2030 code 51 is assigned to all nozzles and at step 2040 a start-up recovery function is programmed. If test 2010 returns no, this means that an unknown failure has been detected, so at step 2015 a code 33 is assigned to all nozzles and a full recovery process is executed.

Returning to FIG. 19, if test 1905 returns no, we move to step 1995. Contrary to the other branch of the tree, in this case all the failure codes are assigned to specific nozzles and not to the entire pen.

At step 1995 it is checked (i) which of the failing nozzles in the current drop detection are condensed in a zone, so step 2190 assigns these a temporary code 30; and (ii) which of the failing nozzles are isolated, so step 2200 gives these a temporary code 40. Depending on the answer to this question a temporary code is given to all the nozzles out, since a pen can have several nozzles out condensed and several nozzles out isolated.

Table 7 shows a hypothetical even row of nozzles where the failing ones are the nozzles 10, 150, 152, 154, 400, 404 and 524. There is a box that means that the current drop detection and then the temporary fail vector.

TABLE 7

| | Nozzle 10 | Nozzle 150–152–154 | Nozzle 400–402–404 | Nozzle 520 |
|---|---|---|---|---|
| Current DD: | v | v X v | v v | v |
| Code: | 40 | 30 30 30 | 30 0 30 | 40 |

Next, all nozzles with code 30 will be analysed. We need to know if these are located in a know valley of the printhead or these has been generated by a bigger problem like start-up, starvation or External contamination. In this example it is assumed that these pens have a defect which causes a valley between even nozzles 200 and 280

At step 2110, if the condensed nozzles out are EVEN numbers located between nozzles number 200 and 280, we are facing a Valley and a code 46 is assigned to these at step 2190. At step 2195 a valley recovery is programmed for such nozzles.

If not, a test 2130 is executed to check is the current drop detection was performed at the beginning of plot.

If not, steps similar to steps 1920–1990 are performed to understand whether the failure is caused by start-up, external contamination or starvation. Thus, at step 2140 it is controlled if the maximum temperature of the pen is higher than a threshold, preferably 60° C. or more. If not, at step 2150 the failing nozzles are set to code 60, and at step 2160 an external contamination recovery is programmed for these nozzles.

If the answer to step 2140 is yes, at step 1950 is verified if the printed plot was an high density plot. If so this means that the pen suffer a problem of starvation; thus at step 1960 a code 71 is assigned to all the failing nozzles and at step 1980 a starvation recovery function is programmed for these nozzles.

Returning to test 2130, if the answer is yes, at step 2175 it is checked if a new reset of the printer occurred or the pen has been capped for a long period. If so, at step 2180 code 50 is assigned to the failing nozzles and at step 2185 a start-up recovery function is programmed for these nozzles. If test 2175 returns no, at step 2170 a code 33 is assigned to these nozzles and a full recovery process is programmed at step 2177.

Returning to step 2200, a test 2210 for continuing nozzles with gap is run for each nozzle (good or 40) by looking at its history.

Preferably for each nozzles the history includes the current plus last 30 drop detections. In the current best mode it is determined if the nozzle is a continuing (intermittent or continuing) failing nozzle. To check this , a number of drop detection for this nozzles is taken into exam and it is detected how often the nozzle was working or non-functioning. Preferably, if in 6 drop detections (current plus last 5) failed 4 or more times and was firing 2 or less times (this is defines the allowed gap) it is flagged as continuing failing nozzle. The skilled in the art may appreciate that these vales are entirely experimental, and that can be easily varied if the requirements for assigning a failure become more or less strict.

Depending on the answer, a different temporary code is assigned. If it's the first time (or too long since the last time it failed) that the nozzle fails, the code 40 is maintained at step 2215. If the nozzle is identified as a continuing falling nozzle, at step 2220 it will receive (i) a code 41 if it is currently failing or (ii) a code 20 if it is currently working (meaning that in the close past failed at least 4 times) and not 0.

At step 2225, it is investigated if each code-41 nozzles out is failing in a continues way or intermittent way, by checking if was failing in the previous 5 plus current drop detections. Then, if it returns no, this means that the nozzles out have been never recovered again, and are classified as nozzles with resistor out and at step 2275 a code 45 is assigned. At step 2280 the process end without recovery for these resistor out nozzles.

The code-41 nozzles out, that fail in an intermittent way, maintain their code at step 2230. In the following Table 8 is given an example of continuing nozzles out.

TABLE 8

| | Nozzle 10 | Nozzle 150–152–154 | Nozzle 400–402– | Nozzle 520 |
|---|---|---|---|---|
| Previous | x | x x | | |
| Current DD: | x | x x x | x x | x |
| First Code: | 40 | 30 30 30 | 30 0 30 | 40 |
| Continuing nozzles out? | | | | |
| Second Code: | 41 | 30 30 30 | 30 0 30 | 40 |

Figure 23:
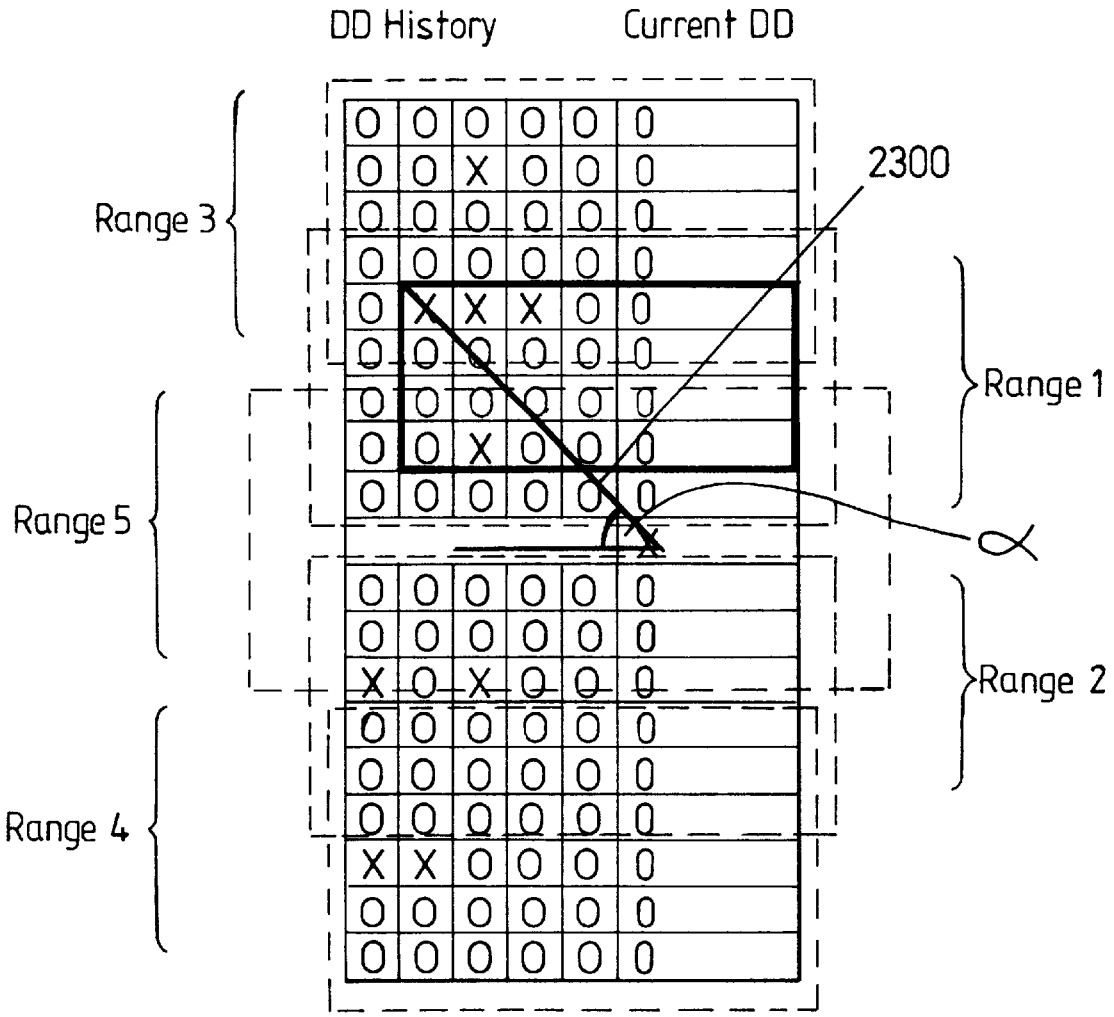
FIG. 23 shows a matrix of drop detections used to identify a trajectory of failing nozzle(s) over time.

At step 2235 the algorithm analyses all the remaining nozzles with code 41 (intermittent nozzles out) and 40 (isolate but not continuing nozzle out) to see whether it exists a trajectory in a given range around each of such nozzles. As shown in FIG. 23, this range is a matrix of 18 nozzles (all EVEN or all ODD), of which 9 above and 9 below the analysed nozzle and 6 drop detections per nozzle. This matrix is formed by five smaller overlapping ranges (6DD×6Nozzles) built in the following way: the first range is extending for 6 nozzles directly above the analysed one and with a dept of 6 drop detections, the second range is extending for 6 nozzles directly below the analysed one and a dept of six drop detections. Third and Forth ranges are like the first and second ranges but shifted respectively 3 nozzles up and 3 nozzles down. The fifth range is the central one extending from three nozzles above the analysed one to three nozzles below it. Then it is calculated the sum of nozzles out in each of the smaller 6×6 ranges and then it is selected the range that has more nozzles out as far as it has more than 1 nozzle out. The next step is to reduce the selected 6×6 range to an even smaller range which has to contain all such nozzles out. Then, the corner of this range and the nozzle to be analysed creates a trajectory 2300. An acceptable trajectory will have a slope bigger than a given threshold. Preferably this threshold is an angle α comprised, including the extremes, between 10 and 90 degrees.

If a nozzle out has an acceptable trajectory, at step 2240 it will change the code to 42; at the same time its neighbour nozzles, even if good nozzles, will have a new code assigned (code 44) meaning that they are neighbours of a 42 nozzle. Preferably 2 neighbours per side will have the code changed, as show in Table 9. At step 2250 an internal contamination action is programmed for nozzles 42 and 44. Experiments run by the Applicant have shown that internal contaminants can be hardly removed, and that, if these nozzles are serviced, it is likely that the contaminants are displaced somewhere else on the printhead, i.e. damaging other nozzles which possibly were working in the past. The rationale in this case is to disable the failing nozzle and its neighbours so that the internal contamination will not be moving while printing a plot. This means that the print mask generation process will error hide nozzles with code 42 and 44 and will select working nozzles that are more likely to function during the printing the plot (in fact no drop detection is expected while printing a plot).

If the nozzle out hasn't an acceptable trajectory, the code 40 (step 2255) or 41 (step 2260) will not change. Then a code 40 means that the nozzle out is punctual and a code 41 means that the nozzle out may be caused by a bubble. Accordingly at step 2265 a punctual recovery is programmed on nozzle 40 while on step 2270 a few bubble recovery is programmed for nozzle 41.

In Table 9 an example of pattern recognition of a trajectory is shown assuming that nozzle out 520 has an acceptable trajectory. Then, the code will change to 42 and the neighbours code will change to 44.

TABLE 9

| | Nozzle 10 | Nozzle 150–152–154 | Nozzle 400–402– | Nozzle 520 |
|---|---|---|---|---|
| Previous | x | x x | | |
| Current DD: | x | x x x | x x | x |
| First Code: | 40 | 30 30 30 | 30 0 30 | 40 |
| Second Code: | 41 | 30 30 30 | 30 0 30 | 40 |
| Internal contamination trajectory analysis: analyse just code 40 and 41 | | | | |
| Third | 41 | 30 30 30 | 30 0 30 | 44 44 42 44 44 |

Finally, all the failing codes of the printhead generated by the dynamic recovery process will be stored in two final fail vectors, one for the even nozzles and one for the odd nozzles. According to the examples above the final fail vector for the even nozzles will be:

| Nozzle: | 2 . . . 8 | 10 | 12 . . . 148 | 150 | 152 | 154 | 156 . . . 398 | 400 | 402 | 404 | 406 . . . 512 | 516 | 518 | 520 | 522 | 524 |
|---|---|---|---|---|---|---|---|---|---|---|---|---|---|---|---|---|
| Code: | 0 . . . 0 | 41 | 0 . . . 0 | 30 | 30 | 30 | 0 . . . 0 | 30 | 0 | 30 | 0 . . . 0 | 44 | 44 | 42 | 44 | 44 |

The pattern recognition used to seek aberrant nozzles is simpler. Basically, it is just looking for continuing aberrant nozzles, i.e. nozzles with a tendency to be aberrant nozzles. A punctual aberrant nozzle, having code 2 and 3, generally does not hurt the image quality but a continuing aberrant nozzle, either low or high aberrant, does and it is identified by code 10.

As in the case of checking continuing nozzles out at step 2210, the pattern recognition looks for a nozzle that has been aberrant at least X times in the last Y drop detection, where X is preferably greater than 8 and Y is greater than 12, i.e. allowing the nozzle to work 3 times in the last 12 drop detections. This allows to classify as continuing aberrant nozzle, nozzles which are aberrant in an intermittent way.

As said above the dynamic recovery process is basically formed by two major phases, a patter recognition and a recovery cycle. In the following it will be describes how the recovery cycle interfaces the output of the pattern recognition, i.e. the final fail vectors.

Table 10 contains a summary of the failure mode codes for failing nozzles. Preferably, all these failure mode codes are generated each time during the pattern recognition and stored in the final fail vector. The contents of this vector is not stored in the database as part of the drop detection history, and once that that the recovery servicing procedure has finished, these values are discarded.

TABLE 10

| CODE | EXPLANATION |
|---|---|
| 50/51 | Start-up |
| 70/71 | Starvation |
| 80/81 | Bad pen (too hot when printing low density plot) |
| 60/61 | External contamination |
| 41/20 | Continuing nozzle out: bubbles |
| 40 | Punctual nozzle out |
| 46 | Valley |
| 10 | Continuing aberrant nozzle |
| 42 | Internal contamination |
| 44 | Neighbour of internal contamination |
| 45 | Resistor out |

Preferably each of the above failure mode code will trigger a specific recovery function or action as shown in Table 2 above.

In addition, if the dynamical recovery process works with pens which may have different ink systems, e.g. pigmented or dye-based ink, some modifications need to be taken into account. From tests run by the Applicant, the pattern recognition may remain substantially the same, but depending on the ink system in use the specific recovery functions triggered may be different. For instance, in case of external contamination, a recovery for a pigmented ink preferably requires a high wipe speed, while a recovery for a dye-based ink preferably requires a low wipe speed.

A pen may have nozzles out with different failure mode codes, as shown in the examples above, then more than one specific recovery function needs to be applied to the printhead. The less aggressive recovery will be done first and the most aggressive will be done at the end.

For instance if the printhead has bubbles and very aggressive recovery (to recover other nozzle out typology) is applied prior to recovering them, the servicing may end up with an increase of the amount of bubbles. This means that first the bubbles need to be recovered and then the aggressive recovery can be applied to recover the other nozzle out typology. Each specific recovery has a different code, as shown in Table 2 and in FIGS. 19–22: the lowest is the code, the less aggressive/strong is the recovery, and this code is used to sort the functions before being applied.

Preferably, a fibre detection function can be added to the pattern recognition procedure. A long fibre or a piece of paper could block partially the drop detection light path. Having the fail vector for all the pens in the printer it can be analysed if the drop detection detects the same amount of nozzles out in all pens. If the drop detector detects more than 30 nozzles out that may be due to a fibre, an error message may appear in the front panel, informing the user of the kind of failure. If the drop detector detects less than 30 nozzles out due to a fibre the printer considers those 30 nozzles as being good.

Now it is described in greater details how each specific recovery function works, together with its strength code and thresholds.

Some failure modes codes do not trigger any specific recovery function because either they cannot be recovered (resistor out) or it is not entirely known how to recover them. The skilled in the art may appreciated that any novel specific recovery function can be added in this process without departing from the spirit of the present invention Each recovery may also have one or more thresholds to be triggered, preferably a triplet. The value of each threshold may be different for different specific recoveries, colours and ink types.

In this embodiment having 4 pens, a starting threshold of a specific recovery function is a vector of 4 values {x, y, z, a,}, which stores all the different starting thresholds of a such function when applied to pen of different colours (K, Y, C, M). For instance this means that a K pen needs 'x' nozzles out with a specific failure mode code to trigger the corresponding specific recovery function in that colour. Similarly y nozzles out are the trigger for a yellow pen and so on. In case that the printer uses more colours, e.g. like light cyan or light magenta, this vector is expanded by adding more values, e.g. two new values. Preferably, different vectors can be provided for different ink types but, for simplicity, in the following reference is made to only one vector.

A recovery threshold contains a value representing the percentage of nozzles which need to be recovered by said recovery function in a single run. If the number of recovered nozzles is above the threshold this allows the same specific recovery to be applied again, if a repeated cycle of specific functions is applied. The percentage of nozzles that need to be recovered is calculated on the total number of failing nozzles (i.e. nozzles originally marked as 1, 2 or 3) which have caused the failure associated to that recovery.

An anti-damage threshold contains a value representing a maximum number of nozzles of a non currently serviced printhead which, during a cycle of recovery functions, can be damaged (i.e. working nozzles converted into no-working) by the servicing applied on the serviced printhead. If more nozzles than this value are damaged, future iteration of the recovery function will be inhibited. This anti-damage threshold is particularly beneficial when a wipe servicing is applied. Because of the way the wipers on the printhead cleaners can be actuated and applied to the nozzles plate, it may happen that when wiping a printhead, simultaneously, one or more additional pen are wiped. Thus while the required servicing, including a wiping step, may be beneficial for such a pen, it is likely to damage other pens. If this happens, and the generation of non-working nozzles is higher than the anti-damage threshold, the servicing, including the wiping step, is no longer repeated in the current dynamic recovery process. Similarly, this concept applies to all the specific recovery functions.

Start-up Recovery

This recovery consists of spitting all the nozzles from the pen that is suffering Start-up. Preferably the recovery is 1500 spits per nozzle, at 50° C. and 10.000 Hz.

The starting threshold is {3,3,3,3} and the recovery threshold is 20% of nozzles recovered. The anti-damage threshold is 5 and its strength code is 1

External Contamination Recovery

This recovery is among the few ones which use a wiping step. One of the bigger benefits of using specific recoveries has been the reduced use of the wipe servicing since if applied improperly it may generate more problems, e.g. the wiper may force dried ink or contaminants into one or more nozzles. The wipe is used only when it is known that it will be useful. Several steps exist in this recovery function:

Pre-wipe spitting which spits 200 spits to all the pen at 50° C. and 10.000 Hz.

Bi-directional wipe: 6 cycles at 2 ips.

Post-wipe spitting which spits 200 spits to all the pens at 50° C. and 10.000 Hz All the thresholds are preferably higher than the ones of most of the remaining recoveries, in order to reduce to a minimum the usage of this function. The starting threshold is {5,5,5,5}, the recovery threshold is 40%, the anti-damage threshold is 5 and its strength code is 6

Few Bubbles Recovery

Once a bubble is detected, a good way to recover it is to spit at different frequencies the nozzle with the bubble and its neighbours. In this recovery, the spit step applies to the nozzles with the bubble and to extra X neighbours at both sides. Preferably X is equal to 5 or more.

Spit 200 drops at 50° C. and 1.000 Hz.

Spit 200 drops at 50° C. and 15.000 Hz.

Spit 200 drops at 50° C. and 1.000 Hz.

The starting threshold is {3,3,3,3}, the recovery threshold is 20%, the anti-damage threshold is 5 and its strength code is 4.

Punctual Nozzle Out Recovery

The recovery just applies the following servicing to the sole nozzle that is failing: spit 50 drops at 50° C. and 10.000 Hz.

The starting threshold is {3,3,3,3}, the recovery threshold is 20%, the anti-damage threshold is 5 and its strength code is 10

Valley Recovery

The recovery applies the following servicing to the failing nozzles:

Spit all pens 20 drops at 50° C. and 10.000 Hz

Prime bad pen(s)

Wait 6 seconds

Wipe 3 cycles at 2 ips

Spit all pens at 800 drops at 50° C. at 10.000 Hz

Snoutwipe with wiper 190

The starting threshold is {8,8,8,8}, the recovery threshold is 40% the anti-damage threshold is 3 and its strength code is 10.

6.7. Starvation Recovery

If starvation has been identified, there is no servicing currently available for this defect. Preferably a message is sent to the user through the user interface advising to replace the pen. If the pen is not replaced the printmode is changed by increasing the number of passes, to reduce the throughput of the pen and to prevent the pen from not receiving enough ink.

The starting threshold is {0,0,0,0}, the recovery threshold is 0 the anti-damage threshold is 1000, or any high value that avoid stopping the recovery in case other failing nozzles are generated in other pens, and its strength code is 2.

Bad Pens Recovery

The associated failure mode refers to a pen which become too hot when it prints a low-density plot. Again no servicing is available. Preferably a message is sent to the user, through the user interface, advising to replace the pen. If the pen is not replaced the printmode is changed by increasing the number of passes, reducing the throughput of the pen, to prevent the pen to become too hot again.

The starting threshold is {0,0,0,0}, the recovery threshold is 0 the anti-damage threshold is 1000, or any high value that avoid stopping the recovery in case other failing nozzles are generated in other pens, and its strength code is 3.

Many Bubbles Recovery

This is a recovery consists of priming, wiping and spitting:

Spit all pens 20 drops at 50° C. and 10.000 Hz

Prime bad pen(s)

Wait 6 seconds

Wipe 3 cycles at 2 ips

Spit all pens at 800 drops at 50° C. at 10.000 Hz

Snoutwipe with wiper 190

The starting threshold is {8,8,8,8}, the recovery threshold is 40% the anti-damage threshold is 3 and its strength code is 9.

Full Recovery

This recovery can correspond to the full recovery process described above with reference to FIGS. 13–18.

Alternatively, a full recovery function can consist of (a) a conventional spitting recovery, with starting threshold equal to {3,3,3,3} or more, the recovery threshold equal to 20% or more, the anti-damage threshold equal to 5 or more and its strength code equal to 0.

(b) a conventional wiping recovery with starting threshold equal to {5,5,5,5} or more, the recovery threshold equal to 40% or more, the anti-damage threshold equal to 5 or more, and its strength code equal to 7; and (c) and conventional priming recovery with starting threshold equal to {8,8,8,8} or more, the recovery threshold equal to 40% or more, the anti-damage threshold equal to 5 or more and its strength code is 8.

These 3 recoveries are applied in sequence, from the lower strength code to the upper, but with an intervening drop detection step which checks the percentage of recovery before deciding if repeating the current recovery or passing to the following stronger one. This is applied each time that the pattern recognition is not capable of recognising a failure mode.

Figure 17A:
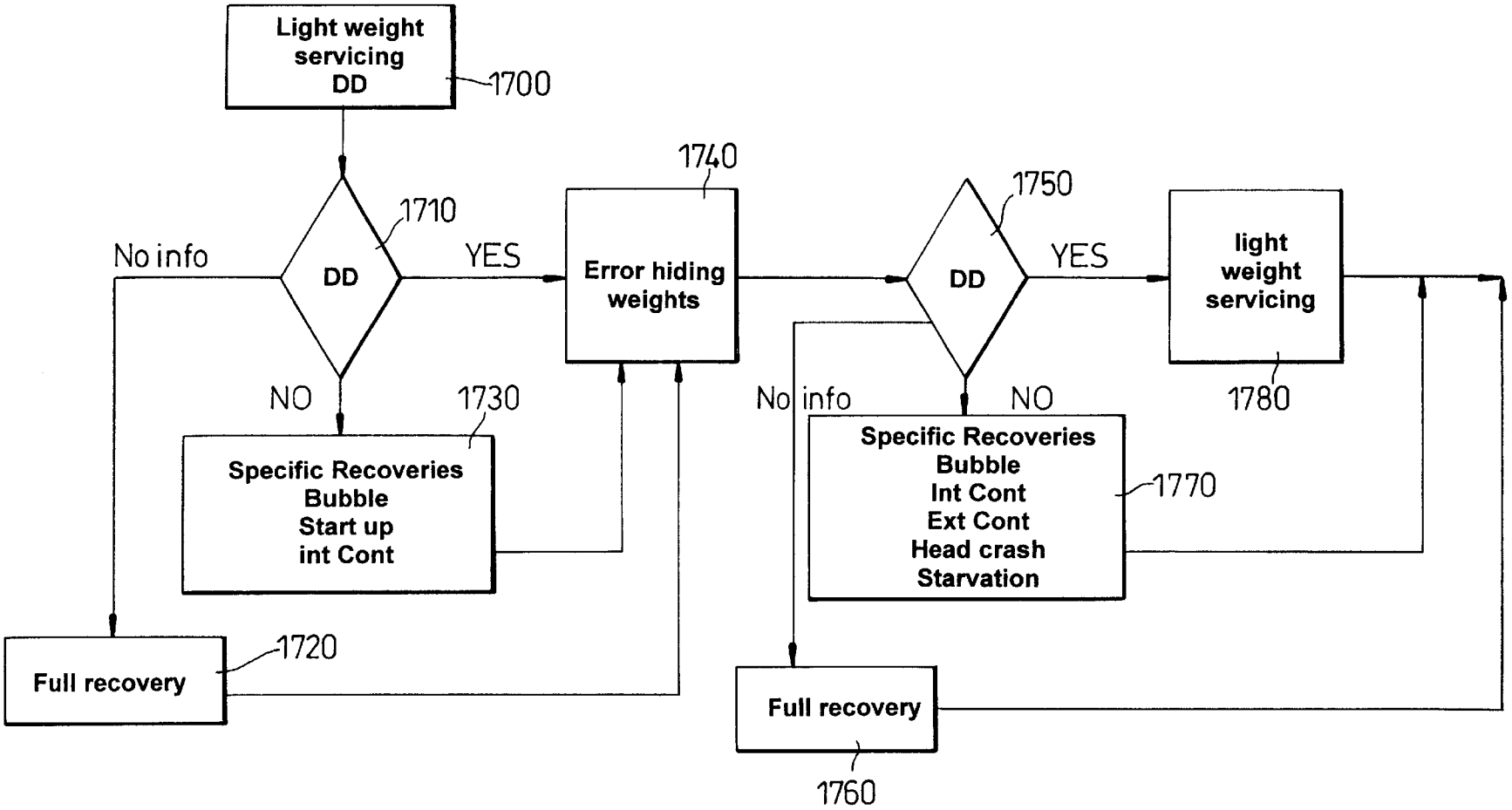
FIGS. 17A and 17B illustrate higher level steps of the printhead dynamic recovery process according to two embodiments of the present invention.
Figure 17B:
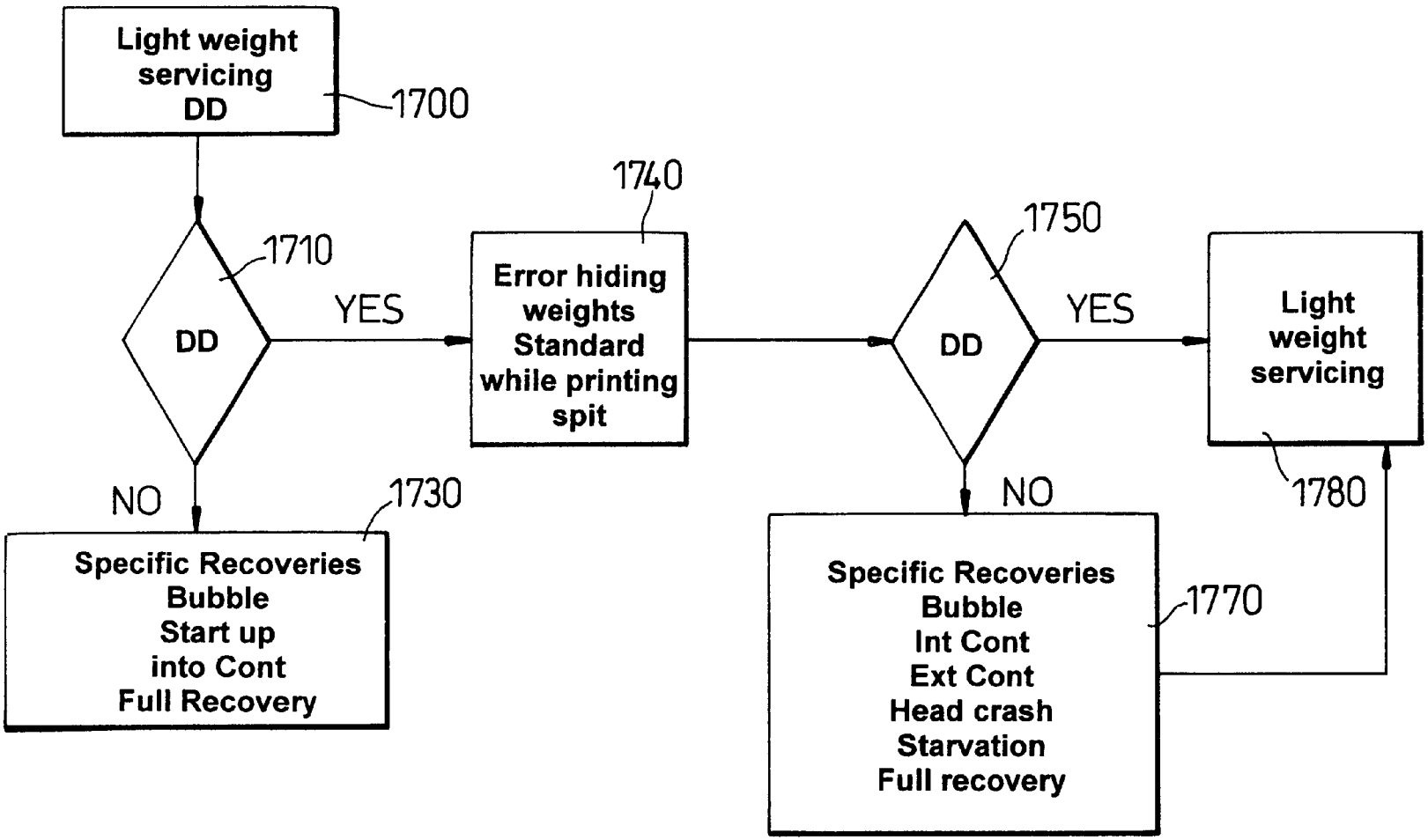

In a second preferred embodiment and in accordance to the above, the dynamic servicing process described with reference to FIG. 17A, is modified in a way that the full servicing process is entirely replaced by the use of the above full recovery function, integrated into the dynamic servicing process, as shown at FIG. 17B.

In FIG. 17B steps 1720 and 1760 have been removed and the lists of specific recoveries at steps 1730 and 1770 have been integrated with the addition of the full recovery function. This means that, whenever at steps 1710 or 1750 the drop detection history cannot be used for any reasons, a code 33 will be assigned to the nozzles of the entire pen. This will trigger a full servicing function on the entire pen at the corresponding following step 1730 or 1770.

Fibre Detection

If the drop detector detects more than 30 nozzles out that may be due to a fibre, an error message should appear in the front panel, informing the user of the kind of failure. If the drop detector detects less than 30 nozzles out due to a fibre the printer considers those 30 nozzles as being good.

Figure 24:
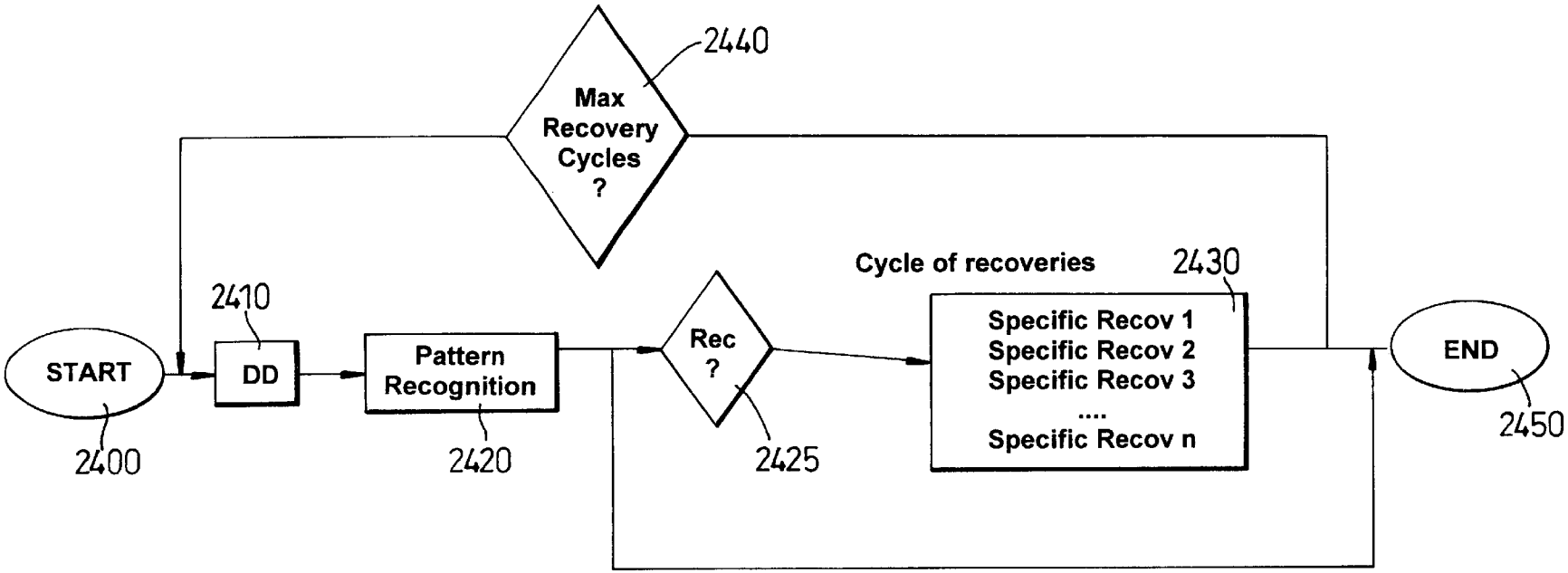
FIG. 24 illustrates in more detail steps on how cycles of specific recovery functions are generated and managed in dynamic recovery process.

If we move now to FIG. 24 it is shown how the dynamic servicing process applies the recovery functions associated to the fail vectors to the printhead.

At step 2400 the process starts and at step 2410 a drop detection is performed. At step 2420 a pattern recognition is made, based on the results of drop detection and, as described above, it returns a pair of fail vectors containing the failure mode codes for each non-working nozzle. Test 2425 checks if the failure mode codes in the failing nozzles require any specific recovery functions to be applied to the pen or to any nozzles. If any programmed recovery, taking into account all the associated thresholds, is triggered, control passes to step 2430 where all the triggered functions are ordered in a list from the one having the lower strength code to the one having the higher code, generating one cycle of recovery functions. Then each of the functions in the cycle is applied in sequence to the pen or nozzles. Once the cycle finishes, a test 2440 is done to verify if the number of cycles of recovery functions applied to the printheads is bigger than a certain threshold, which preferably is set to 3. If 3 cycles have been already done the process makes a final drop detection and a pattern recognition, to check which are the nozzles still failing or at risk of failure which need error hiding, and ends at step 2450. If the limit has not been reached, a new drop detection 2410 and patter recognition 2420 is performed in order, if necessary, to generate a new cycle of recovery functions, which may be different from the previous one.

Figure 25:
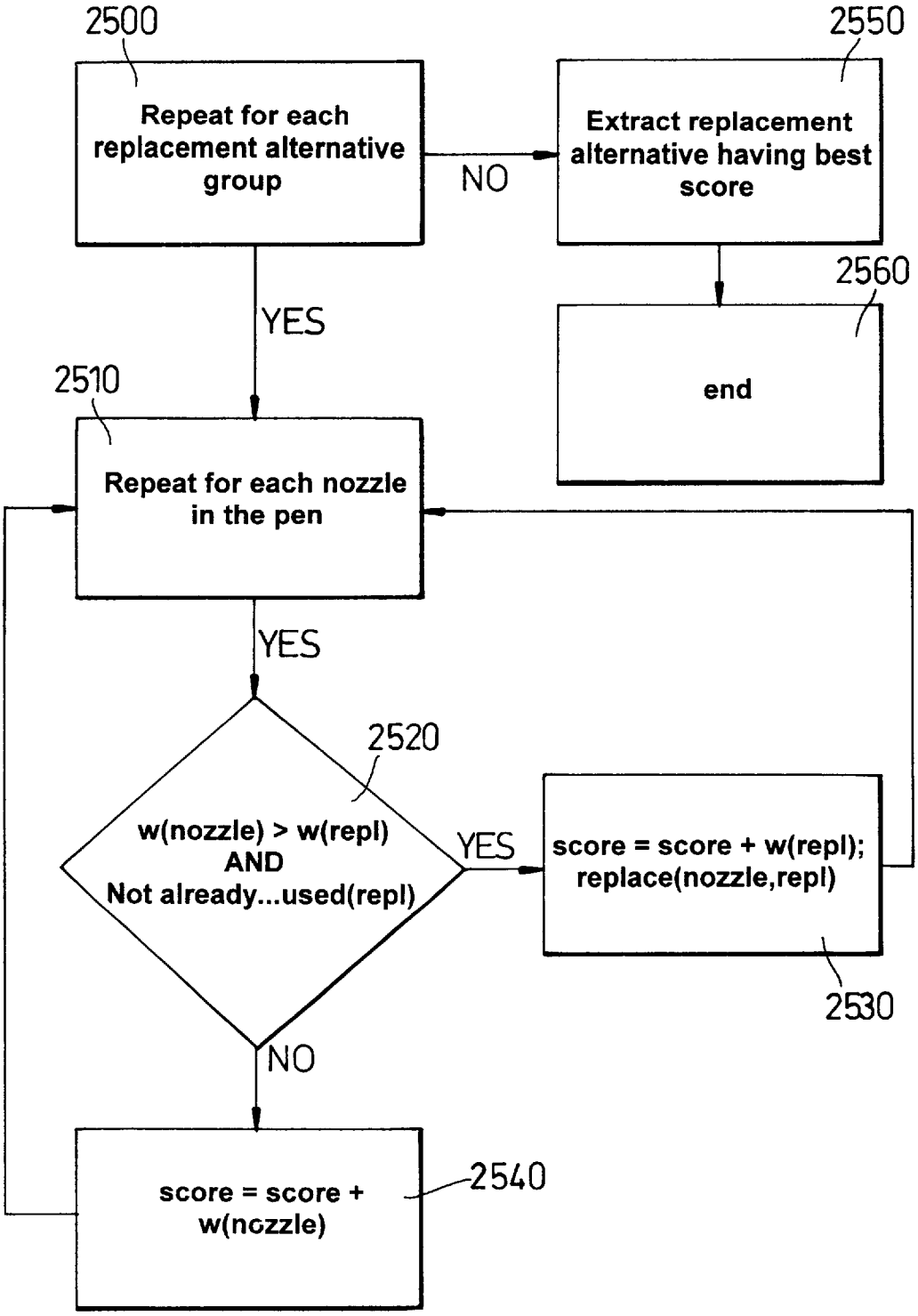
FIG. 25 illustrates schematically steps involved in nozzles error hiding.

With reference to FIG. 25 an exemplary error hiding technique which can be used to hide artefacts made by not recovered nozzles or aberrant nozzles is described It is known to use error hiding to improve the print quality. In EP patent application no. 98301559.5 it is describe a technique which use a pattern based nozzle health detection technique, based on a LED line sensor mounted on the pen carriage which reads a printed pattern to find misdirected or missing dots corresponding to nozzles out, weak and some kinds of misdirection.

This technique is executed each certain number of plots and apply error hiding on the failing nozzles. However, this approach has some limitations:

- It is slow and this limits the number of times that it is possible to perform without heavily affecting throughput and printer productivity. This means that the result of a single detection will be used for several plots with the risk of printhead nozzle health changing over time.
- Only the most recent detection is used, making impossible adjusting the error hiding strategy to printhead nozzle health dynamic variations, such as internal contaminants moving inside the nozzles, air accumulation, nozzle plate dirtiness, head crashes (printhead touching media while printing), external contaminants moving on the nozzle plate, or the like.
- Each cycle of the technique implies a certain waste of media or a media change since cannot successfully work on all media.

In addition to the previous definitions already described for maintaining historical health information on nozzles, the following definitions also will be used in this embodiment.

Dnozzi: this array contains the results of the last eight drop detections for the ith nozzle.

Dnozzi[7] contains the result of the more recent drop detections

Dnozzi[0] contains the result of eight usable drop detects ago.

For the sake of clarity DDMap and Dnozzi has been described independently but both contains the same information. Each DDmap vector contains the data for each nozzle according to a single drop detection, while each Dnozzi contains the data for a single nozzle according to all the usable drop detections. Thus according to the various examples system comprising a pen having 524 nozzles which wants to maintain a history of 8 drop detections needs 524 Dnozzi[8] vectors and 8 DDMap[524] vectors b: contains the factor for weighting the historical result of the usable drop detection, i.e. a value which allows to emphasise measurements related either to more recent drop detections (when b contains bigger values) or to older drop detections (if b contains smaller values).

W: is a function able to calculate the weight of a given historical drop detection array Dnozzi[].

W is defined as:

$$W\left(Dnozzi[\,] = \sum_{i=0}^{7} Dnozzi[i] \cdot b^{i}\right.$$

W is then normalised to obtain a function w in the [0.1] range which correspond to a distribution of probability.

$$w(Dnoxxi[\,] = \frac{W(Dnozzi[\,]}{W(\{1,1,1,1,1,1,1,1\})} = \frac{\sum_{i=0}^{7} Dnozzi[i] \cdot b^{i}}{\sum_{i=0}^{7} b^{i}}$$

Thus w attempts to predict the probability that the ith nozzle would pass the next drop detection, i.e. would fire properly. In order to do so the value of b is chosen by using its maximum likelihood estimator for the w distribution.

With reference to FIGS. 26A to 26D, it is shown how the value of w changes for one nozzle after every drop detection, where each figure refers to the same nozzle history but applying a different values for the basis b.

Figure 26A:
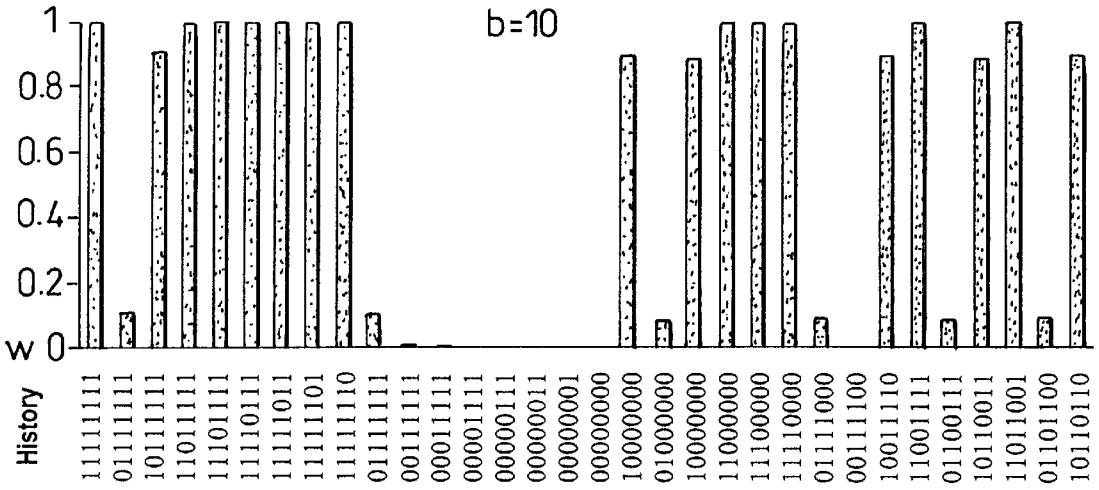
FIGS. 26A–26D are diagrams showing how the probability of finding a non-working nozzle varies according to its health history and to 4 different weighting basis.

In FIG. 26A b is equal to 10 and it is shown how the more recent 1–2 detection are considerably affecting the weight result.

Figure 26B:
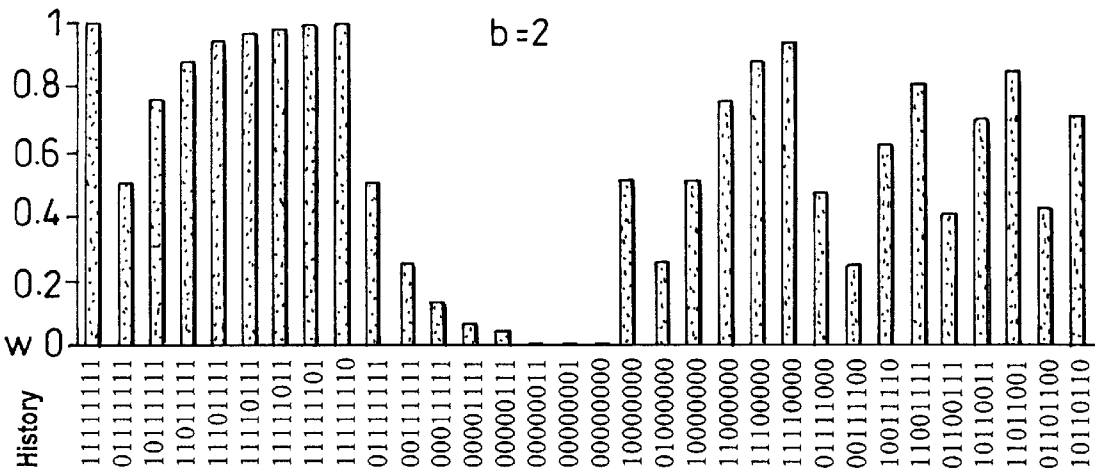

In FIG. 26B b is equal to 2, i.e. the weight of the last detection is bigger than the sum of the weight of all the previous detection. Thus, a non-working nozzle which has fired only once but during the last drop detect is weight more than a nozzle which is always firing but has failed during the last drop detection. Experiments run by the applicant have shown that the second nozzle is more reliable of the first one.

Figure 26C:
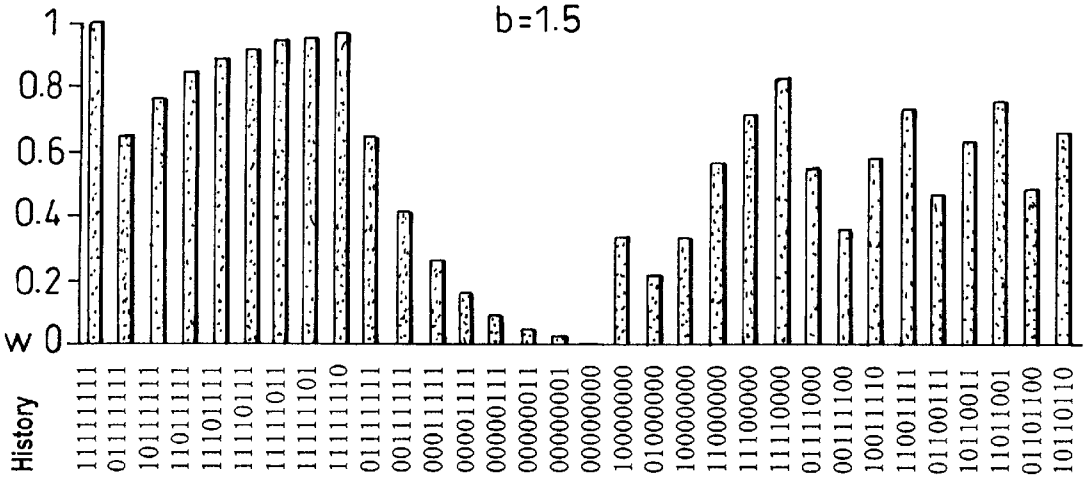

In FIG. 26C b is equal to 1.5 in order to take more into account the history of the nozzle.

Figure 26D:
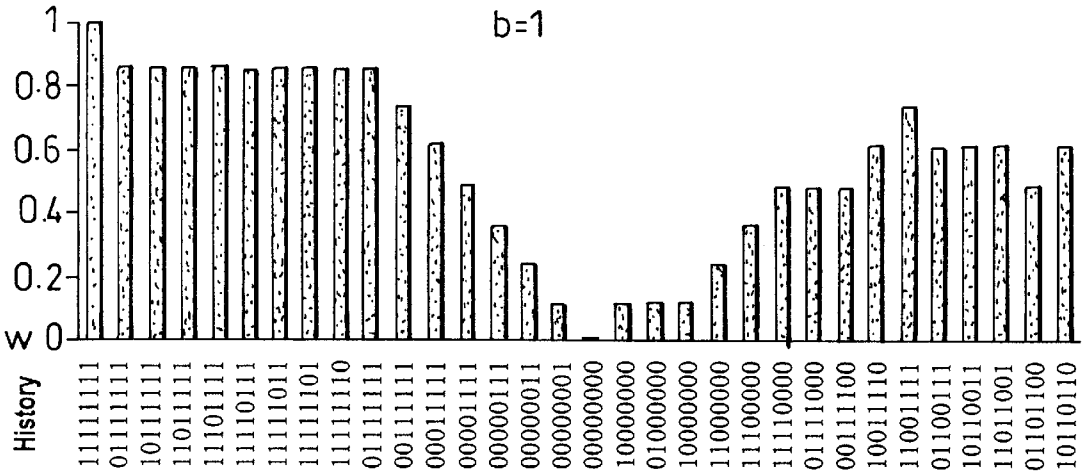

In FIG. 26D b is equal to 1, thus all the drop detection has the same history.

For each example the following history for the nozzle has been used, wherein 1 is correspond to working and 0 to failing:

Initial history {1, 1, 1, 1, 1, 1, 1, 1}

History: 0,1,1,1,1,1,1,1,0,0,0,0,0,0,0,0,1,0,1,1,1,1,0,0,1,1, 0,1,1,0,1

The values reported on the X axis correspond to blocks of 8 consecutive historical result starting from the initial history {1,1,1,1,1,1,1,1) and permuting the values according to the History up to the more recent block {1,0,1,1,0,1,1,0).

Extended test run by Applicant have shown that within a preferred range of values for the weight factor b included between 1 and 2 all of which are capable of providing a reliable estimation of the probability that the nozzle will work the next time it is fired, the better values are between 1.4 and 1.6, preferably 1.5, all of which are capable of providing a more realistic picture of the status of the nozzle.

Error hiding problems depends mainly on two error: a) wrong nozzle identification, i.e. the nozzle identified as failing is actually working, so there was non need to replace it; b) wrong nozzle replacement, i.e. the nozzle selected for replacement is actually non-working.

In the following will be described a probabilistic technique to determine if a nozzle should be replaced and by which other nozzle.

To determine if a nozzle should be replaced, the probability that it will fail the next drop detection is compared with a threshold, in this embodiment the value is 0. The estimation of this probability is obtained by means of the w function, i.e. 1-w would be the probability-to-fail score and this value will be used to identify the nozzle to be replaced.

Usually, error hiding implies a multi-pass printmode, even if there are techniques for performing error hiding even with one-pass print modes. In the following it will be described how this technique is working with a multi-pass printmode and while the skilled in the art may appreciate that the same technique will work using the same principles in single-pass printmodes.

The concept of printmodes is a useful and well known technique of laying down in each pass of the pen only a fraction of the total in required in each section of the image, so that any areas left white in each pass are filled in by one or more later passes. This tends to control bleed, blocking and cockle by reducing the amount of liquid that is on page at any given time.

The specific partial-inking pattern employed in each pass, and the way in which these different patterns add up to a single fully inked image is known as a printmode. For instance a one-pass mode is one in which all dots to be fired on a given row of dots are placed on the medium in one swath of the printhead, and than the print medium is advanced into position for the next swath.

A two-pass mode is a print pattern wherein one-half of the dots available in a given row of available dots per swath are printed on each pass of the printhead, so two passes are needed to complete the printing for a given row. Similarly, a four pass mode is a print pattern wherein one forth of the dots for a given row are printed on each pass of the printhead, so four passes are needed to complete the printing for a given row.

The patter used in printing each nozzle section is known as the "printmode mask" or "printmask" or sometime just "mask". A printmask is a binary pattern that determines exactly which ink drops are printed in a given pass or, to put the same thing in another way, which passes are used to print a each pixel. The printmask is thus used to "mix up" the nozzle used, as between passes, in such a way as to reduce undesirable printing artefacts.

EP application no 98301559.5 describes how to work with a plurality of selected print mask in order to implement error hiding in multipass print modes and the same technique may be used also in this case.

In the following will be described how to modify the masks for a given print mode in accordance to the probability that certain nozzles may fail to perform error hiding.

For the sake of clarity in the following example the following assumption will be done: a) printhead have four nozzles only , and 2) a four-pass 25% density interlaced printmode are used c) 4 bit masks are used.

Table 11 shows the standard print mask for the used printmode. The columns are the four nozzles of the pen and the rows are the four passes of the printmode. In addition, the cells contain a binary number meaning when the nozzle will fire for a given pass. The mask chosen are simple: in pass 0 all nozzles fire only every 4th dot, in pass 1 they fire every $3^{rd}$ dot, and so on.

TABLE 11

| | N0 | N1 | N2 | N3 |
|---|---|---|---|---|
| Pass 1 | 0001 | 0001 | 0001 | 0001 |
| Pass 2 | 0010 | 0010 | 0010 | 0010 |
| Pass 3 | 0100 | 0100 | 0100 | 0100 |
| Pass 4 | 1000 | 1000 | 1000 | 1000 |

At this point the different error hiding alternatives for this print mode shall be considered. Each alternative is a group of 4 element and the ith element of the group is the replacement for the ith pass. For instance the group {2, 4, 1, 3) means that the malfunctioning nozzles of pass 1 are to be replaced by nozzles of pass 2, malfunctioning nozzles of pass 2 by nozzles of pass 4, malfunctioning nozzles of pass 3 by nozzles of pass 1 and malfunctioning nozzles of pass 4 by nozzles of pass 3.

Instead of evaluating each possible alternative, the example will consider only two replacement alternatives: {2, 3, 4, 1} and {3,4,1,2}

The estimated probabilities (calculated as previously described using b=1.5 and the result of the most recent drop detections) for each nozzle to be found working are. N0=0.4, N1=0.7, N2=1, N3=1.

The technique weights each of the possible alternatives according the algorithm as will be described in accordance with FIG. 25. This process will try to select the alternative using the number of nozzles (original or replaced) having the bigger probably to work, as a whole, trying to exclude nozzles not recovered, intermittent and continuing aberrant.

The process start at step 2500, which for each of the possible replacement alternatives step 2510 is repeated.

At step 2510, for each nozzle of the pen test 2520, and steps 2530 or 2540 are repeated. Test 2520 verify whether the weight of said nozzle is smaller that the weight of the replacement nozzle, i.e. the replacement nozzle would more likely work better of the originally designated nozzle, AND if the replacement nozzle is still available, i.e. the replacement nozzle is not already in use for firing as an original nozzle.

If the result of the test is YES the score is increased of the a value equal to the weight of the replaced nozzle and the nozzle is considered replaced; otherwise the score is increased of the a value equal to the weight of the original nozzle. When the iteration 2510 ends score will contain a value corresponding to the quality of the first replacement alternative, in terms of sum of the probability of working of each nozzle (original or replaced) in this group.

Iteration 2510 will now start again to calculate the score of the next replacement alternative, and it will be repeated until all the replacement alternatives are evaluated. At step 2550 the process extract the replacement alternative with the best score and ends at step 2560 returning the elected replacement alternative to a know error hiding process to perform the error hiding in accordance with the proposed replacement.

If this process is applied on the above example option 1 {2,3,4,1} will score:

$$1+1+0.7+1=3.7$$

while option 2 will score $$1+1+1+1=4$$

Thus Option 2 will be elected to generate an updated printing masks as follow in table 9:

TABLE 9

| | N0 | N1 | N2 | N3 |
|---|---|---|---|---|
| Pass 1 | 0000 | 0000 | 0101 | 0101 |
| Pass 2 | 0000 | 0000 | 1010 | 1010 |
| Pass 3 | 0000 | 0000 | 0101 | 0101 |
| Pass 4 | 0000 | 0000 | 1010 | 1010 |

The result is that the two nozzles N0 and N1 having the higher probability of failing has been correctly replaced by the ones having higher probability of working.

What is claimed is:

1. A method of improving image quality on plots produced by a printhead, having a plurality of nozzles, mounted in an inkjet printing device for printing plots, at least a nozzle having at least a working status and a failing status and such printing device being capable of performing a variety of functions, said method comprising the steps of:

checking the status of one or more nozzles;

storing in a memory support the status of a checked nozzle as detected during said checking step; and based on a plurality of said statuses stored over time in said memory support, performing an appropriate servicing function from said variety for recovering a nozzle having a failing status back to a working status.

2. The method of claim 1, wherein a nozzle having a failing status comprises at least one of a malfunctioning nozzle or an aberrant nozzle.

3. The method of claim 1, where one or more servicing functions are applied in sequence if the nozzle continues to exhibit a failing status.

4. The method of claim 3, where after applying one or more servicing functions, one or more error hiding functions are also applied to hide a nozzle continuing to exhibit a failing status.

5. The method of claim 1, further comprising the step of identifying the cause of failure of a nozzle having a failing status, before the step of performing said appropriate function.

6. The method of claim 5, wherein said step of identifying comprises the step of observing the status of the nozzle is changing over time.

7. The method of claim 5, wherein said step of identifying the cause of failure of a nozzle having a failing status is based on examining said plurality of statuses individually stored over time in said memory support.

8. A computer program comprising computer program code means performing the following steps when said program is run on an inkjet printing device comprising a printhead, having a plurality of nozzles, and said printing device being capable of performing a variety of functions:

enabling the device to check a status of one or more nozzles;

storing in a memory support said status of a checked nozzle as detected during said checking step; and based on a plurality of said statuses stored over time in said memory support, enabling the device to perform an appropriate servicing function for recovering a nozzle having a failing status back to a working status.

9. An inkjet printing device for printing plots comprising:

a printhead, having a plurality of nozzle;

a servicing unit capable of applying recovery functions to said plurality of nozzles;

detection means for checking if one or more of said nozzles is in a working status or in a failing status; and memory means comprising a plurality of said recovery functions executable by said device to improve image quality, wherein said memory means, responsive to said detection means, includes a plurality of said statuses stored over time and wherein said device further comprises means to select and execute at least one of said plurality of recovery functions, responsive to said plurality of statuses stored in said memory means.

10. The method of claim 1, wherein each nozzle has at least a working status and a failing status.

11. An inkjet printing device for printing plots comprising:

a printhead, having a plurality of nozzles;

a servicing unit for applying recovery functions to said plurality of nozzles;

a sensor for detecting whether a nozzle is in a working status or in a failing status;

a memory, sharing a plurality of said recovery functions executable by said device to improve image quality, wherein said memory also stores a plurality of said statuses over time, based on detections performed by said sensor, and wherein based on a plurality of said statuses stored over time in said memory, said device performs an appropriate recovery function for recovering said nozzle from a failing status back to a working status.

* * * * *